US008388408B2

(12) United States Patent
Kobayashi et al.

(10) Patent No.: US 8,388,408 B2
(45) Date of Patent: Mar. 5, 2013

(54) METHOD OF MAKING DIAGRAM FOR USE IN SELECTION OF WAVELENGTH OF LIGHT FOR POLISHING ENDPOINT DETECTION, METHOD FOR SELECTING WAVELENGTH OF LIGHT FOR POLISHING ENDPOINT DETECTION, AND POLISHING ENDPOINT DETECTION METHOD

(75) Inventors: Yoichi Kobayashi, Tokyo (JP); Noburu Shimizu, Tokyo (JP); Shinrou Ohta, Tokyo (JP)

(73) Assignee: Ebara Corporation, Tokyo (JP)

( * ) Notice: Subject to any disclaimer, the term of this patent is extended or adjusted under 35 U.S.C. 154(b) by 801 days.

(21) Appl. No.: 12/461,533

(22) Filed: Aug. 14, 2009

(65) Prior Publication Data

US 2010/0093260 A1 Apr. 15, 2010

(30) Foreign Application Priority Data

| | | |
|---|---|---|
| Oct. 10, 2008 | (JP) | 2008-263375 |
| Nov. 11, 2008 | (JP) | 2008-288704 |
| May 27, 2009 | (JP) | 2009-127254 |
| Jun. 11, 2009 | (JP) | 2009-140079 |
| Jun. 16, 2009 | (JP) | 2009-143052 |
| Aug. 7, 2009 | (JP) | 2009-184271 |

(51) Int. Cl.
*B24B 49/00* (2012.01)
*B24B 51/00* (2006.01)

(52) U.S. Cl. ..... 451/5; 451/6; 451/8

(58) Field of Classification Search ..... 250/339.07, 250/339.11, 559.27; 451/5, 6, 8, 36, 41
See application file for complete search history.

(56) References Cited

U.S. PATENT DOCUMENTS

| | | | | |
|---|---|---|---|---|
| 5,893,796 | A | 4/1999 | Birang et al. | |
| 6,271,047 | B1 | 8/2001 | Ushio et al. | |
| 6,489,624 | B1 | 12/2002 | Ushio et al. | |
| 6,664,557 | B1 * | 12/2003 | Amartur | 250/559.27 |
| 6,812,478 | B2 * | 11/2004 | Amartur | 250/559.29 |
| 6,991,514 | B1 * | 1/2006 | Meloni et al. | 451/5 |
| 7,021,991 | B2 * | 4/2006 | Shimizu et al. | 451/6 |
| 7,252,575 | B2 | 8/2007 | Kobayashi et al. | |
| 2001/0027080 | A1 * | 10/2001 | Wiswesser et al. | 451/6 |
| 2002/0115380 | A1 * | 8/2002 | Yamane et al. | 451/6 |

FOREIGN PATENT DOCUMENTS

| | | |
|---|---|---|
| JP | 10-112449 | 4/1986 |
| JP | 2005-109094 | 4/2005 |

* cited by examiner

*Primary Examiner* — Timothy V Eley
(74) *Attorney, Agent, or Firm* — Wenderoth, Lind & Ponack, L.L.P.

(57) ABSTRACT

A method of producing a diagram for use in selecting wavelengths of light in optical polishing end point detection is provided. The method includes polishing a surface of a substrate having a film by a polishing pad; applying light to the surface of the substrate and receiving reflected light from the substrate during the polishing of the substrate; calculating relative reflectances of the reflected light at respective wavelengths; determining wavelengths of the reflected light which indicate a local maximum point and a local minimum point of the relative reflectances which vary with a polishing time; identifying a point of time when the wavelengths, indicating the local maximum point and the local minimum point, are determined; and plotting coordinates, specified by the wavelengths and the point of time corresponding to the wavelengths, onto a coordinate system having coordinate axes indicating wavelength of the light and polishing time.

10 Claims, 69 Drawing Sheets

METHOD OF MAKING DIAGRAM FOR USE IN SELECTION OF WAVELENGTH OF LIGHT FOR POLISHING ENDPOINT DETECTION, METHOD FOR SELECTING WAVELENGTH OF LIGHT FOR POLISHING ENDPOINT DETECTION, AND POLISHING ENDPOINT DETECTION METHOD

BACKGROUND OF THE INVENTION

1. Field of the Invention

The present invention relates to a polishing progress motoring method and a polishing apparatus, and more particularly to a polishing progress motoring method and a polishing apparatus for monitoring a change in thickness of a transparent insulating film during polishing of the film.

The present invention also relates to a method and an apparatus for selecting wavelengths of light for use in an optical polishing end point detection of a substrate having a transparent insulating film.

The present invention also relates to a method and an apparatus for detecting a polishing end point of a substrate having an insulating film, and more particularly to a method and an apparatus for detecting a polishing end point based on reflected light from a substrate. The present invention also relates to a polishing method and a polishing apparatus for polishing a substrate while monitoring reflected light from the substrate.

The present invention also relates to a polishing method and a polishing apparatus for a substrate using an optical polishing end point detection unit, and more particularly to a polishing method and a polishing apparatus suitable for use in identifying a cause of photocorrosion of a metal film.

The present invention also relates to a method of monitoring a polishing process of a substrate having an insulating film, and more particularly to a method of monitoring a polishing process of a substrate based on reflected light from the substrate.

2. Description of the Related Art

In fabrication processes of a semiconductor device, several kinds of materials are repeatedly deposited as films on a silicon wafer to form a multilayer structure. To realize such a multilayer structure, it is important to planarize a surface of a top layer. A polishing apparatus for performing chemical mechanical polishing (CMP) is used as one of techniques for achieving such planarization.

The polishing apparatus of this type includes, typically, a polishing table supporting a polishing pad thereon, a top ring for holding a substrate (a wafer with a film formed thereon), and a polishing liquid supply mechanism for supplying a polishing liquid onto the polishing pad. Polishing of a substrate is performed as follows. The top ring presses the substrate against the polishing pad, while the polishing liquid supply mechanism supplies the polishing liquid onto the polishing pad. In this state, the top ring and the polishing table are moved relative to each other to polish the substrate, thereby planarizing the film of the substrate. The polishing apparatus typically includes a polishing end point detection unit. This polishing end point detection unit is configured to determine a polishing end point based on a time when the film is removed to reach a predetermined thickness or when the film in its entirety is removed.

One example of such polishing end point detection unit is a so-called optical polishing end point detection apparatus, which is configured to apply light to a surface of a substrate and determine a polishing end point based on information contained in reflected light from the substrate. The optical polishing end point detection apparatus typically includes a light-applying section, a light-receiving section, and a spectroscope. The spectroscope decomposes the reflected light from the substrate according to wavelength and measures reflection intensity at each wavelength. This optical polishing end point detection apparatus is often used in polishing of a substrate having a light-transmittable film. For example, the Japanese laid-open patent publication No. 2004-154928 discloses a method in which intensity of reflected light from a substrate (i.e., reflection intensity) is subjected to certain processes for removing noise components to create a characteristic value and the polishing end point is detected from a distinctive point (a local maximum point or a local minimum point) of the temporal variation in the characteristic value.

The characteristic value created from the reflection intensity varies periodically with a polishing time as shown in FIG. 1, and local maximum points and local minimum points appear alternately. This phenomenon is due to interference between light waves. Specifically, the light, applied to the substrate, is reflected off an interface between a medium and a film and an interface between the film and an underlying layer. The light waves from these interfaces interfere with each other. The manner of interference between the light waves varies depending on the thickness of the film (i.e., a length of an optical path). Therefore, the intensity of the reflected light from the substrate (i.e., the reflection intensity) varies periodically in accordance with the thickness of the film. The reflection intensity can also be expressed as a reflectance.

The above-described optical polishing end point detection apparatus counts the number of distinctive points (i.e., the local maximum points or local minimum points) of the variation in the characteristic value after the polishing process is started, and detects a point of time when the number of distinctive points has reached a preset value. Then, the polishing process is stopped after a predetermined period of time has elapsed from the detected point of time.

The characteristic value is an index (a spectral index) obtained based on the reflection intensity measured at each wavelength. Specifically, the characteristic value is given by the following equation (1):

$$\text{Characteristic value(Spectral Index)}=\text{ref}(\lambda 1)/(\text{ref}(\lambda 1)+\text{ref}(\lambda 2)+\ldots+\text{ref}(\lambda k)) \quad (1)$$

In this equation (1), $\lambda$ represents a wavelength of the light, and ref ($\lambda$k) represents a reflection intensity at a wavelength $\lambda$k. The number of wavelengths $\lambda$ to be used in calculation of the characteristic value is preferably two or three (i.e., k=2 or 3).

As can be seen from the equation (1), the reflection intensity is divided by the refection intensity. This process can remove noise components contained in the reflection intensity (i.e., noise components generated by the increase and decrease in the amount of reflected light regardless of the wavelength). Therefore, the characteristic value with less noise components can be obtained. Instead of the characteristic value, the reflection intensity (or reflectance) itself may be monitored. In this case also, since the reflection intensity varies periodically according to the polishing time in the same manner as the graph shown in FIG. 1, the polishing end point can be detected based on the change in the reflection intensity.

Further, the characteristic value may be calculated using relative reflectance that is created based on the reflection intensity. The relative reflectance is a ratio of an actual intensity of reflected light (which is determined by subtracting a background intensity from a reflection intensity measured) to a reference intensity of light (which is determined by subtracting the background intensity from a reference reflection intensity). The background intensity is an intensity that is measured under conditions where no reflecting object exists. The relative reflectance is determined by subtracting the background intensity from both the reflection intensity at each wavelength during polishing of the substrate and the reference reflection intensity at each wavelength that is obtained under predetermined polishing conditions to determine the actual intensity and the reference intensity and then dividing the actual intensity by the reference intensity. More specifically, the relative reflectance is obtained by using $$\text{the relative reflectance } R(\lambda)=[E(\lambda)-D(\lambda)]/[B(\lambda)-D(\lambda)] \quad (2)$$

where λ is a wavelength, E(λ) is a reflection intensity with respect to a substrate as an object to be polished, B(λ) is the reference reflection intensity, and D(λ) is the background intensity (dark level) obtained under conditions where the substrate does not exist or the light from a light source toward the substrate is cut off by a shutter or the like. The reference reflection intensity B(λ) may be an intensity of reflected light from a silicon wafer when water-polishing the silicon wafer while supplying pure water onto the polishing pad. In this specification, the reflection intensity and the relative reflectance will be collectively referred to as reflection intensity.

Using relative reflectances determined from the equation (2), the characteristic value can be calculated from the following equation (3):

$$\text{The characteristic value } S(\lambda 1)=R(\lambda 1)/(R(\lambda 1)+R(\lambda 2)+\ldots+R(\lambda k)) \quad (3)$$

In this equation, λ is a wavelength of light, and R(λk) is a relative reflectance at a wavelength λk. The number of wavelengths λ to be used in calculation of the characteristic value is preferably two or three (i.e., k=2 or 3).

Further, using the above-described relative reflectances at plural wavelengths λk (k=1, . . . , K) and weight functions, the characteristic value S (λ1, λ2, . . . , λK) may be calculated from the following equations:

$$X(\lambda k)=\int R(\lambda)\cdot Wk(\lambda)d\lambda \quad (4)$$

$$\text{The characteristic value } S(\lambda 1, \lambda 2, \ldots, \lambda K)=X(\lambda 1)/[X(\lambda 1)+X(\lambda 2)+\ldots+X(\lambda K)]=X(\lambda 1)/\Sigma X(\lambda k) \quad (5)$$

In the above equation (4), Wk(λ) is a weight function having its center on the wavelength λk (i.e., a weight function having its maximum value at the wavelength λk). FIG. 2 shows examples of the weight function. The maximum value and the width of the weight function shown in FIG. 2 can be changed appropriately. In the equation (4), interval of integration is from a minimum wavelength to a maximum wavelength of a measurable range of the optical polishing end point detection apparatus. For example, where the optical polishing end point detection apparatus has its measurable range from 400 nm to 800 nm, the interval of integration is from 400 to 800.

The above-described optical polishing end point detection apparatus counts the number of distinctive points (i.e., the local maximum points or local minimum points) of the variation in the characteristic value which appear after the polishing process is started as shown in FIG. 1, and determines a time when the number of distinctive points reaches a preset number. Then, the polishing process is stopped after a predetermined period of time has elapsed from the determined time. However, in this polishing end point detection method, when the thickness of the film to be removed (i.e., an amount of film to be removed) is small, only one or two distinctive points appear during polishing even if the wavelengths are appropriately selected. This makes it difficult to monitor the progress of the polishing process.

If light with a shorter wavelength is used, a larger number of distinctive points are expected to appear. However, application of light with a short wavelength to a substrate can cause a problem of so-called photocorrosion. This photocorrosion is a phenomenon of corrosion that occurs in interconnect metal, such as copper, as a result of application of light thereto. In addition, in a case where light with a short wavelength in ultraviolet region is used, a normal glass material cannot be used in an optical transmission system, and as such quartz is needed. Moreover, a dedicated light source and a dedicated spectroscope are needed, thus increasing a cost of the apparatus.

Further, as shown in FIG. 3, an underlying layer generally has a surface with convex and concave portions. Due to a variation in size of the convex and concave portions, appearance times of the local maximum points and the local minimum points of the characteristic value may vary from substrate to substrate. For example, as shown in FIG. 4, when polishing a film having initial thicknesses of 400 nm and 750 nm, a local maximum point of the characteristic value appears at a certain point of time that is different from that in the case of polishing a film having initial thicknesses of 400 nm and 785 nm, even if a removal rate is the same. Consequently, the resultant thickness of the polished film varies from substrate to substrate, and a yield of products is lowered.

In particular, in a process of polishing a layer composed of a copper interconnect material and an insulating material after removing a copper film and a barrier film, it is necessary to accurately detect the polishing end point. The purpose of this polishing process is to adjust a height of the interconnects (i.e., an ohmic value or resistance) by polishing the layer composed of the copper interconnect material and the insulating material after removing the copper film (i.e., the interconnect material) and the underlying barrier film (e.g., tantalum or tantalum nitride). If an accurate polishing end point detection is not performed in this polishing process, the ohmic value of the interconnects varies greatly. Thus, in this polishing process, shift of the appearance times of the local maximum points and the local minimum points due to the variation in the initial film thickness including the underlying layer is not permitted from the viewpoint of the required accuracy. In addition, it is necessary to avoid the influence of the photocorrosion on the interconnects.

To detect an accurate polishing end point, it is necessary to select the wavelengths such that a local maximum point or a local minimum point of the characteristic value appears when the film thickness approaches or reaches a target thickness. However, in actual procedures, the optimum wavelengths are found by trial and error, and hence a long time is needed to select the wavelengths.

In a polishing process for the purpose of exposing a lower film by polishing an upper film, e.g., a polishing process for STI (shallow trench isolation) formation, it is customary to adjust a polishing liquid such that a polishing rate of the lower film is lower than that of the upper film. This is for preventing excess-polishing of the lower film to stabilize the polishing process. However, when the polishing rate is low, the characteristic value (or the reflection intensity) does not fluctuate greatly, as shown in FIG. 5. As a result, the periodical variation in the characteristic value is hardly observed and it is therefore difficult to detect the distinctive point (the local maximum point or local minimum point) of the characteristic value. Consequently, an accurate polishing end point detection cannot be achieved. In addition, since the fluctuation of the characteristic value (or the reflection intensity) is affected by the thickness of both the upper film and the lower film and the type of films, the difference in the initial film thickness between substrates may cause an error of the polishing end point detection. Generally, the difference in the initial film thickness between substrates in each process lot is about ±10%. Such a variation in the initial film thickness can result in an error of the polishing end point detection, because even if the distinctive point (the local maximum point or local minimum point) of the characteristic value is detected, a relationship between the distinctive point of the characteristic value (or the reflection intensity) and the exposure point of the lower film may be altered due to the difference in the film thickness between substrates.

FIG. 6 is a cross-sectional view showing a multilayer interconnect structure formed on a silicon wafer. An oxide film 100 having a gate structure is formed on the silicon wafer. Multiple SiCN films 101 and oxide films (e.g., $SiO_2$) 102 are formed on the oxide film 100. The oxide films 102 function as an inter-level dielectric, and the SiCN films 101 function as an etch stopper and a diffusion-preventing layer for the inter-level dielectric. A trench 103 and a via plug 104 are formed in the oxide films 102. A barrier film (e.g., TaN, Ta, Ru, Ti, or TiN) 105 is formed on surfaces of the trench 103 and the via plug 104 and an upper surface of the oxide film 102. Further, a copper film M2 is formed on the barrier film 105, so that the trench 103 and the via plug 104 are filled with part of the copper film M2. The trench 103 is formed according to interconnect patterns, and the copper filling the trench 103 provides metal interconnects. The copper in the trench 103 is electrically connected to lower-level copper interconnects M1 via the copper in the via plug 104.

The copper film M2 formed on areas, other than the trench 103 and the via plug 104, is an unnecessary copper film which causes short circuit between the interconnects. This unnecessary copper film is polished by the above-described polishing apparatus. As shown in FIG. 6, polishing of the copper film M2 is performed in approximately two steps. The first step is a process of removing the exposed copper film M2. In this first step, only the copper film M2, which is metal, is polished. Therefore, an eddy current sensor is used to monitor the progress of polishing of the copper film M2. The second step is a process of removing the barrier film 105 after the exposed copper film M2 is removed and then polishing the copper in the trench 103, together with the oxide film 102. Removal of the barrier film 105 can be detected by an eddy current sensor or a table-current sensor (which measures a change in current of a motor rotating the polishing table caused in response to a change in frictional torque between the surface of the substrate and the polishing pad). When the barrier film 105 is thin enough to allow the light to pass therethrough, it is possible to detect the removal of the barrier film 105 by the optical polishing end point detection apparatus. Because the height of the copper in the trench 103 determines the resistance of the interconnects, it is important to accurately detect the polishing end point in the second step. As can be seen from FIG. 6, in the second step, the oxide film 102 is mainly polished. Therefore, the optical polishing end point detection apparatus is used to monitor the progress of polishing in the second step.

As described above, the optical polishing end point detection apparatus is suitable for use in polishing of a light-transmittable film, such as an oxide film. However, when the optical polishing end point detection apparatus is used in polishing of a metal film, such as a copper film, the photocorrosion can occur in the metal film. The photocorrosion is a phenomenon of corrosion of a material caused by application of light thereto. Specifically, when light is applied to the material, photoelectromotive force is generated in the material to produce an electric current that flows therethrough, causing corrosion of the material. This photocorrosion can cause a change in resistance of the metal interconnects, thus causing defects of a semiconductor device as a product. Accordingly, preventing the photocorrosion is one of the important issues in the fabrication process of the semiconductor device.

It is considered that the photocorrosion is likely to occur in the presence of a liquid. Since the polishing liquid is used in polishing of a substrate, it is important to prevent the photocorrosion during polishing of the substrate. Generally, the photocorrosion is considered to occur depending on illuminance of light (expressed by "lux"). However, most of detailed conditions where the photocorrosion occurs are unknown. As a result, it is still difficult to prevent the photocorrosion from occurring.

The characteristic value as shown in FIG. 1 fluctuates periodically according to the thickness of the light-transmittable film which is reduced as the polishing process proceeds. Therefore, the characteristic value can be regarded as an index that indicates the progress of polishing of the film. However, the substrate generally has a multilayer structure composed of metal interconnects with different patterns and multiple insulating films having light transmission characteristics. Therefore, the optical polishing end point detection apparatus detects a film thickness that reflects not only an uppermost insulating film, but also an underlying insulating film. For example, in an example shown in FIG. 7, a lower insulating film is formed on a silicon wafer, and a metal interconnect and an upper insulating film are formed on the lower insulating film. A thickness to be monitored during polishing is a thickness of the upper insulating film. However, part of the light emitted from the optical polishing end point detection apparatus travels through the upper insulating film and the lower insulating film and reflects off underlying metal interconnects, elements with no light transmission characteristic, and the silicon wafer. As a result, the characteristic value calculated by the optical polishing end point detection apparatus reflects both the thickness of the upper insulating film and the thickness of the lower insulating film. In this case, if the thickness of the lower insulating film varies from region to region (as indicated by $d_1$ and $d_2$ in FIG. 7), a reliable characteristic value cannot be obtained, and hence the accuracy of the polishing end point detection is lowered. In addition, even if substrates have the same structure, the thickness of the lower insulating film may vary from substrate to substrate. In this case also, the accuracy of the polishing end point detection is lowered.

SUMMARY OF THE INVENTION

The present invention has been made in view of the above drawbacks. It is therefore a first object of the present invention to provide a method of producing a diagram for use in effectively selecting optimal wavelengths of light to be used in optical polishing end point detection, and a method of effectively selecting optimal wavelengths of light to be used in optical polishing end point detection.

It is a second object of the present invention to provide a polishing end point detection method and a polishing end point detection apparatus capable of detecting an accurate polishing end point utilizing a change in polishing rate.

To achieve the first object, the present invention provides a method of producing a diagram for use in selecting wavelengths of light in optical polishing end point detection. This method includes: polishing a surface of a substrate having a film by a polishing pad; applying light to the surface of the substrate and receiving reflected light from the substrate during the polishing of the substrate; calculating relative reflectances of the reflected light at respective wavelengths; determining wavelengths of the reflected light which indicate a local maximum point and a local minimum point of the relative reflectances which vary with a polishing time; identifying a point of time when the wavelengths, indicating the local maximum point and the local minimum point, are determined; and plotting coordinates, specified by the wavelengths and the point of time corresponding to the wavelengths, onto a coordinate system having coordinate axes indicating wavelength of the light and polishing time.

In a preferred aspect of the present invention, the determining wavelengths of the reflected light which indicate the local maximum point and the local minimum point comprises: calculating an average of relative reflectances at each wavelength; dividing each relative reflectance at each point of time by the average to provide modified relative reflectances for the respective wavelengths; and determining wavelengths of the reflected light which indicate a local maximum point and a local minimum point of the modified relative reflectances.

In a preferred aspect of the present invention, the determining wavelengths of the reflected light which indicate the local maximum point and the local minimum point comprises: calculating an average of relative reflectances at each wavelength; subtracting the average from each relative reflectance at each point of time to provide modified relative reflectances for the respective wavelengths; and determining wavelengths of the reflected light which indicate a local maximum point and a local minimum point of the modified relative reflectances.

Another aspect of the present invention is to provide a method of selecting wavelengths of light for use in optical polishing end point detection. This method includes: polishing a surface of a substrate having a film by a polishing pad; applying light to the surface of the substrate and receiving reflected light from the substrate during the polishing of the substrate; calculating relative reflectances of the reflected light at respective wavelengths; determining wavelengths of the reflected light which indicate a local maximum point and a local minimum point of the relative reflectances which vary with a polishing time; identifying a point of time when the wavelengths, indicating the local maximum point and the local minimum point, are determined; plotting coordinates, specified by the wavelengths and the point of time corresponding to the wavelengths, onto a coordinate system having coordinate axes indicating wavelength of the light and polishing time to produce a diagram; searching for coordinates existing in a predetermined time range on the diagram; and selecting plural wavelengths from wavelengths constituting the coordinates obtained by the searching.

In a preferred aspect of the present invention, the selecting plural wavelengths from wavelengths constituting the coordinates obtained by the searching comprises: with use of the wavelengths constituting the coordinates obtained by the searching, generating plural combinations each comprising plural wavelengths; calculating a characteristic value, which varies periodically with a change in thickness of the film, from relative reflectances at the plural wavelengths of each combination; calculating evaluation scores for the plural combinations using a wavelength-evaluation formula; and selecting plural wavelengths constituting a combination with a highest evaluation score.

In a preferred aspect of the present invention, the wavelength-evaluation formula includes, as evaluation factors, a point of time when a local maximum point or a local minimum point of the characteristic value appears and an amplitude of a graph described by the characteristic value with the polishing time.

In a preferred aspect of the present invention, the method further includes: performing fine adjustment of the selected plural wavelengths.

Another aspect of the present invention is to provide a method of detecting a polishing end point. This method includes: polishing a surface of a substrate having a film by a polishing pad; applying light to the surface of the substrate and receiving reflected light from the substrate during the polishing of the substrate; calculating relative reflectances of the reflected light at plural wavelengths selected according to a method as recited above; from the calculated relative reflectances, calculating a characteristic value which varies periodically with a change in thickness of the film; and detecting the polishing end point of the substrate by detecting a local maximum point or a local minimum point of the characteristic value that appears during the polishing of the substrate.

Another aspect of the present invention is to provide an apparatus for detecting a polishing end point. This apparatus includes: a light-applying unit configured to apply light to a surface of a substrate having a film during polishing of the substrate; a light-receiving unit configured to receive reflected light from the substrate; a spectroscope configured to measure reflection intensities of the reflected light at respective wavelengths; and a monitoring unit configured to calculate a characteristic value, which varies periodically with a change in thickness of the film, from reflection intensities measured by the spectroscope and monitor the characteristic value. The monitoring unit is configured to calculate relative reflectances from reflection intensities at wavelengths selected according to a method as recited above, calculate the characteristic value, which varies periodically with a change in thickness of the film, from the relative reflectances calculated, and detect the polishing end point of the substrate by detecting a local maximum point or a local minimum point of the characteristic value that appears during polishing of the substrate.

Another aspect of the present invention is to provide a polishing apparatus including: a polishing table for supporting a polishing pad and configured to rotate the polishing pad; a top ring configured to hold a substrate having a film and press the substrate against the polishing pad; and a polishing end point detection unit configured to detect a polishing end point of the substrate. The polishing end point detection unit includes a light-applying unit configured to apply light to a surface of the substrate during polishing of the substrate having the film; a light-receiving unit configured to receive reflected light from the substrate; a spectroscope configured to measure reflection intensities of the reflected light at respective wavelengths; and a monitoring unit configured to calculate a characteristic value, which varies periodically with a change in thickness of the film, from reflection intensities measured by the spectroscope and monitor the characteristic value. The monitoring unit is configured to calculate relative reflectances from reflection intensities at wavelengths selected according to a method as recited above, calculate the characteristic value, which varies periodically with a change in thickness of the film, from the relative reflectances calculated, and detect the polishing end point of the substrate by detecting a local maximum point or a local minimum point of the characteristic value that appears during polishing of the substrate.

The diagram produced according to the first aspect of the present invention shows a relationship between the wavelengths and the local maximum points and local minimum points distributed according to the polishing time. Therefore, by searching for local maximum points and local minimum points appearing at a known target polishing end point detection time or appearing around the target time, wavelengths, corresponding to these extremal points searched, can be selected easily.

To achieve the second object, the present invention provides a method of detecting a polishing end point. This method includes: polishing a surface of a substrate having a film by a polishing pad; applying light to the surface of the substrate and receiving reflected light from the substrate during the polishing of the substrate; measuring reflection intensities of the reflected light at respective wavelengths; creating a spectral profile indicating a relationship between reflection intensity and wavelength with respect to the film from the reflection intensities measured; extracting at least one extremal point indicating extremum of the reflection intensities from the spectral profile; during polishing of the substrate, repeating the creating of the spectral profile and the extracting of the at least one extremal point to obtain plural spectral profiles and plural extremal points; and detecting the polishing end point based on an amount of relative change in the extremal point between the plural spectral profiles.

Lowering of a polishing rate can be regarded as removal of the film as a result of polishing and exposure of an underlying layer. According to the second aspect of the present invention, lowering of the polishing rate, i.e., the polishing end point, can be detected accurately from the relative change in local maximum point and/or local minimum point.

In a preferred aspect of the present invention, the detecting the polishing end point comprises determining the polishing end point by detecting that the amount of relative change reaches a predetermined threshold.

In a preferred aspect of the present invention, the at least one extremal point comprises multiple extremal points. The method further includes sorting the plural extremal points, obtained by the repeating, into plural clusters, and calculating an amount of relative change in extremal point between the plural spectral profiles for each of the plural clusters to determine plural amounts of relative change in the extremal point corresponding respectively to the plural clusters. The detecting the polishing end point comprises detecting the polishing end point based on the plural amounts of relative change.

In a preferred aspect of the present invention, the at least one extremal point comprises multiple extremal points. The method further includes calculating an average of wavelengths of the multiple extremal points extracted from the spectral profile. The detecting the polishing end point comprises detecting the polishing end point based on an amount of relative change in the average between the plural spectral profiles.

In a preferred aspect of the present invention, the method further includes interpolating an extremal point when the plural spectral profiles do not have mutually corresponding extremal points.

In a preferred aspect of the present invention, the method further includes detecting a damaged layer formed in the film from the amount of relative change. The damaged layer results from a process performed on the substrate.

Another aspect of the present invention is to provide a method of detecting a polishing end point. This method includes: polishing a surface of a substrate having a film by a polishing pad; applying light to a first zone and a second zone at radially different locations on the surface of the substrate and receiving reflected light from the substrate during the polishing of the substrate; measuring reflection intensities of the reflected light at respective wavelengths; from the reflection intensities measured, creating a first spectral profile and a second spectral profile each indicating a relationship between reflection intensity and wavelength with respect to the film, the first spectral profile and the second spectral profile corresponding to the first zone and the second zone respectively; extracting a first extremal point and a second extremal point, each indicating extremum of the reflection intensities, from the first spectral profile and the second spectral profile, respectively; during polishing of the substrate, repeating the creating of the first spectral profile and the second spectral profile and the extracting of the first extremal point and the second extremal point to obtain plural first spectral profiles, plural second spectral profiles, plural first extremal points, and plural second extremal points; during polishing of the substrate, controlling forces of pressing the first zone and the second zone against the polishing pad independently based on the first extremal points and the second extremal points; detecting a polishing end point in the first zone based on an amount of relative change in the first extremal point between the plural first spectral profiles; and detecting a polishing end point in the second zone based on an amount of relative change in the second extremal point between the plural second spectral profiles.

Another aspect of the present invention is to provide a polishing method including: polishing a surface of a substrate having a film by a polishing pad; applying light to a first zone and a second zone at radially different locations on the surface of the substrate and receiving reflected light from the substrate during the polishing of the substrate; measuring reflection intensities of the reflected light at respective wavelengths; from the reflection intensities measured, creating a first spectral profile and a second spectral profile each indicating a relationship between reflection intensity and wavelength with respect to the film, the first spectral profile and the second spectral profile corresponding to the first zone and the second zone respectively; extracting a first extremal point and a second extremal point, each indicating extremum of the reflection intensities, from the first spectral profile and the second spectral profile, respectively; during polishing of the substrate, repeating the creating of the first spectral profile and the second spectral profile and the extracting of the first extremal point and the second extremal point to obtain plural first spectral profiles, plural second spectral profiles, plural first extremal points, and plural second extremal points; and during polishing of the substrate, controlling forces of pressing the first zone and the second zone against the polishing pad independently based on the first extremal points and the second extremal points.

Another aspect of the present invention is to provide an apparatus for detecting a polishing end point. This apparatus includes: a light-applying unit configured to apply light to a surface of a substrate having a film; a light-receiving unit configured to receive reflected light from the substrate; a spectroscope configured to measure reflection intensities of the reflected light at respective wavelengths; and a monitoring unit configured to create a spectral profile indicating a relationship between reflection intensity and wavelength with respect to the film from the reflection intensities measured, extract at least one extremal point indicating extremum of the reflection intensities from the spectral profile, and monitor the at least one extremal point. The monitoring unit is further configured to repeat creating of the spectral profile and extracting of the at least one extremal point during polishing of the substrate to obtain plural spectral profiles and plural extremal points and detect the polishing end point based on an amount of relative change in the extremal point between the plural spectral profiles.

Another aspect of the present invention is to provide a polishing apparatus including: a polishing table for supporting a polishing pad; a top ring configured to press a substrate having a film against the polishing pad; and an apparatus for detecting a polishing end point as recited above.

In a preferred aspect of the present invention, the top ring includes a pressing mechanism configured to press multiple zones of the substrate independently; and the apparatus for detecting the polishing end point is configured to detect polishing end points for the respective multiple zones of the substrate.

In a preferred aspect of the present invention, the apparatus for detecting the polishing end point is configured to create spectral profiles for the respective multiple zones of the substrate; and the pressing mechanism is configured to control pressing forces to be applied to the respective multiple zones of the substrate during polishing of the substrate based on extremal points on the spectral profiles.

Another aspect of the present invention is to provide a method of monitoring polishing of a substrate. This method includes: applying light to a surface of the substrate having a film and receiving reflected light from the substrate during polishing of the substrate; measuring reflection intensities of the reflected light at respective wavelengths; creating a spectral profile indicating a relationship between reflection intensity and wavelength with respect to the film from the reflection intensities measured; extracting at least one extremal point indicating extremum of the reflection intensities from the spectral profile; during polishing of the substrate, repeating the creating of the spectral profile and the extracting of the at least one extremal point to obtain plural spectral profiles and plural extremal points; and determining an amount of the film removed based on an amount of relative change in the extremal point between the plural spectral profiles.

In a preferred aspect of the present invention, the polishing of the substrate is a polishing process of adjusting a height of copper interconnects.

In a preferred aspect of the present invention, the method further includes: measuring an initial thickness of the film; and determining a polishing end point based on a difference between the initial thickness and the amount of the film removed.

DETAILED DESCRIPTION OF THE PREFERRED EMBODIMENTS

Figure 8:
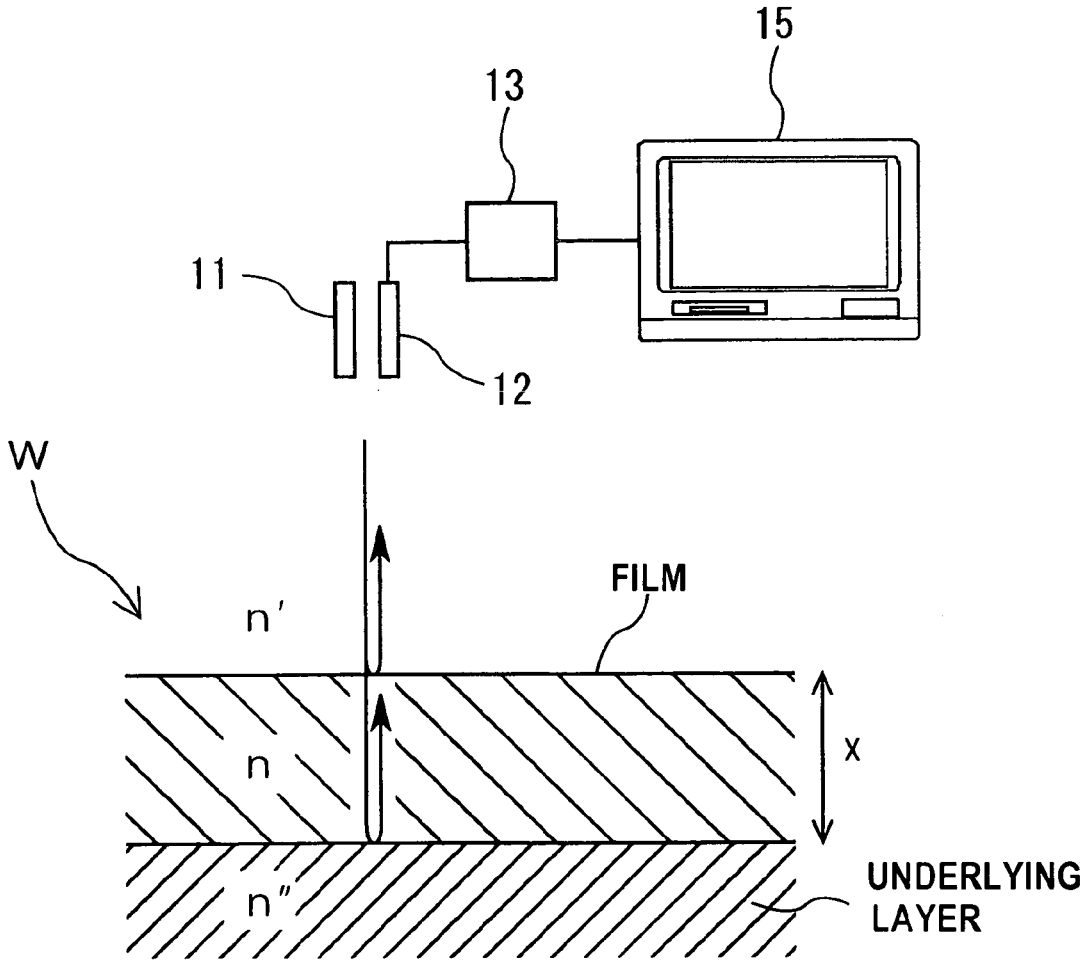
FIG. 8 is a schematic view showing the principle of a polishing progress monitoring method according to an embodiment of the present invention.
Figure 9:
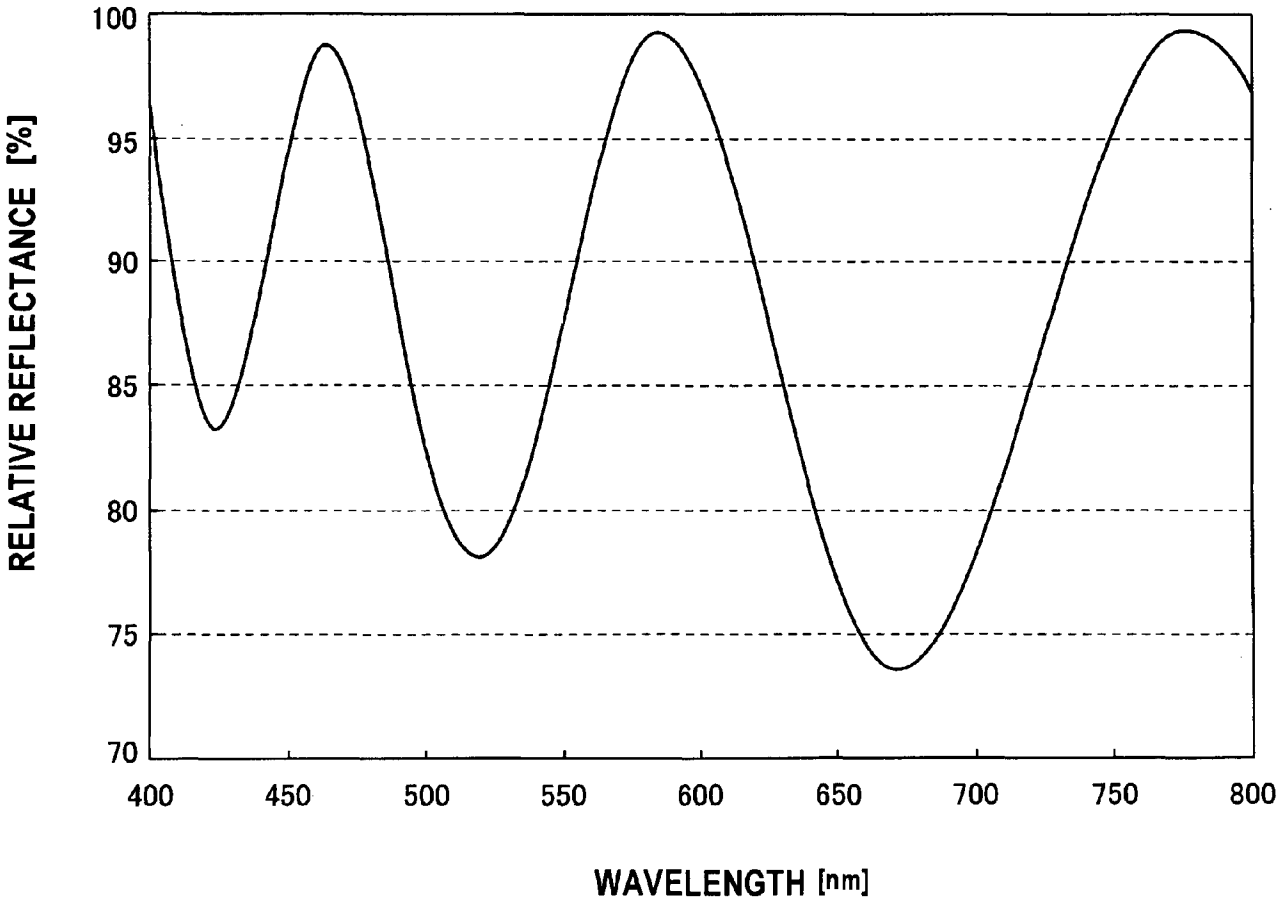
FIG. 9 is a graph showing spectral data indicating intensity of light at each wavelength.

Embodiments of the present invention will be described below with reference to the drawings. FIG. 8 is a schematic view showing the principle of a polishing progress monitoring method according to an embodiment of the present invention. As shown in FIG. 8, a substrate W to be polished has a lower layer (e.g., a silicon layer) and a film (e.g., an insulating film, such as $SiO_2$, having a light-transmittable characteristic) formed on the underlying lower layer. A light-applying unit 11 and a light-receiving unit 12 are arranged so as to face a surface of the substrate W. The light-applying unit 11 is configured to apply light in a direction substantially perpendicular to the surface of the substrate W, and the light-receiving unit 12 is configured to receive the reflected light from the substrate W. A spectroscope 13 is coupled to the light-receiving unit 12. This spectroscope 13 measures intensity of the reflected light, received by the light-receiving unit 12, at each wavelength (i.e., measures reflection intensities at respective wavelengths). More specifically, the spectroscope 13 decomposes the reflected light according to the wavelength and produces spectral data indicating the intensity of light (i.e., the reflection intensity) at each wavelength, as shown in FIG. 9. In a graph shown in FIG. 9, a horizontal axis indicates wavelength of the light, and a vertical axis indicates relative reflectance (which will be described below) calculated from the reflection intensity.

A monitoring unit 15 for monitoring the progress of polishing of the substrate is coupled to the spectroscope 13. A general-purpose computer or a dedicated computer can be used as the monitoring unit 15. This monitoring unit 15 monitors the intensity of the light at predetermined wavelength obtained from the spectral data and monitors the progress of the polishing process from a change in the intensity of the light. The intensity of the light can be expressed as the reflection intensity or the relative reflectance. The reflection intensity is an intensity of the reflected light from the substrate W. The relative reflectance is a ratio of the intensity of the reflected light to a predetermined intensity of the light (a reference value). For example, the relative reflectance is given by subtracting a background intensity from both the reflection intensity at each wavelength obtained during polishing of the substrate and the reflection intensity at each wavelength obtained during water-polishing of a silicon substrate to determine an actual intensity and a reference intensity and then dividing the actual intensity by the reference intensity (see the equation (2)). The background intensity is an intensity that is measured under conditions where no reflecting object or no reflected light exists. Further, the reflection intensity or the relative reflectance may be subjected to noise-reduction processes and the resulting value may be used as an index. This index can be regarded as a value with less noise components as a result of the noise-reduction processes performed on the reflection intensity or the relative reflectance. The procedures of calculating this index will be described later. In this embodiment, the reflection intensity, the relative reflectance, and the aforementioned index will be referred to collectively as a characteristic value. This characteristic value is a value that fluctuates periodically according to a change in the film thickness.

Figure 1:
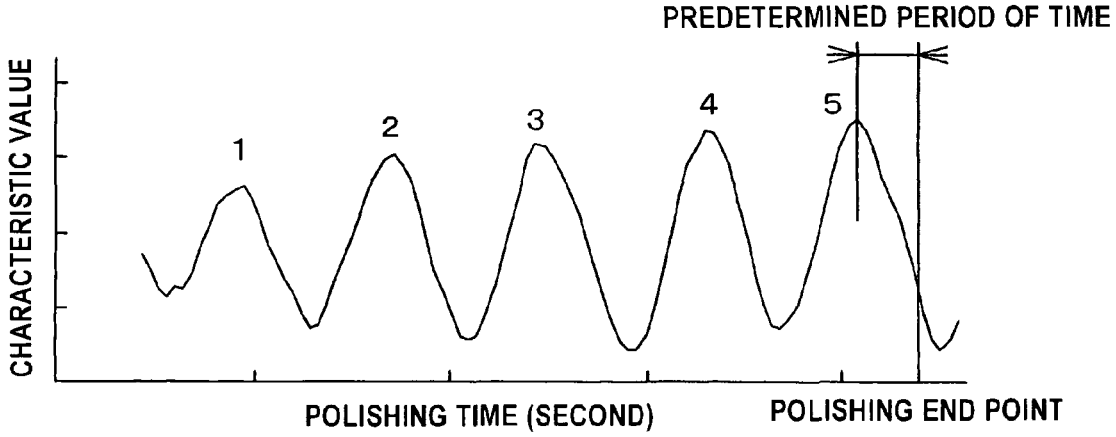
FIG. 1 is a graph showing a characteristic value that varies with a polishing time.
Figure 2:
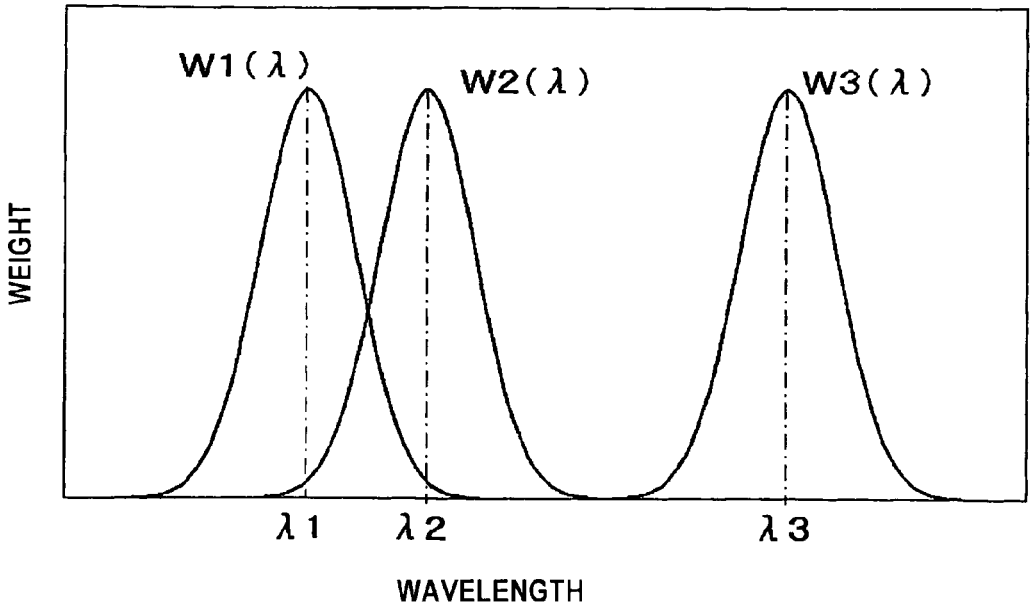
FIG. 2 is a graph showing examples of weight function.

In FIG. 8, n represents a refractive index of the film, n' represents a refractive index of a medium contacting the film, and n" represents a refractive index of the lower layer. Where the refractive index n of the film is larger than the refractive index n' of the medium and the refractive index n" of the lower layer is larger than the refractive index n of the film (i.e., $n'<n<n''$), a phase of light reflected off an interface between the medium and the film and a phase of light reflected off an interface between the film and the lower layer are shifted from a phase of the incident light by $\pi$. Since the reflected light from the substrate is composed of the light reflected off the interface between the medium and the film and the light reflected off the interface between the film and the lower layer, the intensity of the reflected light from the substrate varies depending on a phase difference between the two light waves. Therefore, the aforementioned characteristic value changes according to the thickness of the film (i.e., a length of an optical path), as shown in FIG. 1.

A local maximum point and a local minimum point (i.e., distinctive points) of the characteristic value that changes according to the thickness of the film (i.e., according to a polishing time) are defined as points respectively indicating a local maximum value and a local minimum value of the characteristic value. The local maximum point and the local minimum point are points where constructive interference and destructive interference occur between the reflected light from the interface between the medium and the film and the reflected light from the interface between the film and the lower layer. Therefore, the thickness of the film when the local maximum point appears and the thickness of the film when the local minimum point appears are expressed by as follows:

$$\text{The local minimum point: } 2nx=m\lambda \quad (6)$$

$$\text{The local minimum point: } 2nx=(m-\tfrac{1}{2})\lambda \quad (7)$$

In the above equations, x represents a thickness of the film, $\lambda$ represents a wavelength of the light, and m represents a natural number. The symbol m indicates the phase difference between the light waves causing the constructive interference (i.e., the number of waves on the optical path in the film).

Where the refractive index n of the film is 1.46 (corresponding to a refractive index of $SiO_2$) and the monitoring unit 15 has the ability to monitor the wavelength $\lambda$ ranging from 400 nm to 800 nm (i.e., 400 nm$\leqq\lambda\leqq$800 nm), a range of the film thicknesses x at which the local maximum point and the local minimum point appear is expressed as follows:

In a case of m=1, the local maximum point: 137 nm$\leqq$x$\leqq$274 nm the local minimum point: 68 nm$\leqq$x$\leqq$137 nm In a case of m=2, the local maximum point: 274 nm$\leqq$x$\leqq$548 nm the local minimum point: 205 nm$\leqq$x$\leqq$411 nm In a case of m=3, the local maximum point: 411 nm$\leqq$x$\leqq$822 nm the local minimum point: 342 nm$\leqq$x$\leqq$685 nm From the above-described relational expressions, it can be seen that the local maximum point or the local minimum point necessarily appears when the film thickness is larger than 68 nm. Therefore, the wavelengths of the light are selected based on an initial thickness and a thickness of the film to be removed (i.e., a target amount to be removed) such that at least one local maximum point or local minimum point appears during polishing. A cycle T of the local maximum points and a cycle T of the local minimum points are expressed by an equation $T=\lambda/2n$, which does not depend on the film thickness x. For example, where n is 1.46 and the wavelength $\lambda$, is in the range of 400 nm to 800 nm (i.e., 400 nm$\leqq\lambda\leqq$800 nm), the period T is in the range of 137 nm to 274 nm (i.e., 137 nm$\leqq$T$\leqq$274 nm). In this specification, the period T (=/$\lambda$/2n) is expressed by a length.

In this embodiment, the monitoring unit 15 monitors plural characteristic values corresponding to different wavelengths. Preselected plural wavelengths are stored in the monitoring unit 15. The plural wavelengths to be selected are such that the corresponding characteristic values show at least one local maximum point or local minimum point within a time range from a polishing start point to a polishing end point where a target amount of removal is reached. The monitoring unit 15 extracts reflection intensities at the preselected wavelengths (i.e., different wavelengths) from the spectral data obtained by the spectroscope 13, monitors successively the characteristic values created based on the reflection intensities, and detects the local maximum points (or local minimum points) of the characteristic values successively to thereby monitor the progress of polishing. As described above, in this embodiment, the characteristic value created based on the reflection intensities is the reflection intensity itself, the relative reflectance, or the index produced through the noise-reduction processes.

Hereinafter, an example of the method of selecting the plural wavelengths will be described. First, a first wavelength $\lambda$1 is selected as a reference wavelength such that a local maximum point or local minimum point of the characteristic value appears immediately after polishing is started. This selection of the first wavelength $\lambda$1 can be conducted with reference to spectral data obtained by polishing a sample substrate having the same structure as the substrate which is a workpiece to be polished. Next, a monitoring interval of the progress of polishing is selected. In this example, the monitoring interval is expressed as an amount of the film to be removed. Hereinafter, the monitoring interval will be referred to as a management removal amount Δx. This management removal amount Δx is determined based on a target amount of the film to be removed. For example, when the target amount of the film to be removed is 100 nm, the management removal amount Δx is set to 20 nm which is smaller than the target amount. In this case, the progress of polishing is monitored at intervals of 20 nm until the amount of the removed film reaches 100 nm.

Since the selected wavelengths differ from each other, the local maximum points (or local minimum points) of the characteristic values corresponding to the respective wavelengths appear at different times. The plural wavelengths to be selected are such that the corresponding local maximum points (or local minimum points) appear successively and the amount of the film removed during an interval between the neighboring local maximum points is equal to the management removal amount Δx. By selecting such wavelengths, the local maximum points (or local minimum points) of the characteristic values corresponding to the different wavelengths appear one by one every time the film is removed by the management removal amount Δx. In this case, it is preferable that the plural local maximum points appear at as equal intervals as possible during polishing.

In a case of a blanket wafer with a uniform film thickness over a surface thereof, the wavelengths that cause the local maximum points to appear successively during polishing can be selected as follows. First, as described above, the first wavelength λ1 is selected as the reference wavelength. In order to cause the local maximum point to appear each time the film is removed by the management removal amount Δx, it is necessary to shift the wavelength from the first wavelength λ1 in accordance with the management removal amount Δx. Thus, in the next step, an amount of shift Δλ that determines an amount of shifting the first wavelength λ1 is calculated. The amount of shift ΔX is expressed by the following equation which is derived from the above equation (6):

$$\Delta\lambda=\Delta x\times 2n/m \tag{8}$$

In the above equation (8), n is a refractive index of the film, and m is a natural number determined according to the initial thickness of the film.

Then, the amount of shift Δλ is multiplied by natural number(s), and the resulting value(s) is subtracted from the first wavelength λ1, whereby plural wavelengths λk are determined. Each wavelength λk is expressed by $$\lambda k=\lambda 1-a\times\Delta\lambda \tag{9}$$

where a represents a natural number.

For example, where the first wavelength λ1 is 570 nm, the target amount to be removed is 100 nm, the management removal amount Δx is 20 nm, the refractive index n of the film is 1.46, and the natural number m of the equation (8) is 2, the amount of shift Δλ is determined from the above-described equation (8) as follows:

$$\Delta\lambda=20\text{ nm}\times(2\times 1.46)/2\approx 30\text{ nm}$$

Since the target amount to be removed is 100 nm and the management removal amount Δx is 20 nm, five polishing-monitoring points exist from the polishing start point to the polishing end point. Therefore, in this case, five wavelengths λ1 to λ5, including the first wavelength λ1, are selected. The wavelengths λ2 to λ5 are determined from the above-described equation (9) as follows:

$$\lambda 2=570\text{ nm}-1\times 30\text{ nm}=540\text{ nm}$$

$$\lambda 3=570\text{ nm}-2\times 30\text{ nm}=510\text{ nm}$$

$$\lambda 4=570\text{ nm}-3\times 30\text{ nm}=480\text{ nm}$$

$$\lambda 5=570\text{ nm}-4\times 30\text{ nm}=450\text{ nm}$$

Figure 10:
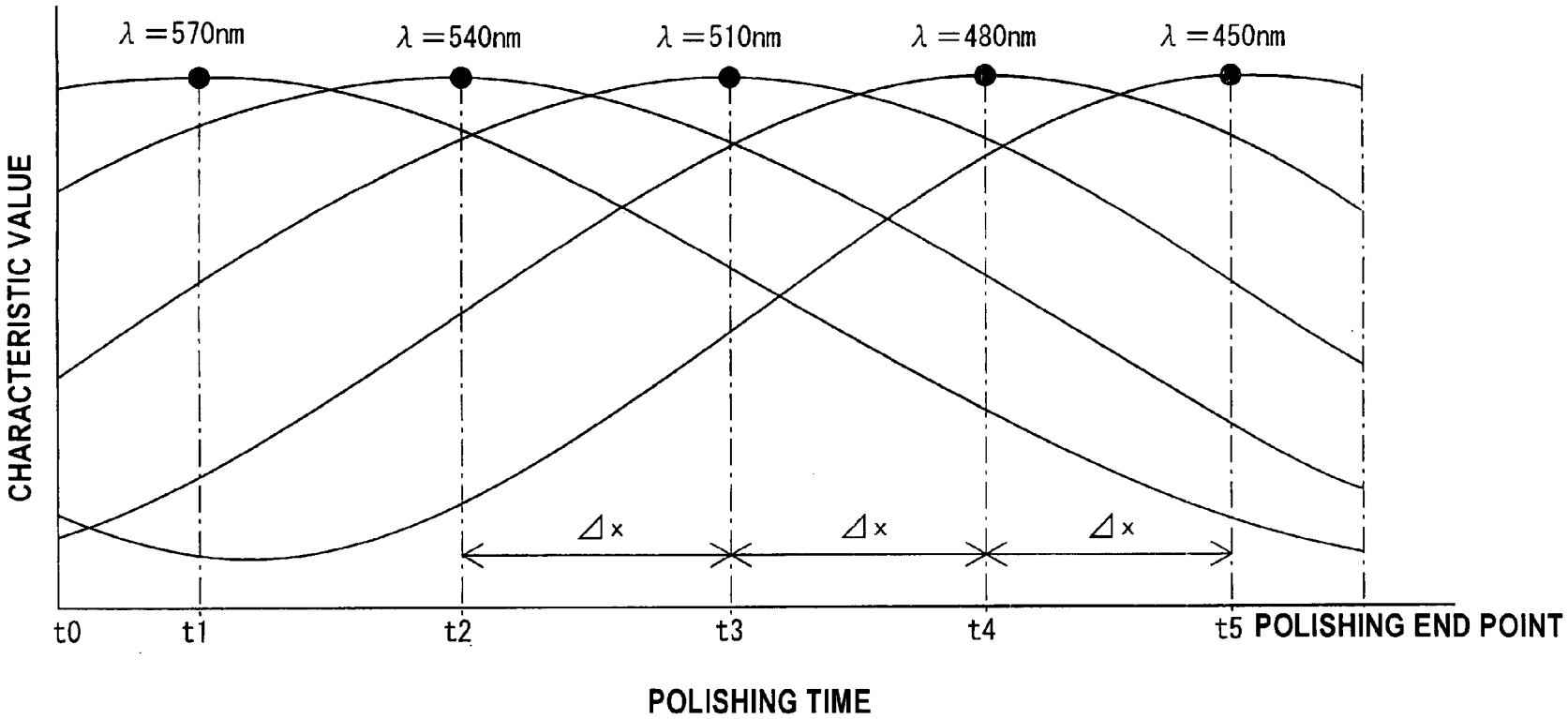
FIG. 10 is a graph showing five characteristic values that change with a polishing time.

FIG. 10 is a graph showing five characteristic values that vary with a polishing time. This graph shows the variations in the characteristic values corresponding to the five wavelengths λ1 to λ5 which have been selected as discussed above. The amount of film removed between the neighboring local maximum points is 20 nm (more accurately, 20.55 nm), which corresponds to the management removal amount Δx. Specifically, the thickness of the film removed during a time interval from when a certain local maximum point appears to when a subsequent local maximum point appears is 20 nm. Therefore, in this case, the progress of polishing can be monitored at the intervals of 20 nm. In this manner, the local maximum points or the local minimum points that appear from the polishing start point to the polishing end point provide monitoring points of the progress of polishing. Accordingly, by detecting the local maximum points or the local minimum points, the progress of polishing can be monitored.

In the above-discussed method of selecting the wavelengths, an n-th wavelength λn may be smaller than the lower limit of the measurable wavelength range of the spectroscope 13. For example, in the above example, a seventh wavelength λ7 is determined to be 390 nm according to the following calculation:

$$\lambda 7=570\text{ nm}-6\times 30\text{ nm}=390\text{ nm}$$

This result shows that the seventh wavelength λ7 is below the lower limit 400 nm of the range of the wavelength which can be monitored by the monitoring unit 15. In such a case, the natural number m is set to be a smaller number, so that a longer wavelength can be reselected. Specifically, from the above equation (6), the film thickness x when the local maximum point, corresponding to the seventh wavelength λ7, appears is given by $$x=m\times\lambda 7/2n=2\times 390/2\times 1.46\approx 267\text{ nm}$$

where m=2 and n=1.46.

Replacing m=2 with m=1, a newly selected wavelength λ7' is obtained as follows:

$$\lambda 7'=2n\times x/m=2\times 1.46\times 267/1\approx 780\text{ nm}$$

In this manner, according to this embodiment, the progress of polishing can be monitored using light with longer wavelengths.

Figure 11:
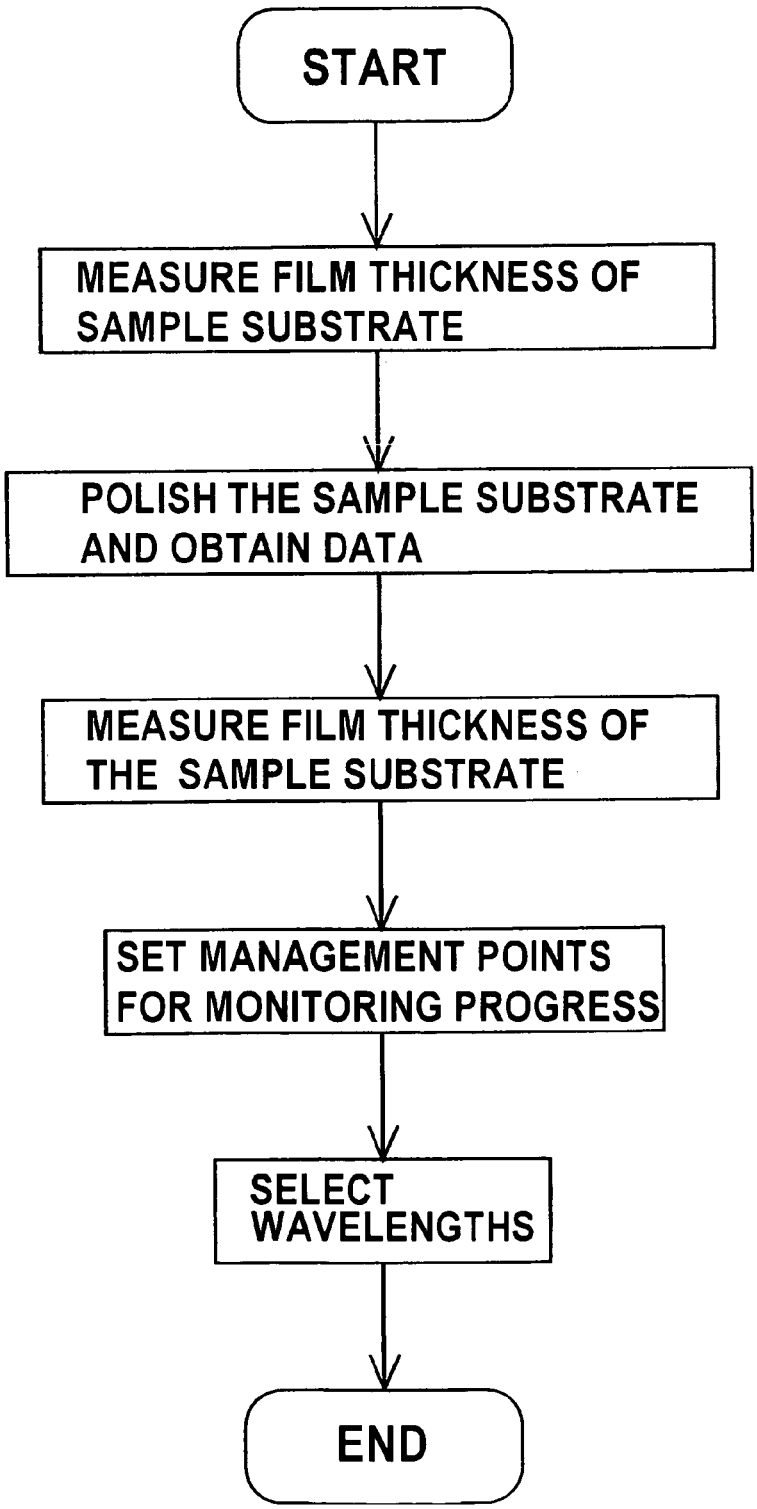
FIG. 11 is a flowchart showing another example of a method of determining wavelengths.

The above-discussed multiple wavelengths can also be determined as follows. FIG. 11 is a flowchart showing another example of the method of determining the wavelengths. A sample substrate, having the same structure as a substrate to be polished, is prepared, and a thickness of a predetermined portion of a film (an uppermost layer) is measured by a non-illustrated film thickness measuring device (step 1). The sample substrate is polished, and several types of data on the sample substrate during the polishing process (including the spectral data created by the spectroscope 13 and a total polishing time) are obtained (step 2). The polished sample substrate is transported to the film thickness measuring device again, where the thickness of the predetermined portion of the film is measured (step 3).

Next, plural management points for monitoring the progress of polishing are set on a temporal axis from a polishing start point to a polishing end point of the sample substrate (step 4). It is preferable that the management points be distributed as evenly as possible from the polishing start point to the polishing end point. Specifically, the plural management points are established at predetermined time intervals from the polishing start point to the polishing end point. For example, the management points may be set to polishing times (i.e., elapsed times) of 40 seconds, 60 seconds, 80 seconds, etc. Then, a removal rate is calculated from the measurement results of the film thickness in step 1 and step 3 and the total polishing time. On the assumption that the removal rate is constant from the polishing start point to the polishing end point, film thicknesses at the respective management points and the amount of the film that has been removed between the management points (corresponding to the above-described management removal amount Δx) are calculated.

Figure 12:
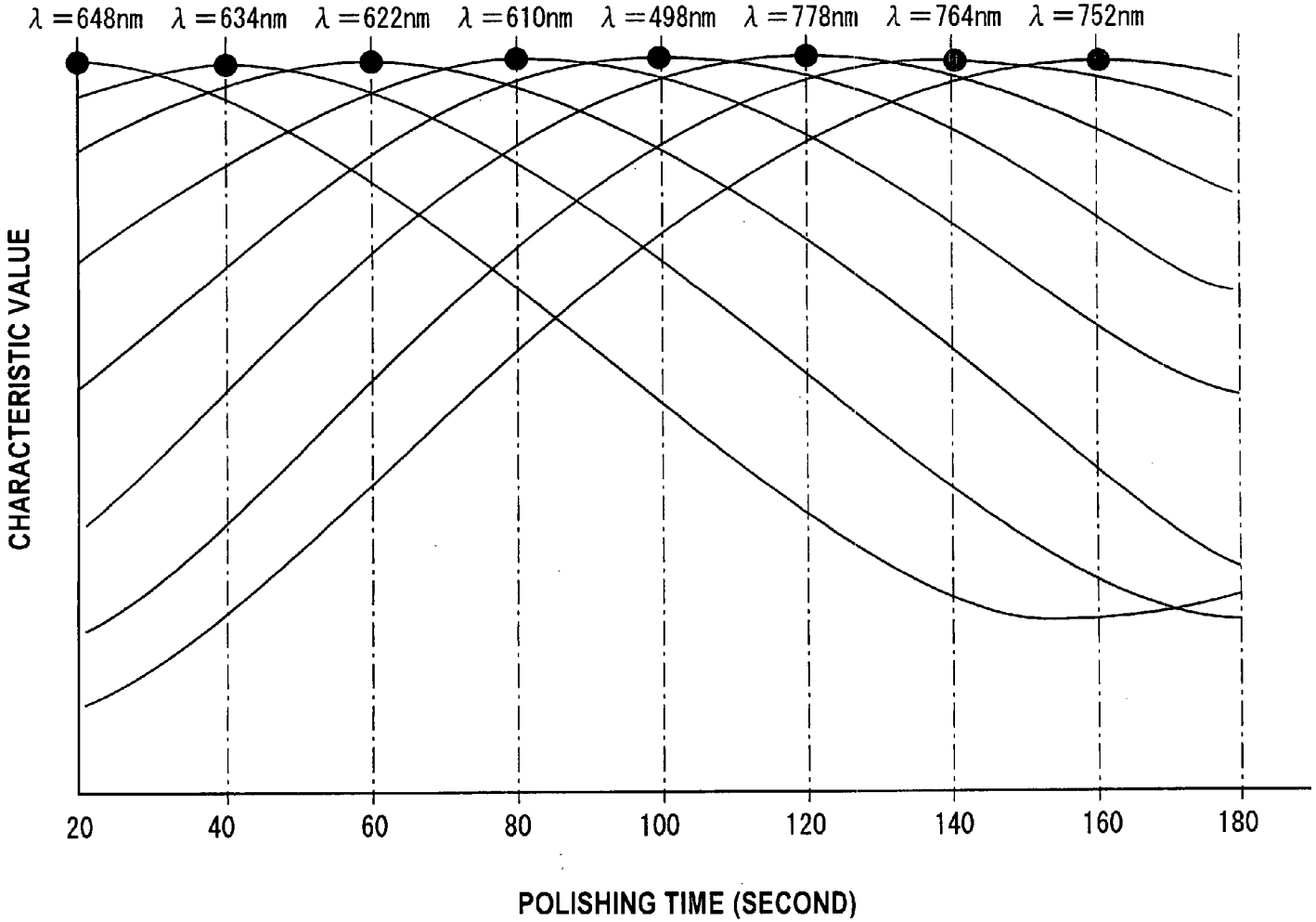
FIG. 12 is a graph showing characteristic values corresponding to the wavelengths selected according to the flowchart shown in FIG. 11.

Next, based on the spectral data obtained in step 2, plural wavelengths are selected. The wavelengths to be selected are such that the corresponding characteristic values show local maximum points at the respective management points. According to this selection method, even when a substrate having complicated pattern structures is to be polished, wavelengths can be selected such that the local maximum points (or local minimum points) appear periodically. FIG. 12 is a graph showing the characteristic values corresponding to the wavelengths selected according to the flowchart shown in FIG. 11. It can be seen from FIG. 12 that, during polishing of the substrate, the local maximum points appear at the time intervals (20 seconds in this example), each of which is equal to the interval between the established management points. In this manner, the progress of polishing can be monitored at desired time intervals.

Figure 13:
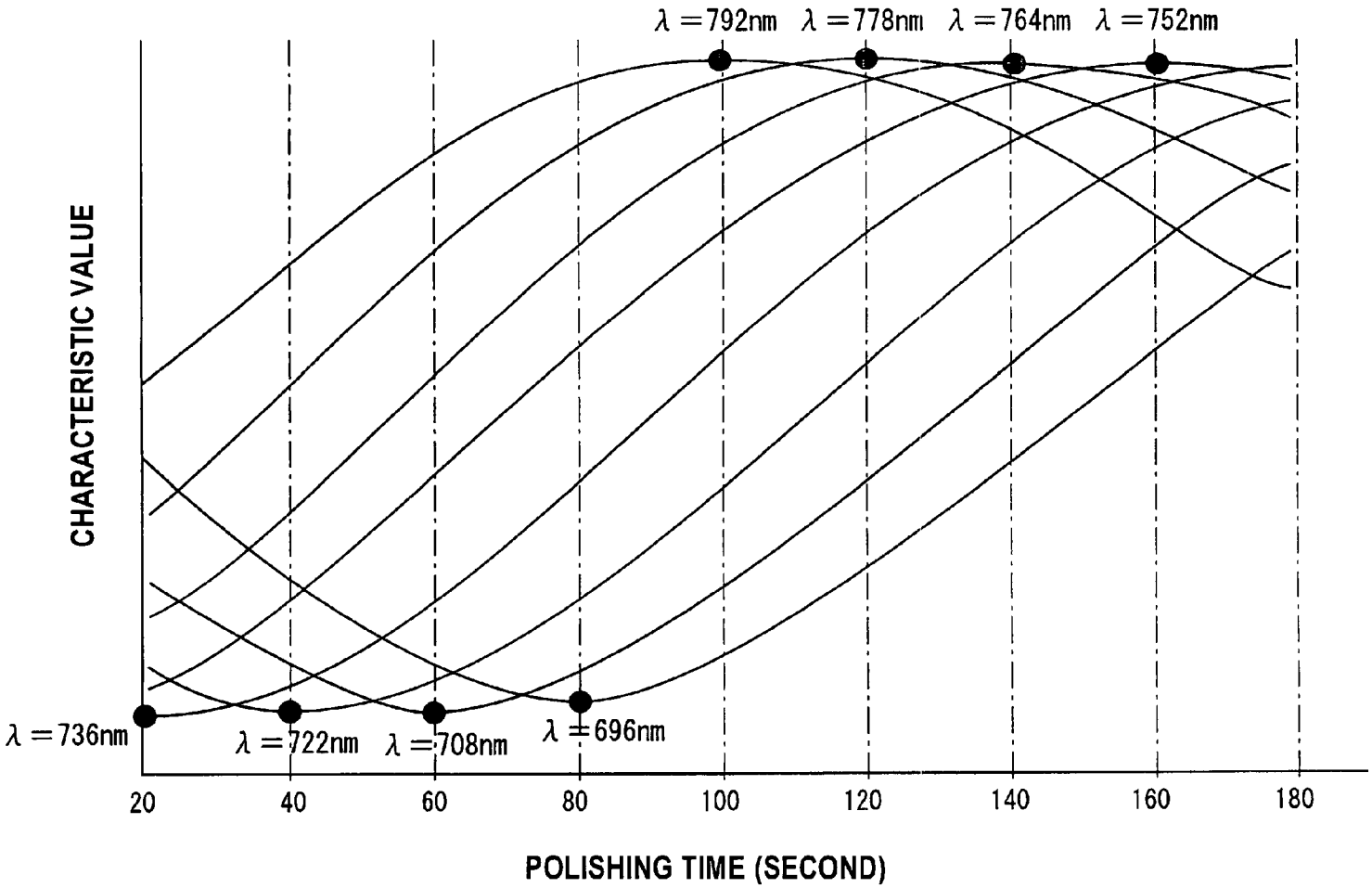
FIG. 13 is a graph showing an example in which local maximum points and local minimum points of the characteristic values appear at approximately equal intervals.

It is possible to use not only the local maximum points but also the local minimum points to monitor the progress of polishing. FIG. 13 is a graph showing an example in which the local maximum points and the local minimum points of the characteristic values appear at approximately equal intervals. As shown in FIG. 13, the wavelengths may be selected such that the local maximum points and the local minimum points appear at approximately equal intervals. In this case, it is possible to use light with longer wavelengths. Therefore, a filter can be used to cut off a shorter wavelength light, and can effectively prevent photocorrosion.

It is preferable to perform noise-reduction process on the spectral data before selecting the wavelengths. For example, an average of measurements at plural points on the surface of the substrate may be calculated, or a moving average of the measurements along a temporal axis may be calculated. It is also possible to calculate an average of reflection intensities measured during polishing at each wavelength, divide each reflection intensity at each wavelength by the corresponding average to create normalized spectral data for each management point, and select the plural wavelengths by searching for wavelengths around wavelengths that correspond to the local maximum points (and/or the local minimum points) in the normalized spectral data. Alternatively, it is possible to determine characteristic values at appropriate increments within the range from the lower limit to the upper limit of the wavelength (e.g., from 400 nm to 800 nm) that can be monitored by the monitoring unit 15, check the temporal variation in the characteristic values, and select plural wavelengths such that the local maximum points and/or the local minimum points appear at desired timings.

The index, calculated based on the reflection intensity or the relative reflectance using wavelength as a parameter, may be used as the characteristic value. For example, the index (λk) as the characteristic value can be calculated with respect to a wavelength λk by using $$A_{\lambda k}=\int R(\lambda)\cdot W_{\lambda k}(\lambda)d\lambda \tag{10}$$

$$\text{index}(\lambda k)=A_{\lambda k} \tag{11}$$

where λrepresents a wavelength, R(λ) is a relative reflectance, $W_{\lambda k}(\lambda)$ is a weight function having its center on the wavelength λk (i.e., having its maximum value at the wavelength λk). Instead of the relative reflectance, the reflection intensity may be used as R(λ). With these processes, noise in the spectral data around the wavelength λk can be reduced, and stable waveform of the temporal variation in the characteristic value can be obtained.

Two or more wavelengths can be used as the parameters to determine the index (λk1, λk2, . . . ) as the characteristic value from the following equation:

$$\text{Index}(\lambda k1,\ \lambda k2,\ \ldots)=A_{\lambda k1}/(A_{\lambda k1}+A_{\lambda k2}+\ldots) \tag{12}$$

Since the relative reflectance is divided by the relative reflectance, the influences of a slight change in distances between the substrate and the light-applying unit and between the substrate and the light-receiving unit and a change in the amount of the received light due to entry of slurry can be suppressed. Therefore, more stable waveform of the temporal variation in the characteristic value can be obtained. In this case, the preferable number of wavelengths as the parameters is two or three. The index can also be calculated from the reflection intensities according to the same procedures.

In the equation (10), interval of integration is from the lower limit to the upper limit of the range of the wavelengths that can be monitored by the monitoring unit 15. For example, where the monitoring unit 15 has the ability to monitor the wavelengths λ ranging from 400 nm to 800 nm, the interval of integration in the equation (10) is from 400 to 800. The processes as expressed by the equations (10) and (12) are processes of reducing noise components from the reflection intensity or the relative reflectance. Therefore, the index with less noise components can be used as the characteristic value by performing the processes as expressed by the equations (10) and (12) on the reflection intensity or the relative reflectance.

Figure 14:
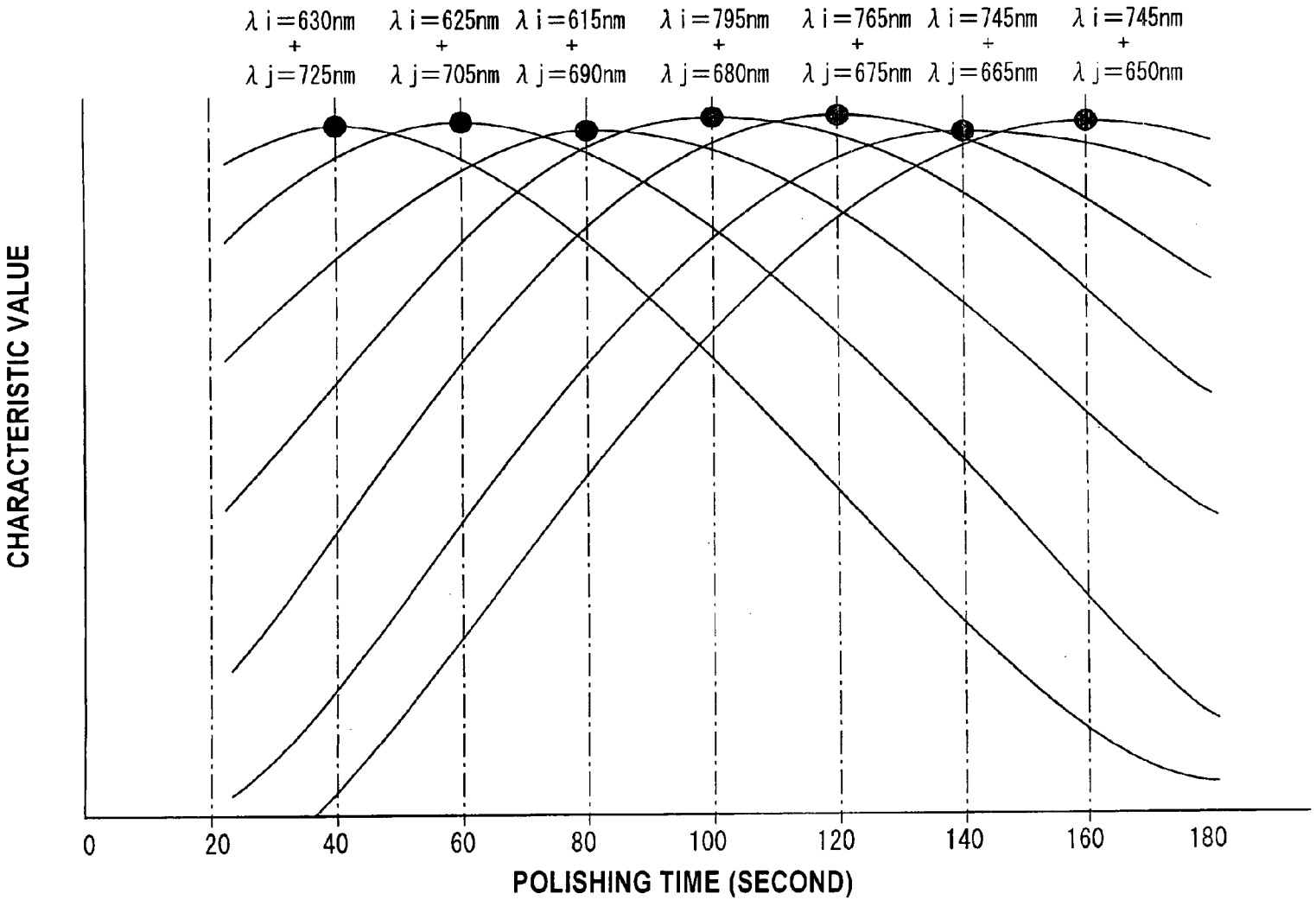
FIG. 14 is a graph showing a characteristic value obtained by performing certain processes on relative reflectance.

FIG. 14 is a graph showing characteristic values expressed by the equations (10) and (12). In this example, two wavelengths are used as the parameters. In this case also, by appropriately selecting the wavelengths, plural local maximum points (or local minimum points) of the characteristic value appear during polishing, as shown in FIG. 14.

Figure 15:
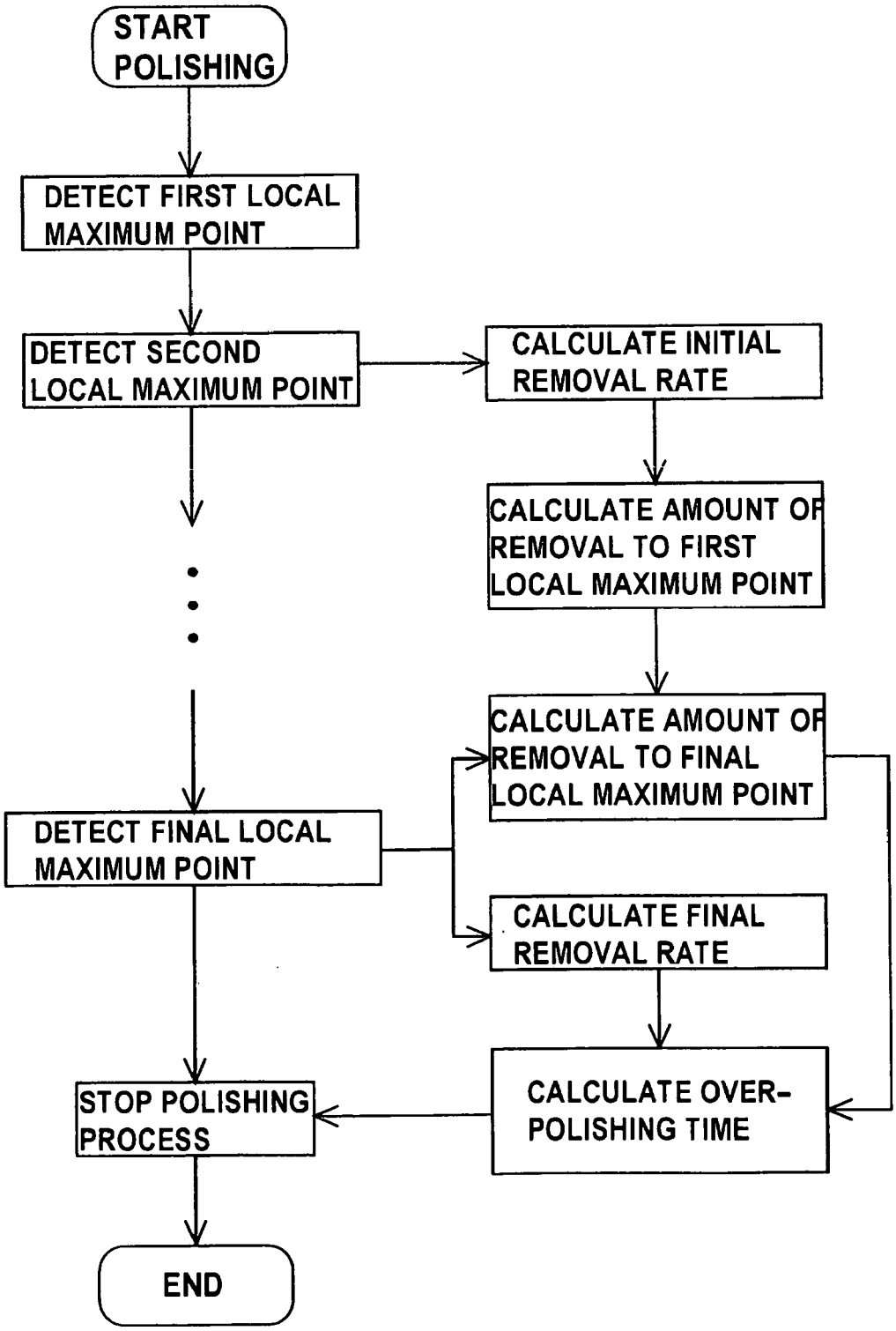
FIG. 15 is a flowchart showing a method of monitoring progress of polishing according to an embodiment of the present invention.

Next, a method of monitoring the polishing process and detecting a polishing end point will be described with reference to FIG. 15, which is a flowchart showing a method of monitoring progress of polishing according to an embodiment of the present invention. First, the first wavelength λ1 is selected. After polishing is started, the characteristic value corresponding to the first wavelength λ1 is monitored by the monitoring unit 15, and a local maximum point of the characteristic value (which will be hereinafter called a first local maximum point) is detected by the monitoring unit 15. After the first local maximum point is detected, the first wavelength λ1 is switched to the second wavelength λ2. Then, the characteristic value corresponding to the second wavelength λ2 is monitored until a local maximum point of the characteristic value (which will be hereinafter called a second local maximum point) is detected by the monitoring unit 15. In this manner, monitoring of the characteristic value and detection of the local maximum point are continued, while the wavelength is successively switched to another.

A removal rate at an initial stage of polishing can be calculated from a time t1 when the first local maximum point appears, a time t2 when the second local maximum point appears, and an amount of the film that has been removed between the first local maximum point and the second local maximum point. Where Δx' represents the amount of the film that has been removed between the first and second local maximum points, an initial removal rate $RR_{Int}$ can be calculated from the following equation:

$$\text{Initial removal rate } RR_{Int}=\Delta x'/(t2-t1) \quad (13)$$

The amount Δx' of the film that has been removed between the first and second local maximum points corresponds to the above-described management removal amount Δx or the amount of the film removed between the above-described management points.

An amount of the film that has been removed during a time interval from a polishing start time t0 to the time t1 (which will be hereinafter called an initial amount of removal) can be determined by multiplying the initial removal rate $RR_{Int}$ by a difference between the time t1 and the time t0

An amount of the film that has been removed at each local maximum point can be obtained by adding the initial amount of removal to a cumulative value of the amounts of the film that has been removed between the local maximum points. Hereinafter, the amount of the film that has been removed at each local maximum point will be referred to as an integrated amount of removal. For example, in the example shown in FIG. 10, the integrated amount of removal at a fifth local maximum point, which is the final local maximum point, can be determined by adding the initial amount to 80 nm which is an amount of removal from the first local maximum point to the fifth local maximum point. In the example shown in FIG. 11, the amount of the film removed between the local maximum points is the amount of the film removed between the management points which is calculated from the polishing results of the sample substrate. After the integrated amount of removal at the fifth local maximum point is calculated, a removal rate $RR_{Fin}$ at a final stage of polishing is calculated. This final removal rate $RR_{Fin}$ can be determined by dividing an amount of the film removed between the final local maximum point and a local maximum point just before the final local maximum point by a time different between these two local maximum points, as with the equation (13).

Then, the integrated amount of removal at the final local maximum point is subtracted from a target amount of removal, and the resultant value is divided by the final removal rate $RR_{Fin}$, whereby an over-polishing time is determined. The over-polishing time is a period of time from the final local maximum point to the polishing end point. Therefore, a polishing end time is determined by adding the over-polishing time to a time when the final local maximum point appears. In this manner, the polishing end time is calculated and the polishing apparatus terminates its polishing operation when the polishing end time is reached.

In the above-discussed polishing progress monitoring method, the monitoring unit 15 calculates and monitors all of the characteristic values with respect to all wavelengths (λ1, λ2, . . . ) simultaneously, and detects the local maximum points (or the local minimum points) while switching the characteristic values from one to another. The number of characteristic values to be calculated and monitored simultaneously may be limited. For example, when switching a wavelength to the next wavelength, the monitoring unit 15 may calculate the characteristic value corresponding to the next wavelength, and may monitor only the calculated characteristic value. This makes it possible to reduce the requisite processing power to thereby reduce the burden of the monitoring unit 15.

Depending on the initial film thickness or the variation in thickness of the underlying film, the characteristic value corresponding to the first wavelength may not show the first local maximum point. In such a case, plural characteristic values corresponding to plural wavelengths are monitored simultaneously, and when any of the characteristic values shows its local maximum point (or its local minimum point), the wavelength of such characteristic value is determined to be the first wavelength. Thereafter, the same steps are performed. The characteristic values to be monitored simultaneously are characteristic values (e.g., those corresponding to the wavelengths λ1, λ2, . . . ) which are expected to show local maximum points (or the local minimum points) at the initial stage of the polishing process. There may be cases where the final local maximum point does not appear at the final stage of the polishing process. In such cases, the integrated amount of removal is calculated each time the local maximum point of each characteristic value is detected, and the difference between the target amount to be removed and the integrated amount of removal is calculated. When the resultant difference becomes smaller than the amount of removal between the local maximum points, the last local maximum point detected is determined to be the final local maximum point. In this case also, the over-polishing time can be calculated in the same steps as described above.

In this embodiment, a thickness of a residual film is not monitored. Instead, a thickness of a film that has been removed, i.e., an amount of the film that has been removed, is monitored. The monitoring unit 15 successively detects the local maximum points of the characteristic values corresponding to the respective wavelengths, while switching from one wavelength to another. With this operation, the monitoring unit 15 can monitor the progress of polishing (e.g., at the intervals of 20 nm). Further, the monitoring unit 15 can calculate the polishing end time from the target amount to be removed, the polishing time measured, and the amount of the film removed between the local maximum points. It should be noted that the local minimum points can be monitored in the same manner for monitoring the progress of the polishing process and detecting the polishing end point.

Figure 3:
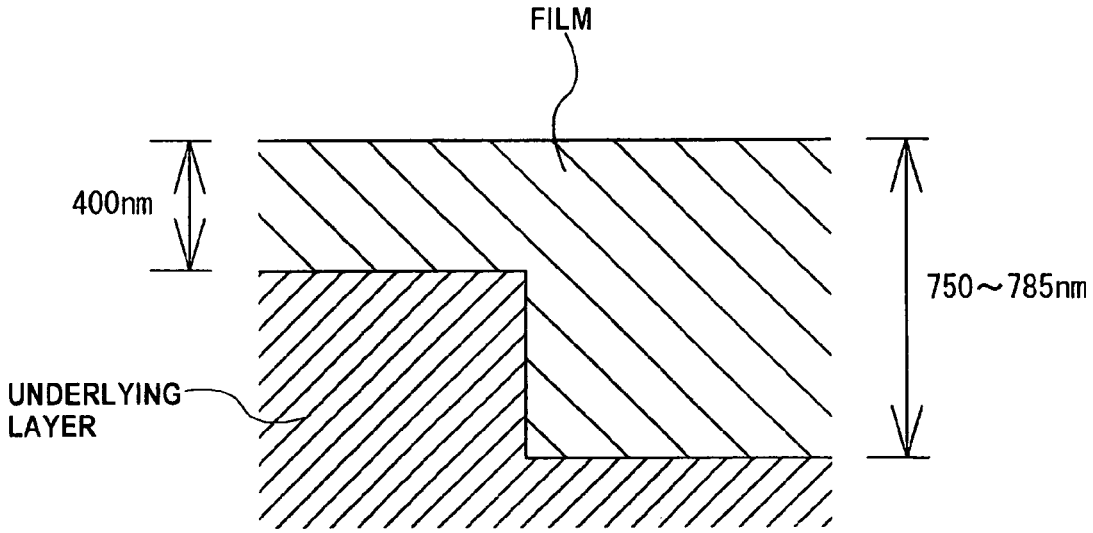
FIG. 3 is a cross-sectional view showing part of a multilayer structure of a substrate.
Figure 4:
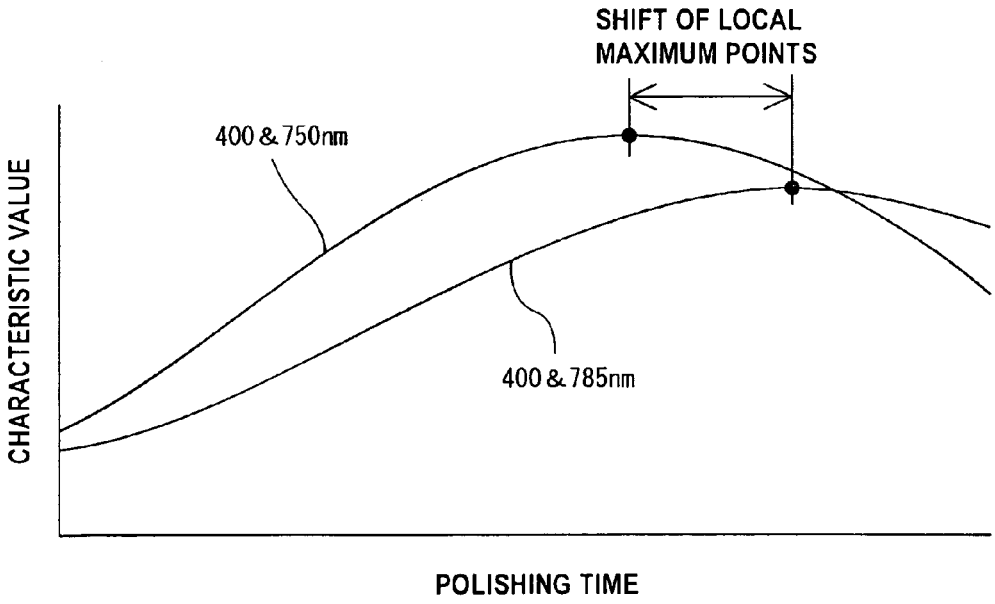
FIG. 4 is a graph showing the characteristic values that shift depending on an initial film thickness.
Figure 5:
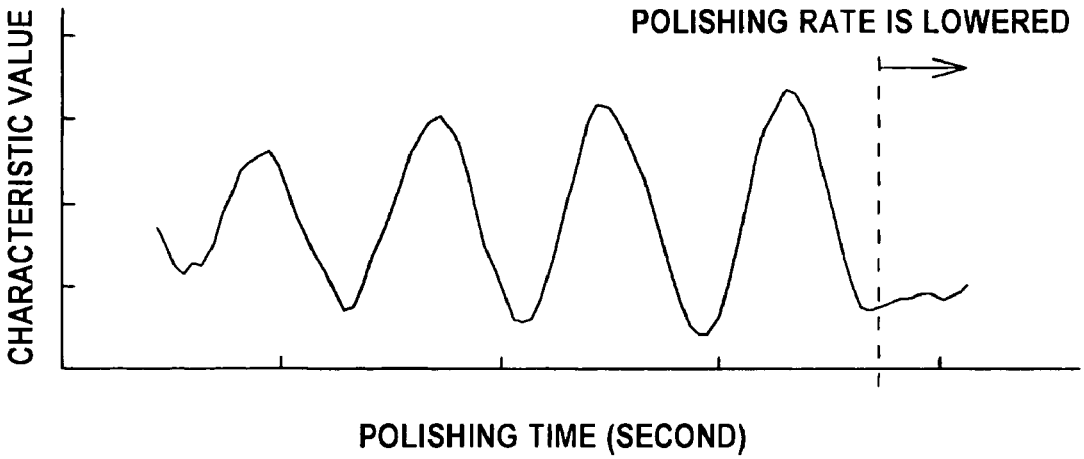
FIG. 5 is a graph showing the characteristic value when a polishing rate is low.
Figure 6:
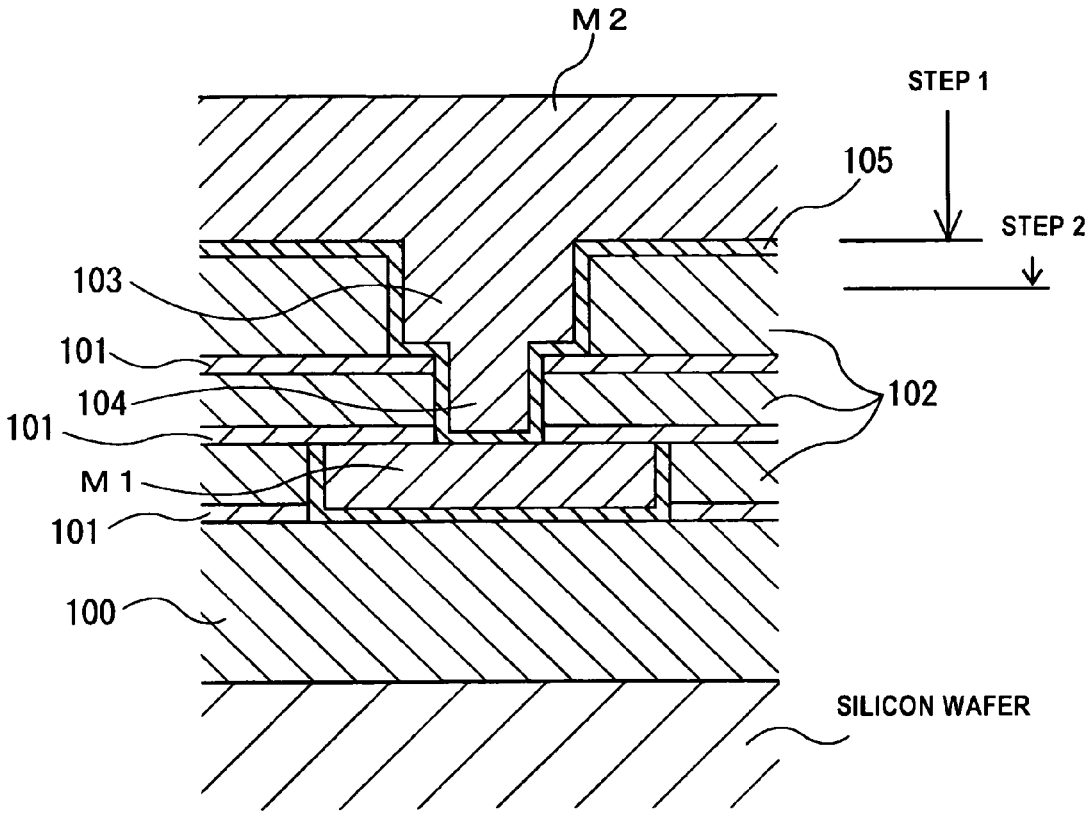
FIG. 6 is a cross-sectional view showing a multilayer interconnect structure formed on a silicon wafer.
Figure 16A:
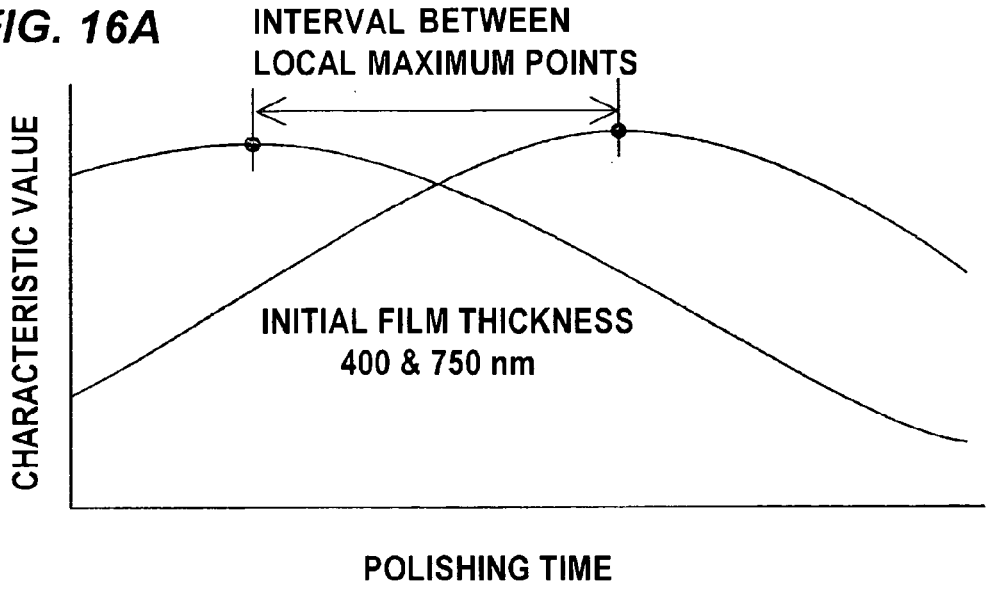
FIG. 16A and FIG. 16B are graphs in which the local maximum point shifts depending on an initial film thickness.
Figure 16B:
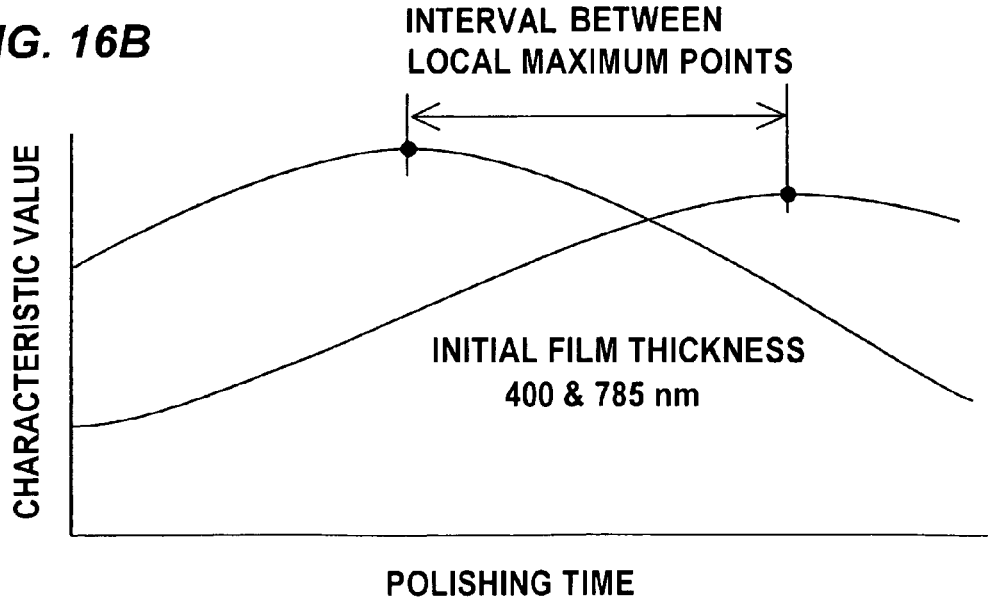

The film to be polished is typically formed on an underlying layer having concave and convex structures. In general, the depth of concave portions of the concave and convex structures is not constant and varies to some extent from region to region. For example, in FIG. 3, depth from a surface of a film to bottom of the concave portions (i.e., the initial film thickness at the concave portions) varies in a range of 750 nm to 785 nm. In such a case, as shown in FIG. 16A and FIG. 16B, the characteristic values vary depending on the initial film thickness, and the local maximum points (or local minimum points) appear at different times. However, even in this case, as can be seen from FIG. 16A and FIG. 16B, if the variation in the initial film thickness at the concave portions (i.e., the variation in the thickness of the underlying layer) is relatively small, the time interval between the neighboring local maximum points and the corresponding amount of the film removed during this time interval are approximately constant, regardless of the variation in the initial film thickness at the concave portions (i.e., the variation in the thickness of the underlying layer). If the variation in the thickness of the underlying layer is large and possibly affects the monitoring operation, a method of applying a filter to a spectral waveform (spectral profile), which will be discussed later, may be used to reduce the influence of the variation in the thickness of the underlying layer.

Figure 17:
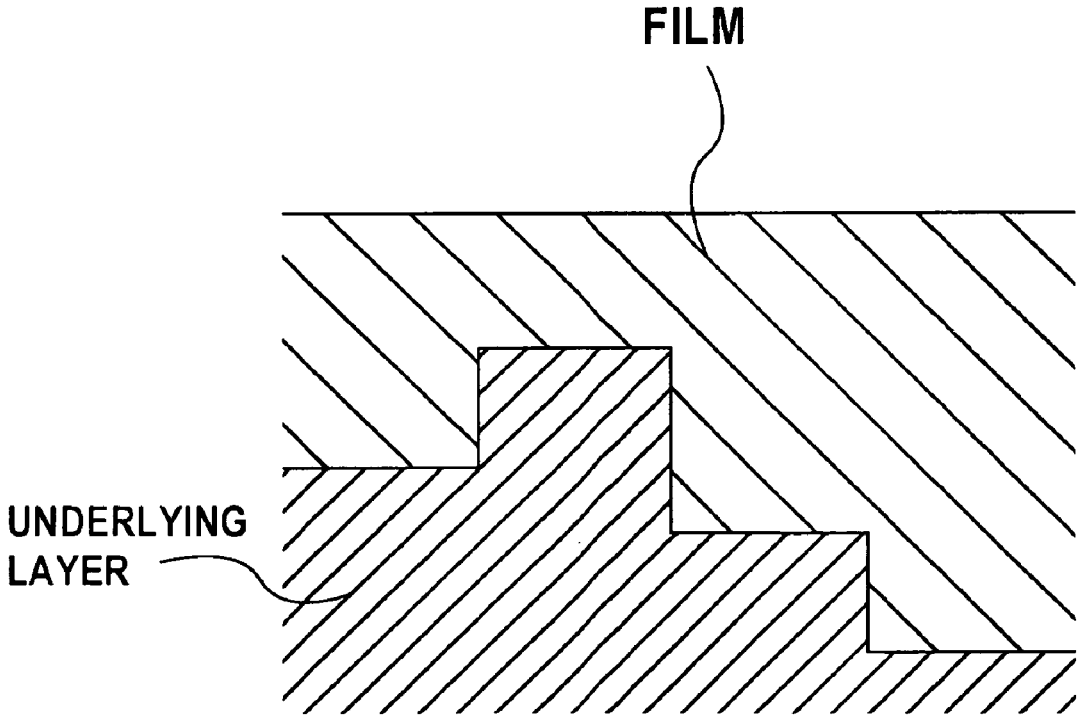
FIG. 17 is a view showing a cross section of part of a pattern substrate as an object to be polished.

As described above, the time interval between the neighboring local maximum points and the corresponding amount of the film removed between the time interval are approximately constant, regardless of the variation in the initial film thickness at the concave portions (i.e., the variation in the thickness of the underlying layer). This fact also holds true for a case of polishing a pattern substrate having complicated structures with film thickness varying from region to region as shown in FIG. 17. In the method of selecting wavelengths as described with reference to FIG. 11, the monitoring interval (i.e., the time interval of the monitoring points) is calculated using the sample substrate having the same structure as the substrate to be polished, and the wavelengths are selected based on the time interval. Therefore, even in the case of polishing a pattern substrate having complicated structure as shown in FIG. 17, the local maximum points appear at approximately equal time intervals. Therefore, the polishing end point can be detected accurately based on the amount of the film that has been removed. The pattern substrates shown in FIG. 3 and FIG. 17 have a surface that has been planarized by a previous polishing process. Therefore, the initial film thickness in this case is a film thickness at a point of time when the previous polishing process is terminated.

According to the method of monitoring the progress of polishing as described above, the progress of polishing can be monitored at small time intervals from the polishing start point to the polishing end point. Further, because the amount of the film that has been removed can be calculated accurately during polishing, an accurate polishing end point detection can be realized. Therefore, the polishing monitoring method of this embodiment can be applied well to a process of adjusting an ohmic value that requires an accurate polishing end point detection. This adjustment process is, specifically, a polishing process of removing a copper film and a barrier film (e.g., tantalum or tantalum nitride) underlying the copper film and subsequently polishing a film including an insulating material and a copper interconnect material to thereby adjust a height of interconnects (i.e., an ohmic value). Further, according to the polishing monitoring method of this embodiment, light with relatively long wavelengths is used. Therefore, damages to the interconnect metal due to photocorrosion can be prevented.

Figure 18:
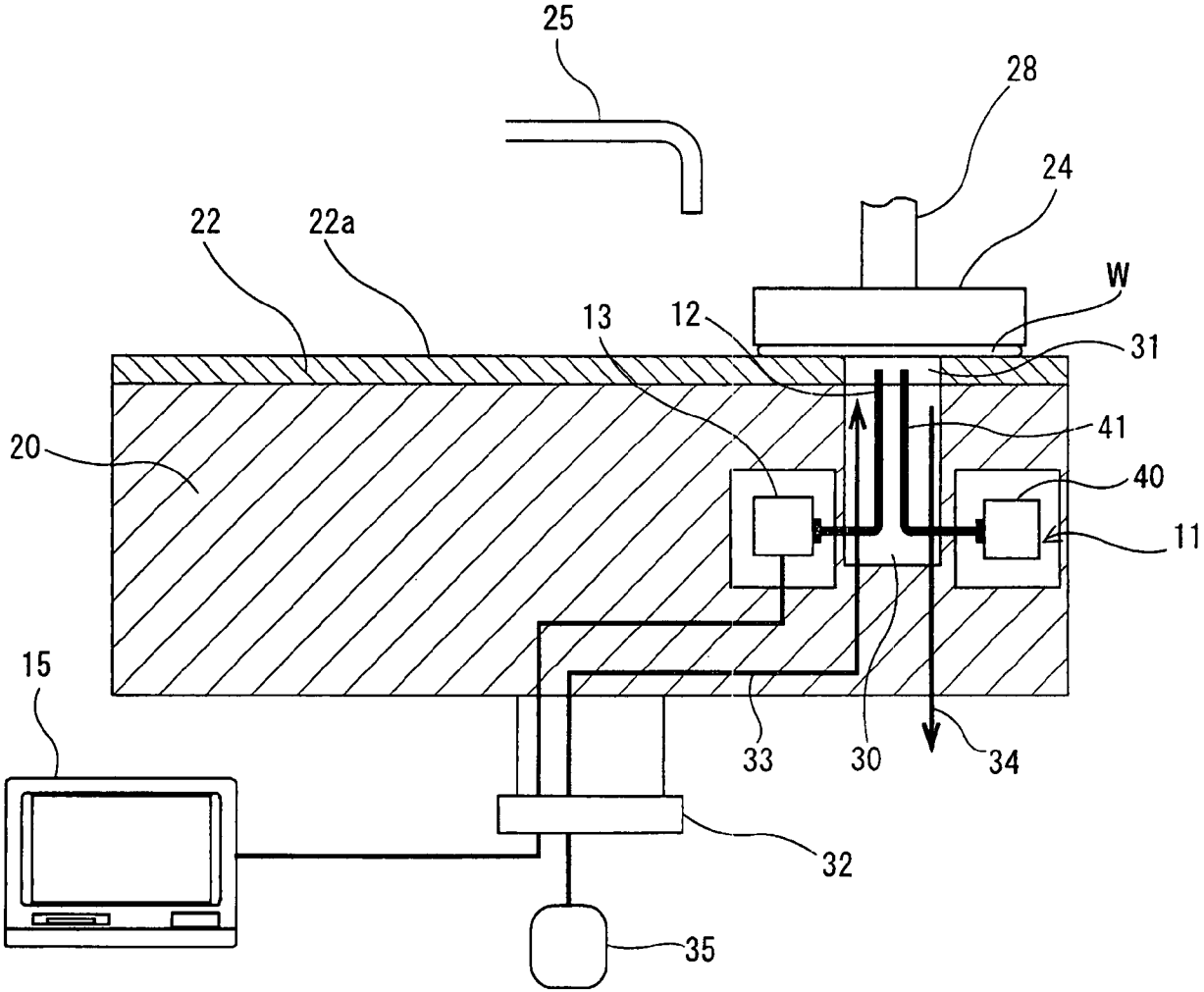
FIG. 18 is a cross-sectional view schematically showing a polishing apparatus according to an embodiment of the present invention.

Next, a polishing apparatus utilizing the above-described principles will be described. FIG. 18 is a cross-sectional view showing the polishing apparatus. As shown in FIG. 18, the polishing apparatus includes a polishing table 20 holding a polishing pad 22 thereon, a top ring 24 configured to hold a substrate W and press the substrate W against the polishing pad 22, and a polishing liquid supply nozzle 25 configured to supply a polishing liquid (slurry) onto the polishing pad 22. The polishing table 20 is coupled to a motor (not shown in the drawing) provided below the polishing table 20, so that the polishing table 20 is rotated about its own axis. The polishing pad 22 is secured to an upper surface of the polishing table 20.

The polishing pad 22 has an upper surface 22*a*, which provides a polishing surface where the substrate W is polished by the sliding contact with the polishing surface. The top ring 24 is coupled to a motor and an elevating cylinder (not shown in the drawing) via a top ring shaft 28. This configuration allows the top ring 24 to move vertically and rotate about the top ring shaft 28. The top ring 24 has a lower surface for holding the substrate W by a vacuum suction or the like.

The substrate W, held on the lower surface of the top ring 24, is rotated by the top ring 24, and is pressed against the polishing pad 22 on the rotating polishing table 20. During the contact between the substrate W and the polishing pad 22, the polishing liquid is supplied onto the polishing surface 22*a* of the polishing pad 22 from the polishing liquid supply nozzle 25. A surface (i.e., a lower surface) of the substrate W is thus polished in the presence of the polishing liquid between the surface of the substrate W and the polishing pad 22. In this embodiment, a mechanism of providing relative movement between the surface of the substrate W and the polishing pad 22 is constructed by the polishing table 20 and the top ring 24.

The polishing table 20 has a hole 30 which has an upper open end lying in the upper surface of the polishing table 20. The polishing pad 22 has a through-hole 31 at a position corresponding to the hole 30. The hole 30 and the through-hole 31 are in fluid communication with each other. The through-hole 31 has an upper open end lying in the polishing surface 22*a* and has a diameter of about 3 mm to 6 mm. The hole 30 is coupled to a liquid supply source 35 via a liquid supply passage 33 and a rotary joint 32. The liquid supply source 35 is configured to supply water (or preferably pure water) as a transparent liquid into the hole 30 during polishing. The water fills a space defined by the lower surface of the substrate W and the through-hole 31, and is expelled therefrom through a liquid discharge passage 34. The polishing liquid is expelled together with the water, whereby a path of light can be secured. A valve (not shown) is provided in the liquid supply passage 33. Operations of the valve are linked with the rotation of the polishing table 20 such that the valve stops the flow of the water or reduces a flow rate of the water when the substrate W is not located above the through-hole 31.

The polishing apparatus has a polishing progress monitoring unit. This polishing progress monitoring unit includes the light-applying unit 11 configured to apply light to the surface of the substrate W, an optical fiber 12 as the light-receiving unit configured to receive the reflected light from the substrate W, the spectroscope 13 configured to decompose the reflected light according to the wavelength and produces the spectral data, and the monitoring unit 15 configured to monitor the progress of polishing according to the above-discussed principle.

The light-applying unit 11 includes a light source 40 and an optical fiber 41 coupled to the light source 40. The optical fiber 41 is a light-transmitting element for directing light from the light source 40 to the surface of the substrate W. The optical fiber 41 extends from the light source 40 into the through-hole 31 through the hole 30 to reach a position near the surface of the substrate W to be polished. The optical fiber 41 and the optical fiber 12 have tip ends, respectively, facing the center of the substrate W held by the top ring 24, so that the light is applied to regions including the center of the substrate W each time the polishing table 20 rotates. In order to facilitate replacement of the polishing pad 22, the optical fiber 41 may be accommodated in the hole 30 such that the tip end of the optical fiber 41 does not protrude from the upper surface of the polishing table 20.

A light emitting diode (LED), a halogen lamp, a xenon lamp, and the like can be used as the light source 40. The optical fiber 41 and the optical fiber 12 are arranged in parallel with each other. The tip ends of the optical fiber 41 and the optical fiber 12 are arranged so as to face in a direction perpendicular to the surface of the substrate W, so that the optical fiber 41 applies the light to the surface of the substrate W from the perpendicular direction.

During polishing of the substrate W, the light-applying unit 11 applies the light to the substrate W, and the optical fiber 12 as the light-receiving unit receives the reflected light from the substrate W. During the application of the light, the hole 30 is filled with the water, whereby the space between the tip ends of the optical fibers 41 and 12 and the surface of the substrate W is filled with the water. The spectroscope 13 measures the intensity of the reflected light at each wavelength and produces the spectral data. The monitoring unit 15 monitors the progress of polishing according to the above-discussed method (principle) based on the spectral data, and further detects the polishing end point.

Figure 19:
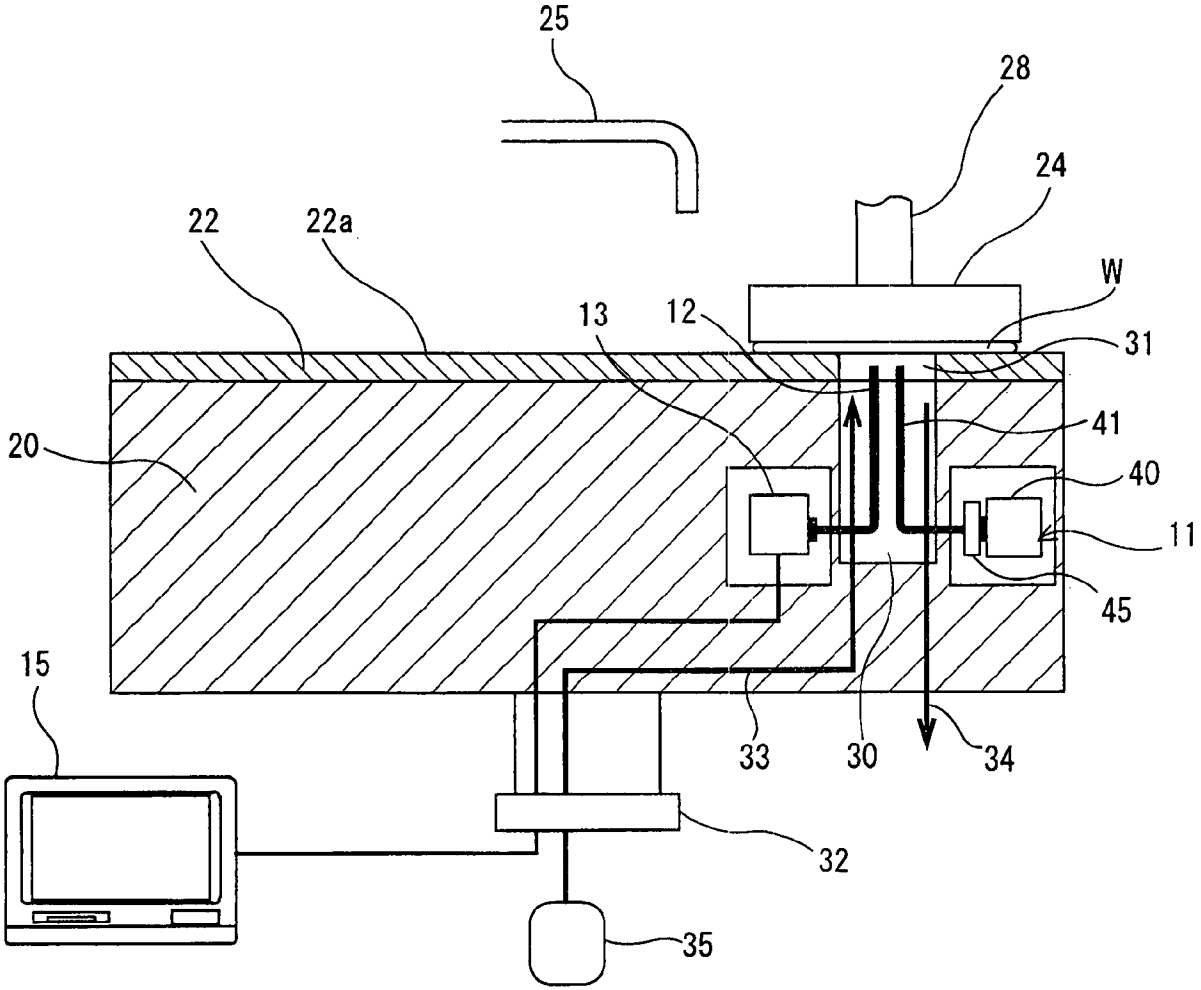
FIG. 19 is a cross-sectional view showing a modified example of the polishing apparatus shown in FIG. 18.

FIG. 19 is a cross-sectional view showing a modified example of the polishing apparatus shown in FIG. 18. In the example shown in FIG. 19, the light-applying unit 11 has a short-wavelength cut-off filter 45 configured to remove short wavelength from the light from the light source 40. This short-wavelength cut-off filter 45 is located between the light source 40 and the optical fiber 41. With this arrangement, the short-wavelength cut-off filter 45 can prevent the photocorrosion of the interconnect metal (e.g., Cu) of the substrate W.

Figure 20:
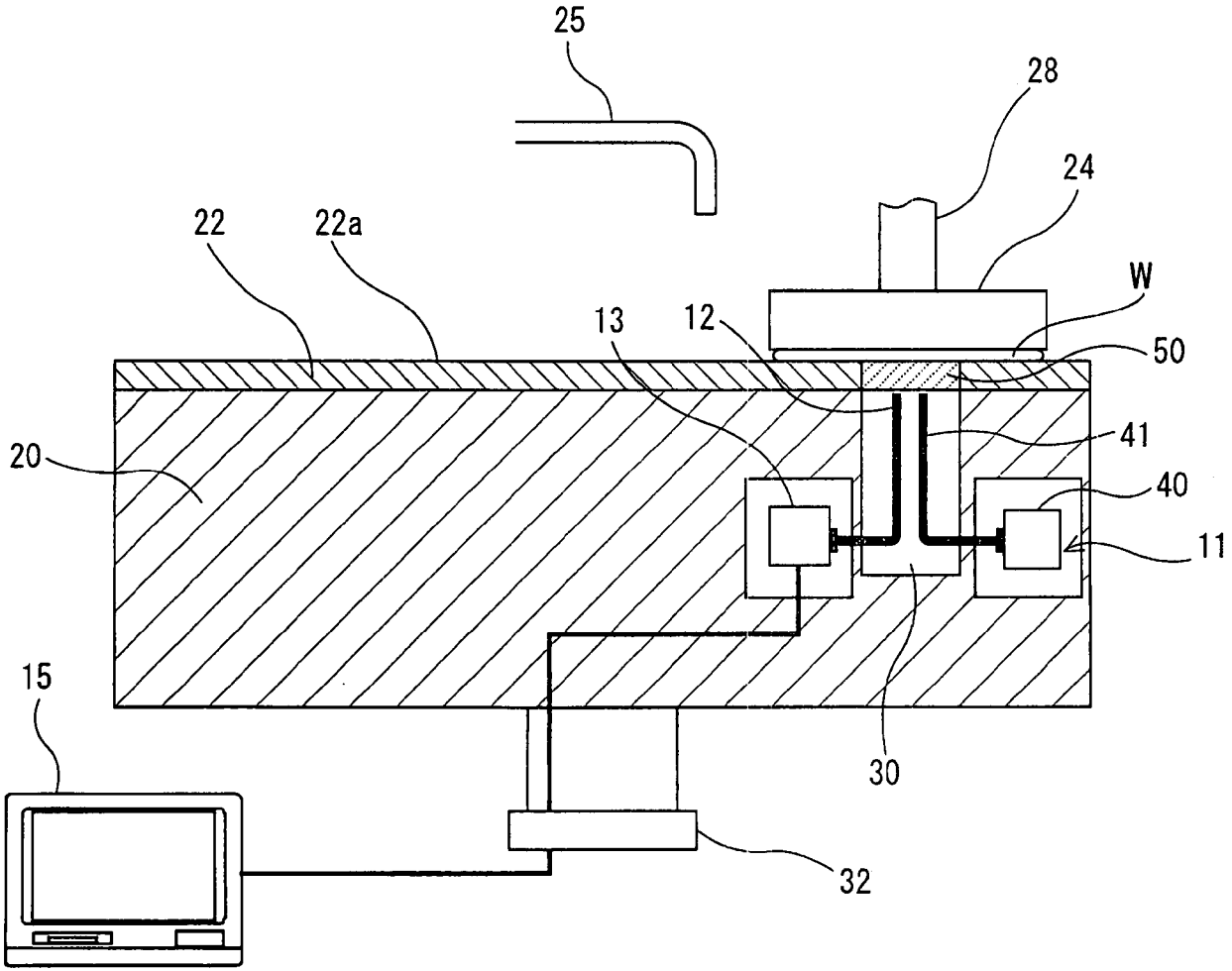
FIG. 20 is a cross-sectional view showing another modified example of the polishing apparatus shown in FIG. 18.

FIG. 20 is a cross-sectional view showing another modified example of the polishing apparatus shown in FIG. 18. In the example shown in FIG. 20, the liquid supply passage, the liquid discharge passage, and the liquid supply source are not provided. Instead of these configurations, a transparent window 50 is provided in the polishing pad 22. The optical fiber 41 of the light-applying unit 11 applies the light through the transparent window 50 to the surface of the substrate W on the polishing pad 22, and the optical fiber 12 as the light-receiving unit receives the reflected light from the substrate W through the transparent window 50.

Figure 21:
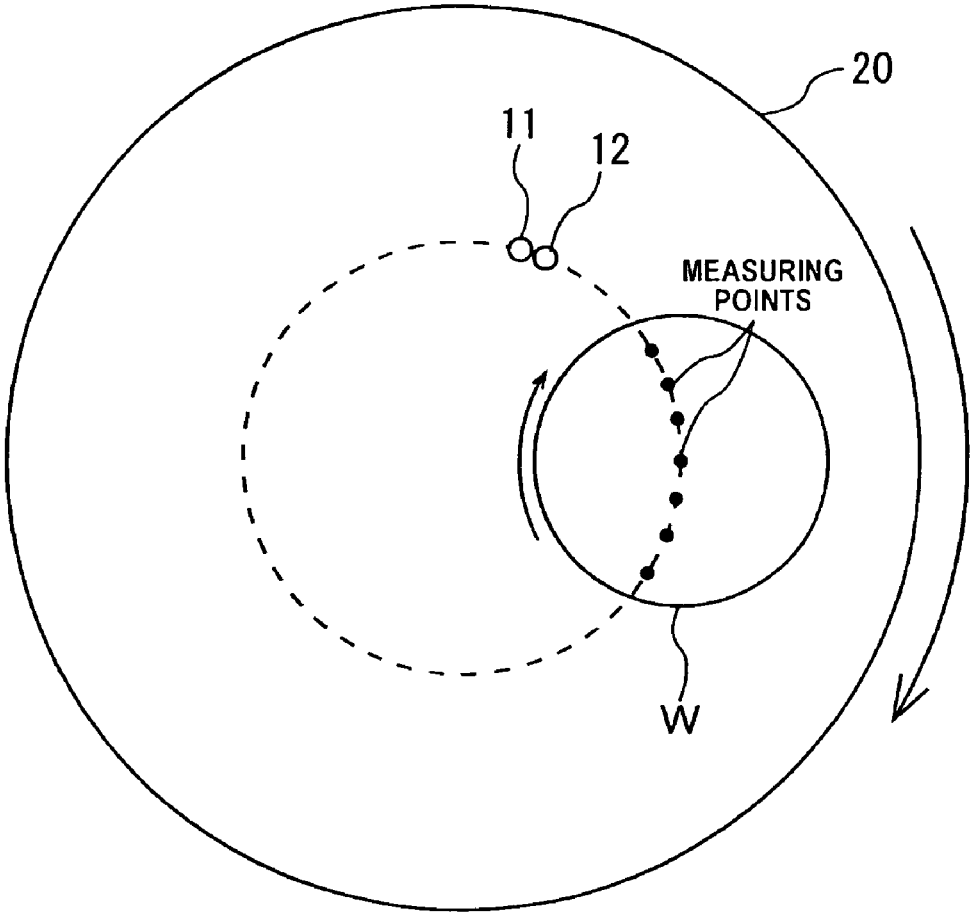
FIG. 21 is a plan view showing a positional relationship between a substrate and a polishing table shown in FIG. 8.

Next, another embodiment of the present invention will be described. The polishing monitoring apparatus shown in FIG. 8 is applied to the present embodiment. This polishing monitoring apparatus can also be used as a polishing end point detection apparatus. FIG. 21 is a plan view showing a positional relationship between a substrate and the polishing table shown in FIG. 8. A substrate W to be polished has a lower layer (e.g., a silicon layer or a tungsten film) and a film (e.g., an insulating film, such as $SiO_2$, having a light-transmittable characteristic) formed on the underlying lower layer. Light-applying unit 11 and light-receiving unit 12 are arranged so as to face a surface of the substrate W. During polishing of the substrate W, the polishing table 20 and the substrate W are rotated, as shown in FIG. 21, to provide relative movement between a polishing pad (not shown) on the polishing table 20 and the substrate W to thereby polish the surface of the substrate W.

The light-applying unit 11 is configured to apply light in a direction substantially perpendicular to the surface of the substrate W, and the light-receiving unit 12 is configured to receive the reflected light from the substrate W. The light-applying unit 11 and the light-receiving unit 12 are moved across the substrate W each time the polishing table 20 makes one revolution. During the revolution, the light-applying unit 11 applies the light to plural measuring points including the center of the substrate W, and the light-receiving unit 12 receives the reflected light from the substrate W. Spectroscope 13 is coupled to the light-receiving unit 12. This spectroscope 13 measures the intensity of the reflected light, received by the light-receiving unit 12, at each wavelength (i.e., measures the reflection intensities at respective wavelengths). More specifically, the spectroscope 13 decomposes the reflected light according to the wavelength and produces spectral data indicating the intensity of light (i.e., the reflection intensity) at each wavelength.

Figure 22:
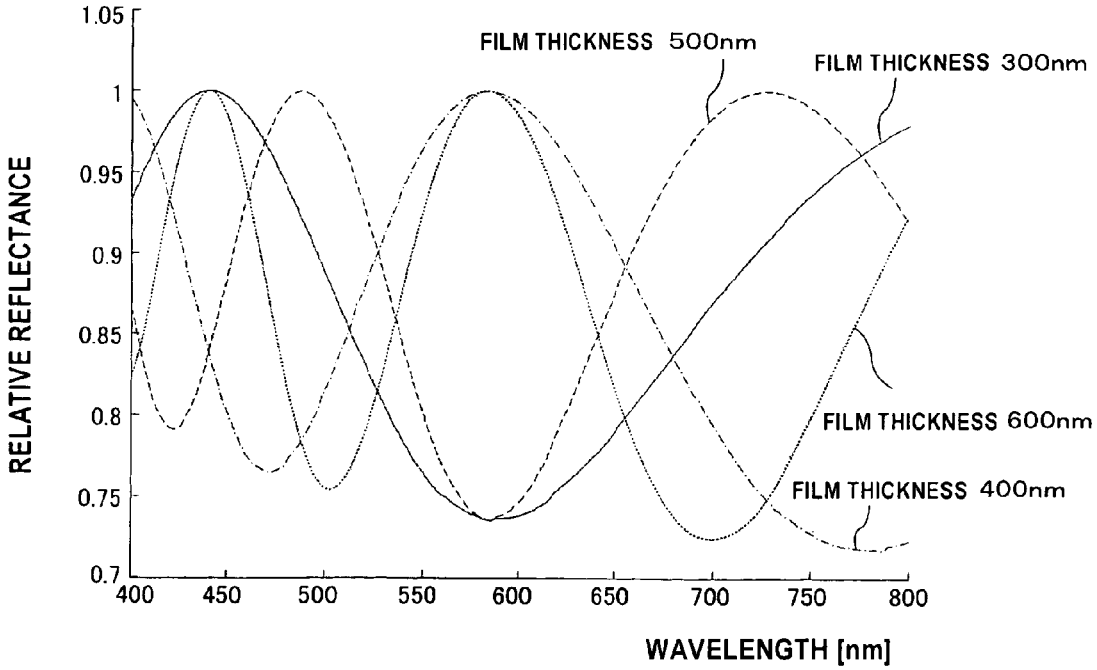
FIG. 22 is a graph showing spectral data obtained by polishing an oxide film ($SiO_2$) with a uniform thickness of 600 nm formed on a silicon wafer.

FIG. 22 is a graph showing the spectral data obtained by polishing an oxide film ($SiO_2$) with a uniform thickness of 600 nm formed on a silicon wafer. In the graph shown in FIG. 22, a horizontal axis indicates wavelength of the light, and a vertical axis indicates relative reflectance calculated from the reflection intensity by using the above equation (2). As shown in FIG. 22, as the film thickness is reduced (i.e., the polishing time increases), positions of local maximum points and local minimum points of the relative reflectances vary. In general, as the film thickness is reduced, the local maximum points shift in a shorter-wavelength direction and intervals between the local maximum points increase.

Monitoring unit 15 is coupled to the spectroscope 13. A general-purpose computer or a dedicated computer can be used as the monitoring unit 15. This monitoring unit 15 is configured to calculate the relative reflectances and the characteristic value from the spectral data, monitor a temporal variation in the characteristic value, and detect a polishing end point based on the local maximum point or the local minimum point of the characteristic value, as shown in FIG. 1. The calculation of the relative reflectances and the characteristic value is performed using the above-described equations (2), (4), and (5).

Figure 23A:
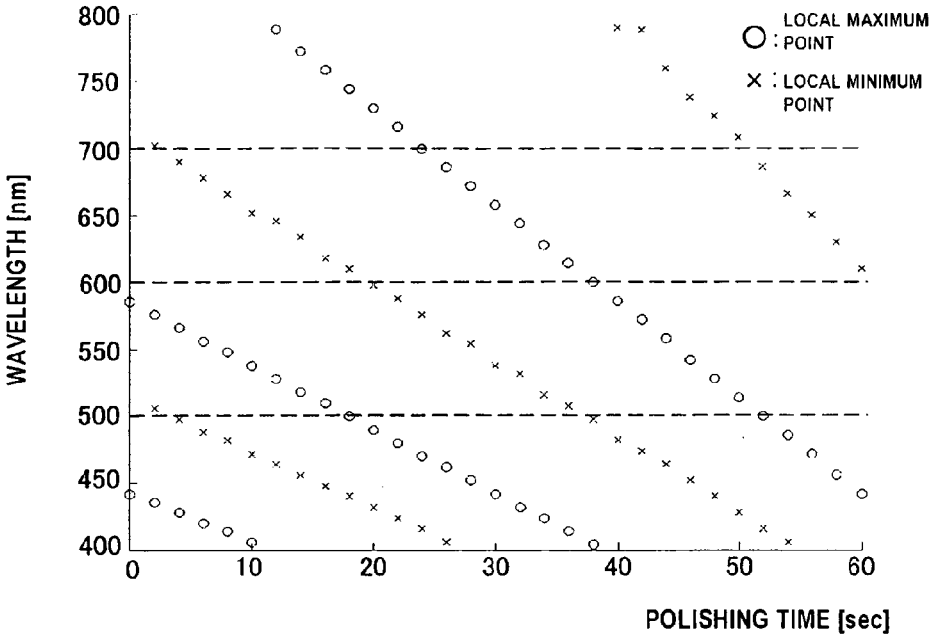
FIG. 23A is a diagram showing distribution of the local maximum points and the local minimum points.

As described above, the wavelengths indicating the local maximum points and the local minimum points of the relative reflectances vary according to the change in the film thickness (i.e., the polishing time). Thus, with use of the monitoring unit 15, spectral data on reflection intensities are obtained during polishing of a sample substrate having the same structure (identical interconnect patterns, identical films) as the substrate to be polished. The monitoring unit 15 determines the wavelengths of the reflected light at which the local maximum points and the local minimum points appear, and identifies a polishing time when these wavelengths are determined. The monitoring unit 15 stores the determined wavelengths and the corresponding polishing time in a storage device (not shown) incorporated in the monitoring unit 15. Further, the monitoring unit 15 plots coordinates, consisting of each wavelength stored and the corresponding polishing time, onto a coordinate system having a vertical axis indicating wavelength and a horizontal axis indicating polishing time, thereby creating a diagram as shown in FIG. 23A. Hereinafter, this diagram will be referred to as a distribution diagram of the local maximum points and the local minimum points, or simply as a distribution diagram. The spectral data, obtained by the monitoring unit 15, may be transmitted to other computer, and creating of the distribution diagram may be performed by this computer.

Figure 23B:
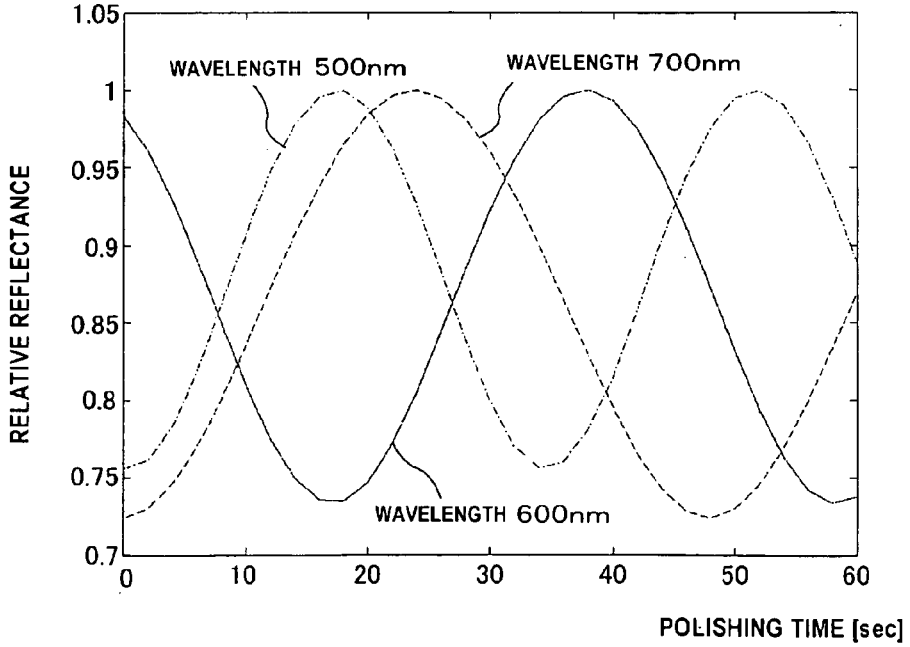
FIG. 23B is a graph showing relative reflectances that change with a polishing time.

In the diagram shown in FIG. 23A, a symbol "○" represents coordinates of a local maximum point, and a symbol "X" represents coordinates of a local minimum point. As can be seen from FIG. 23A, positions of the coordinates indicating the local maximum points and the local minimum points show a downward trend with the polishing time. Therefore, the distribution diagram in FIG. 23A can show a visually-perceptible downward trend of the film thickness. FIG. 23B is a graph showing the relative reflectances that vary with the polishing time. As can be seen from FIG. 23A and FIG. 23B, the local maximum points and the local minimum points of the relative reflectances at respective wavelengths in FIG. 23B appear at times that approximately correspond to the appearance times of the local maximum points and the local minimum points in FIG. 23A. Replacing the film thickness x in the equations (6) and (7) with the polishing time, a straight line connecting the local maximum points and a straight line connecting the local minimum points shown in FIG. 23A can be expressed by the equations (6) and (7), respectively.

Figure 24:
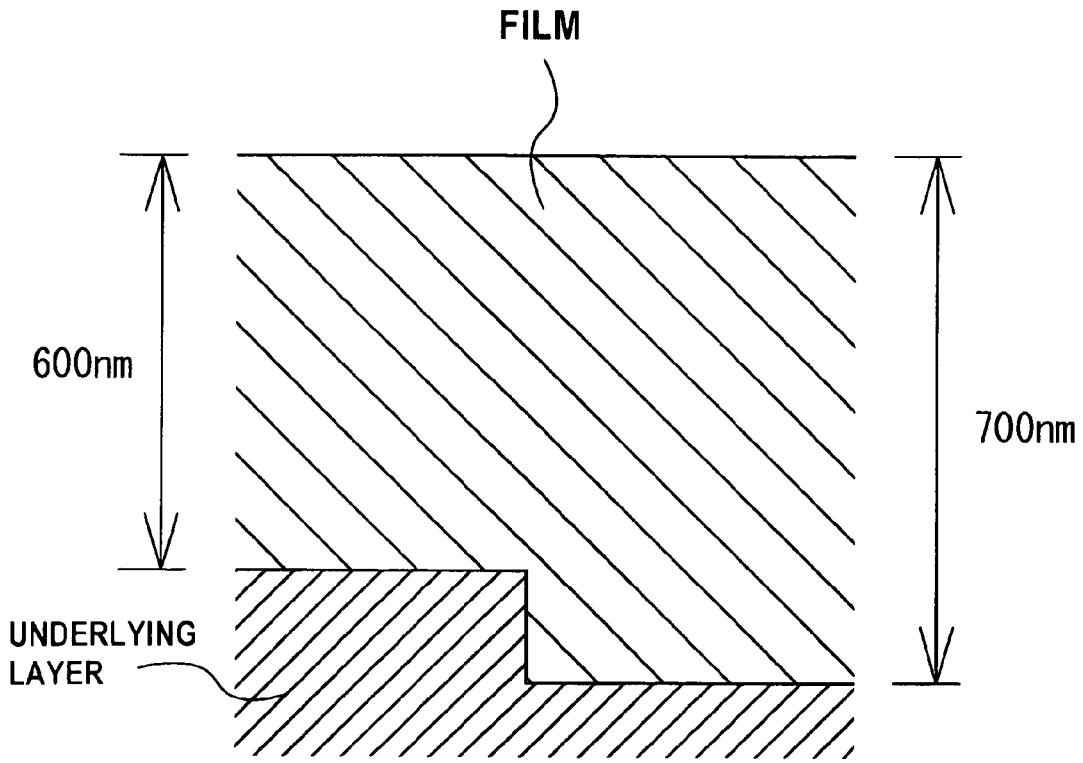
FIG. 24 is a cross-sectional view showing part of a substrate having a film formed on an underlying layer having steps.

The above-described spectral data shown in FIG. 22 are data obtained when polishing a substrate having a film with a uniform thickness formed on an underlying layer. Next, spectral data obtained when polishing a substrate having a film formed on an underlying layer with steps will be described. FIG. 24 is a cross-sectional view showing part of a substrate having a film formed on an underlying lower layer having steps. In this example, the lower layer is a tungsten film that is thick enough not to allow light to pass therethrough. The lower layer has steps on its surface, and a height of the steps is about 100 nm. An oxide film ($SiO_2$) having a thickness in the range of 600 nm to 700 nm is formed on the lower layer.

Figure 25A:
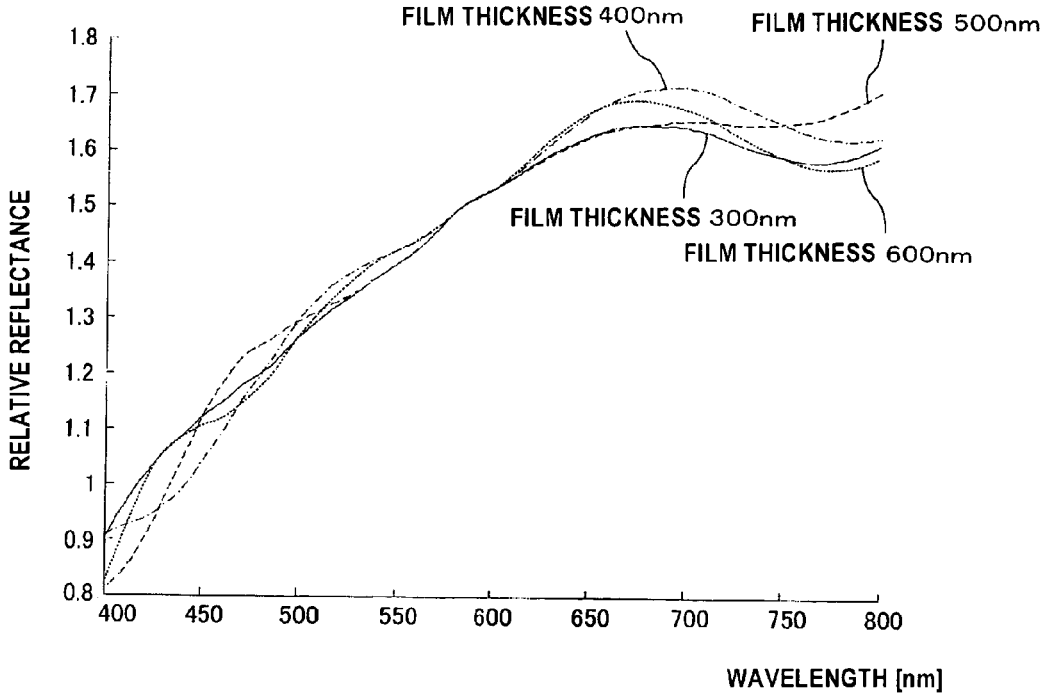
FIG. 25A is a graph showing spectral data obtained by polishing the substrate shown in FIG. 24.
Figure 25B:
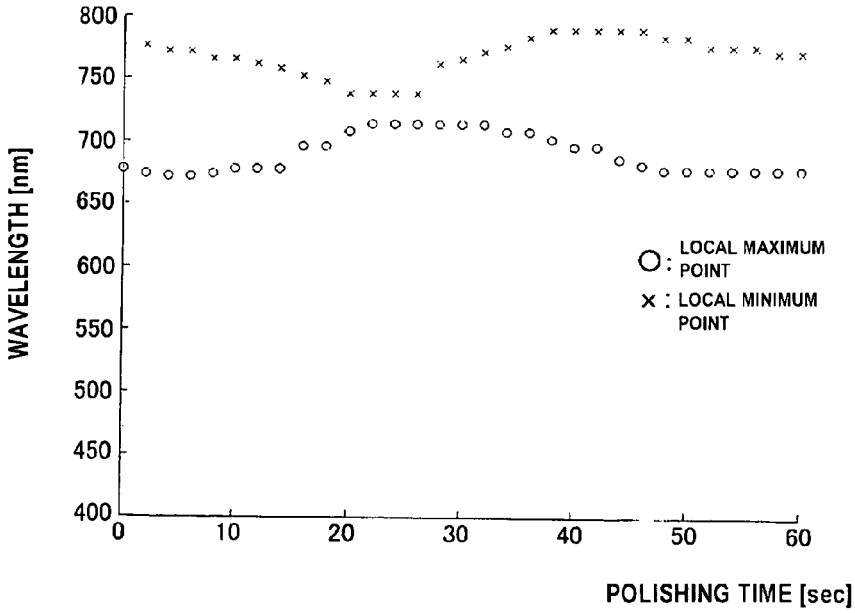
FIG. 25B is a diagram showing distribution of the local maximum points and the local minimum points corresponding to FIG. 25A.

FIG. 25A shows spectral data obtained by polishing the substrate having such structure. As can be seen from FIG. 25A, the longer the wavelength of the light is, the more the relative reflectance increases, and the local maximum points and the local minimum points of the relative reflectances do not clearly appear. This is because of an influence of the underlying lower layer. FIG. 25B is a diagram obtained by plotting coordinates, consisting of the stored wavelengths and the corresponding polishing times indicating the local maximum points and the local minimum points, onto the coordinate system according to the same manner as FIG. 23A. As shown in FIG. 25B, the coordinates indicating the local maximum points and the local minimum points do not show a downward trend, but shift in an approximately horizontal direction.

Figure 26:
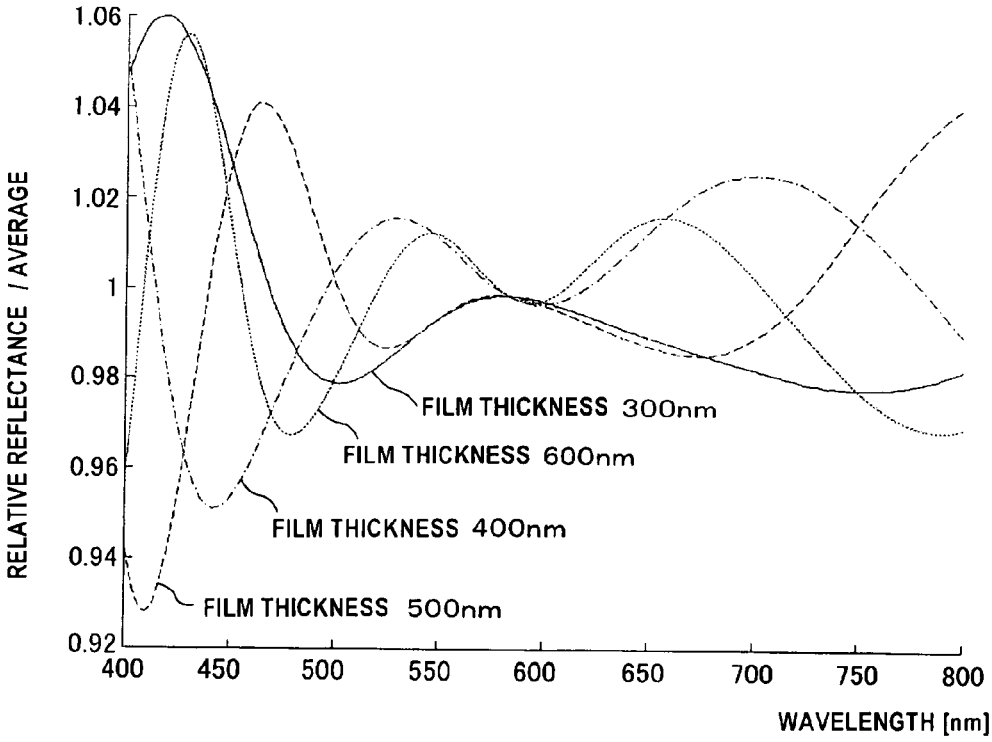
FIG. 26 is a diagram showing spectral data of normalized relative reflectances.

Thus, in order to eliminate the influence of the underlying lower layer, the monitoring unit 15 calculates an average of relative reflectances with respect to each wavelength, and divides each relative reflectance at each polishing time by the average at the corresponding wavelength to thereby create normalized spectral data (i.e., normalized relative reflectances). The aforementioned average of the relative reflectances is an average of relative reflectances obtained over the entire polishing time from the polishing start point to the polishing end point, and is calculated for each wavelength. FIG. 26 shows spectral data of the normalized relative reflectances. As can be seen from FIG. 26, each graph showing the normalized relative reflectances clearly shows local maximum points and local minimum points.

Figure 27A:
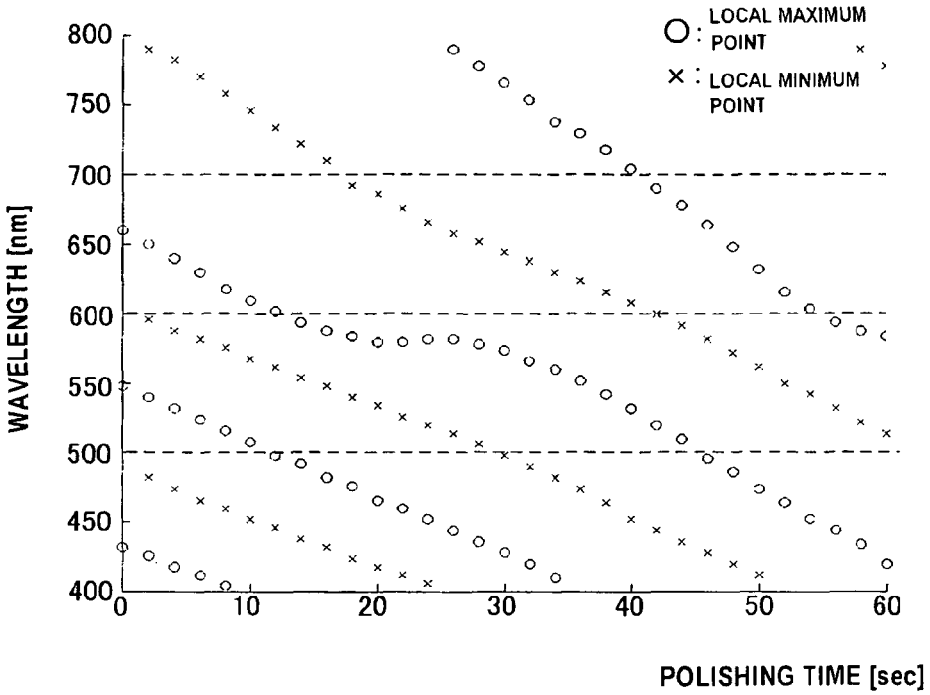
FIG. 27A is a distribution diagram of the local maximum points and the local minimum points produced based on the normalized relative reflectances.

FIG. 27A is a distribution diagram created based on the normalized relative reflectances, and obtained by plotting coordinates, consisting of the wavelengths and the corresponding polishing times indicating the local maximum points and the local minimum points, onto the coordinate system according to the same manner as FIG. 23A. As shown in FIG. 27A, positions of the coordinates indicating the local maximum points and the local minimum points of the normalized relative reflectances show a downward trend, as with the graph shown in FIG. 23A. Therefore, the distribution diagram in FIG. 27A can show a visually-perceptible downward trend of the film thickness with the elapse of the polishing time.

Figure 27B:
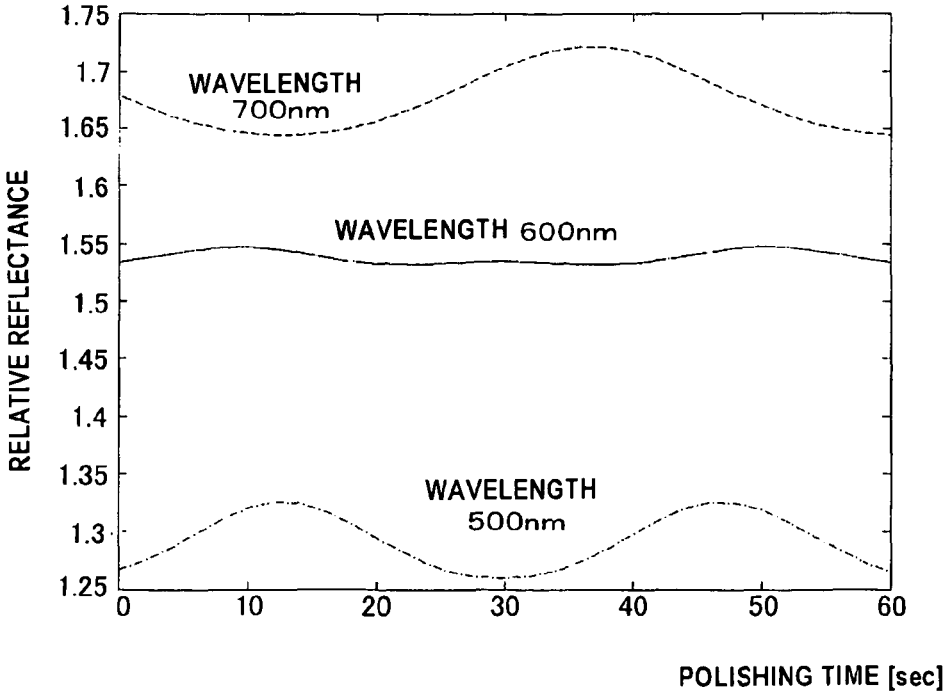
FIG. 27B is a graph showing the relative reflectances that change with a polishing time.

The normalized relative reflectance is given by dividing the relative reflectance by the average of the relative reflectances at the corresponding wavelength. Therefore, the positions (times) of the local maximum points and the local minimum points of the normalized relative reflectances as viewed along the temporal axis agree with the positions (times) of the local maximum points and the local minimum points of the relative reflectances. FIG. 27B is a graph showing the relative reflectances that change with the polishing time. As can be seen from FIG. 27A and FIG. 27B, the local maximum points and the local minimum points of the relative reflectances shown in FIG. 27A appear at times that approximately correspond to the appearance times of the local maximum points and the local minimum points in FIG. 27B.

Figure 28A:
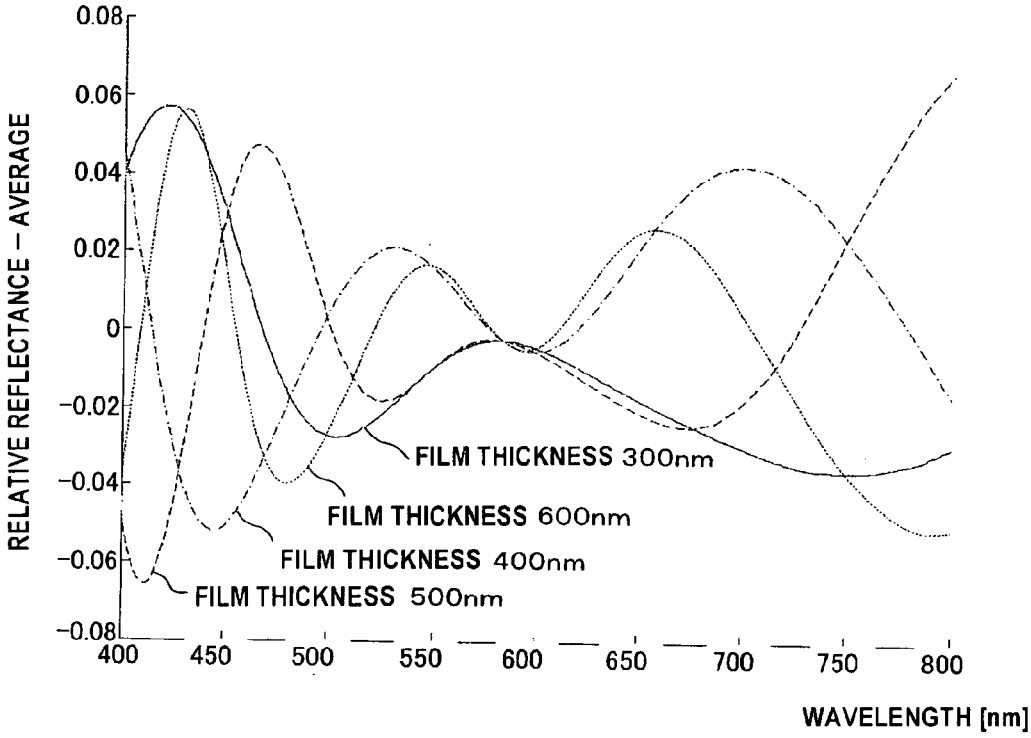
FIG. 28A is a diagram showing spectral data obtained by subtracting an average of relative reflectances from each relative reflectance at each time.
Figure 28B:
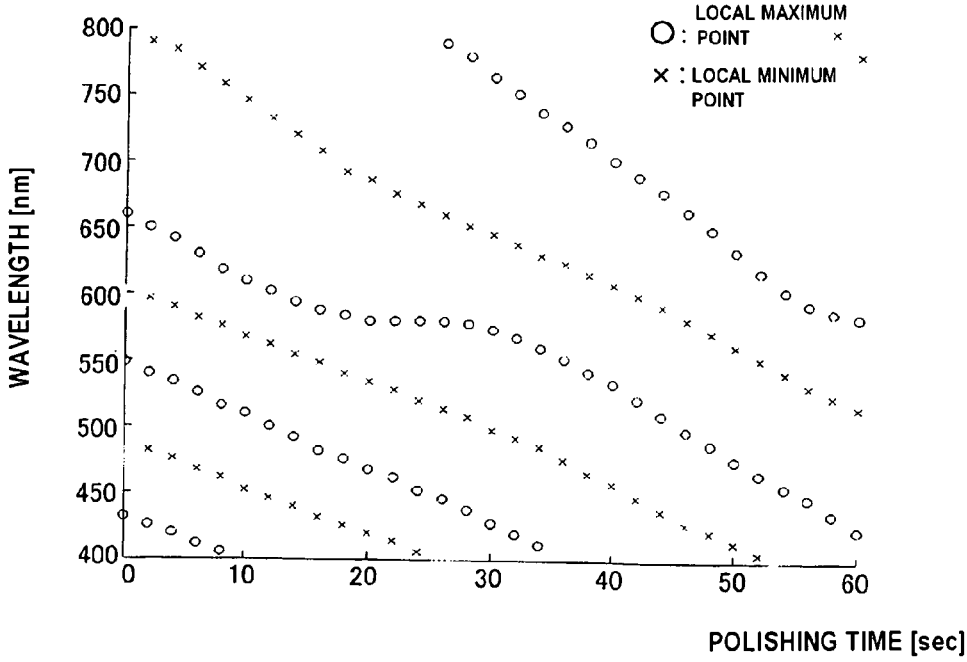
FIG. 28B is a distribution diagram of the local maximum points and the local minimum points produced using the spectral data shown in FIG. 28A.

Spectral data and a distribution diagram of the local maximum points and the local minimum points may be produced by subtracting the average of the relative reflectances at each wavelength from each relative reflectance at the corresponding wavelength calculated at each point of time. In this case also, the spectral data and distribution diagram, which are similar to those in the case of the normalized relative reflectances, can be obtained. FIG. 28A is a diagram showing the spectral data obtained by subtracting the average of the relative reflectances from relative reflectance at each time, and FIG. 28B is a distribution diagram of the local maximum points and the local minimum points produced using the spectral data shown in FIG. 28A. As can be seen from FIG. 28A and FIG. 28B, the spectral data and distribution diagram obtained are similar to those in FIG. 27A and FIG. 27B.

Figure 29A:
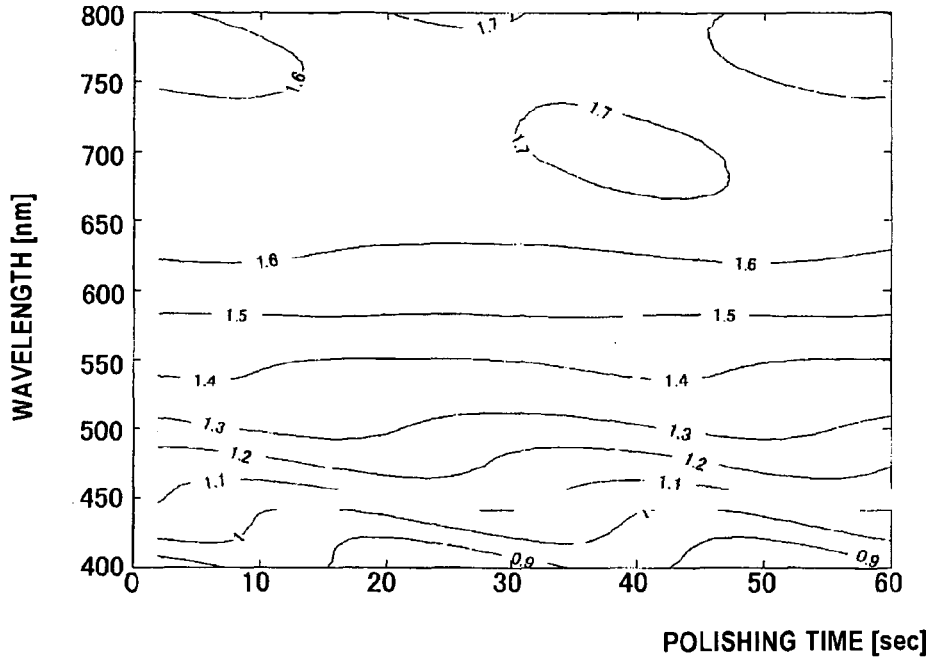
FIG. 29A is a contour map of the relative reflectances corresponding to FIG. 25A.
Figure 29B:
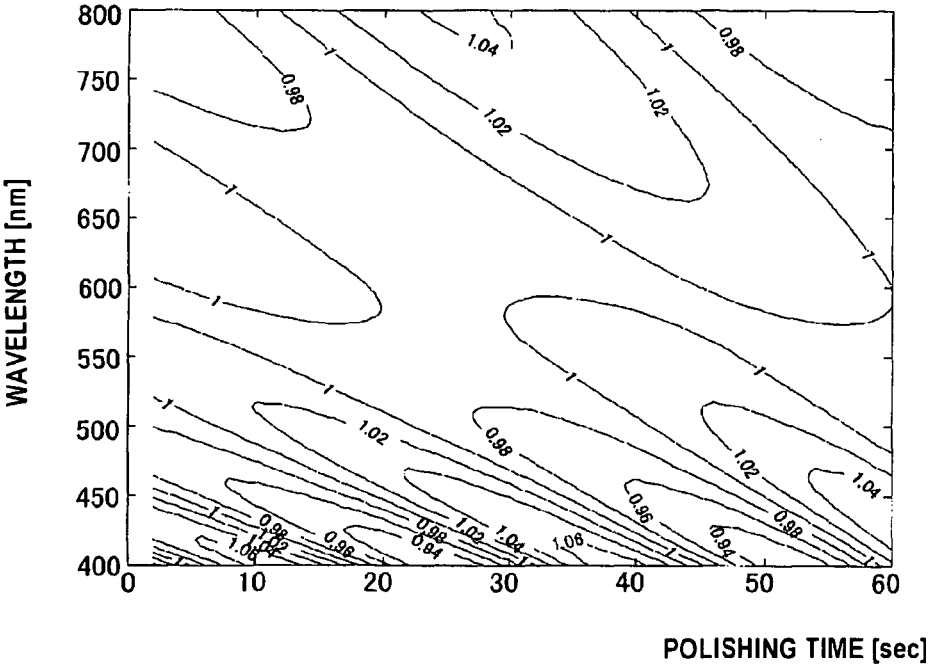
FIG. 29B is a contour map of the normalized relative reflectances corresponding to FIG. 26.

FIG. 29A is a contour map of the relative reflectances corresponding to FIG. 25A, and FIG. 29B is a contour map of the normalized relative reflectances corresponding to FIG. 26. It can be seen from FIG. 29B that the normalized relative reflectances in its entirety show a downward trend with the elapse of the polishing time.

Figure 30:
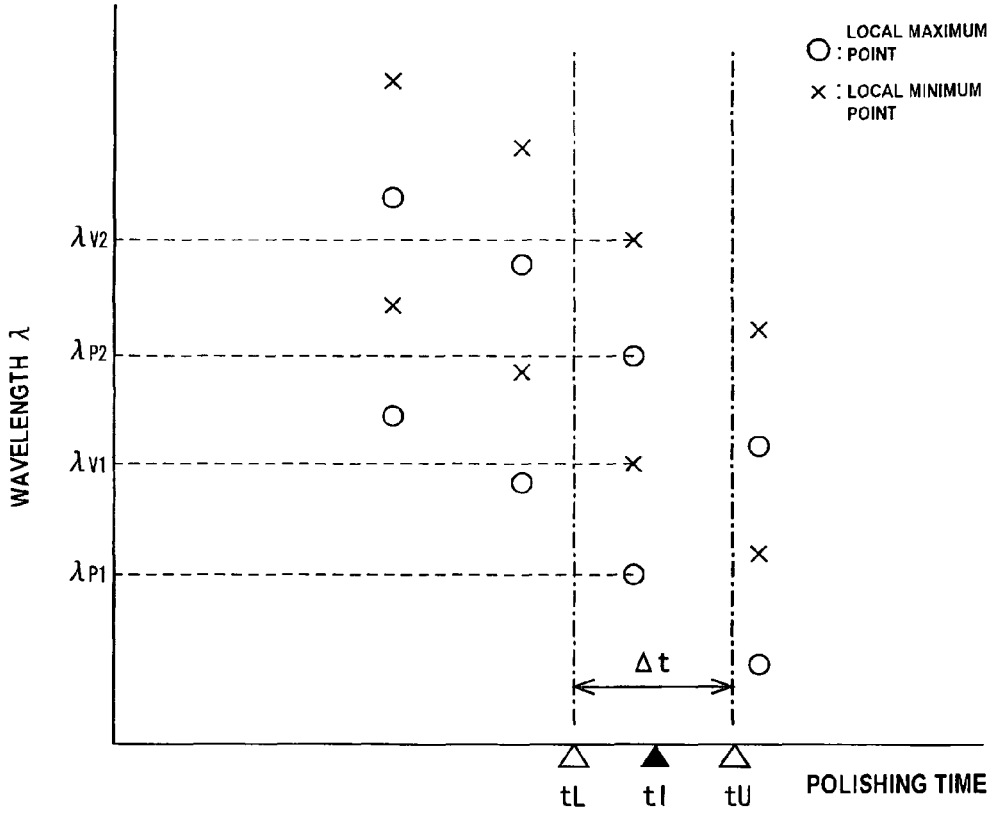
FIG. 30 is a diagram illustrating a method of selecting two wavelengths using the distribution diagram of the local maximum points and the local minimum points.

The method of selecting two wavelengths using the distribution diagram of the local maximum points and the local minimum points will now be described with reference to FIG. 30. In FIG. 30, a symbol tI represents a target time of the polishing end point detection (which will be hereinafter referred to as a detection target time). The wavelengths to be selected are such that a local maximum point or a local minimum point appears within a predetermined time range centering on the detection target time tI. The detection target time tI can be determined by polishing a sample substrate having the same structure as the substrate to be polished, measuring a thickness of a film after polishing (preferably together with a thickness of the film before polishing), and determining a time when the target film thickness is reached.

Next, a detection-time lower limit tL and a detection-time upper limit tU are established with respect to the detection target time tI. The detection-time lower limit tL and the detection-time upper limit tU define a time range Δt in which the detection of the local maximum point or the local minimum point of the characteristic value is permitted in the polishing end point detection process. In addition, the detection-time lower limit tL and the detection-time upper limit tU also define a search range of the local maximum points and the local minimum points of the relative reflectances. Specifically, all of the local maximum points and the local minimum points existing in the time range Δt are searched, and wavelengths corresponding to these local maximum points and local minimum points are selected as candidates. Subsequently, combinations of the wavelengths selected are created. The number of combinations of the wavelengths to be created depends on the number of wavelengths selected as candidates.

In the case where two wavelengths are to be selected finally, combinations of two wavelengths are generated using the plural wavelengths selected as candidates. For example, in FIG. 30, wavelengths $\lambda_{P1}$, $\lambda_{P2}$, $\lambda_{V1}$, $\lambda_{V2}$ are selected as candidates. Therefore, the combinations of two wavelengths generated include [$\lambda_{P1}$, $\lambda_{V1}$], [$\lambda_{P1}$, $\lambda_{V2}$], [$\lambda_{P2}$, $\lambda_{V1}$], and [$\lambda_{P2}$, $\lambda_{V2}$].

The above-described distribution diagram of the local maximum points and local minimum points is a diagram showing relationship between the wavelengths of the light and the local maximum points and local minimum points distributed in accordance with the polishing time. Therefore, searching for the local maximum points and local minimum points that appear within the predetermined time range with its center on the known detection target time makes it easy to select the wavelengths corresponding to those local maximum points and local minimum points. This selection of the wavelengths of the light may be conducted by an operating person or the monitoring unit 15 or other computer. While this example describes the method of selecting two wavelengths, three or more wavelengths can be selected using the same method.

Figure 31:
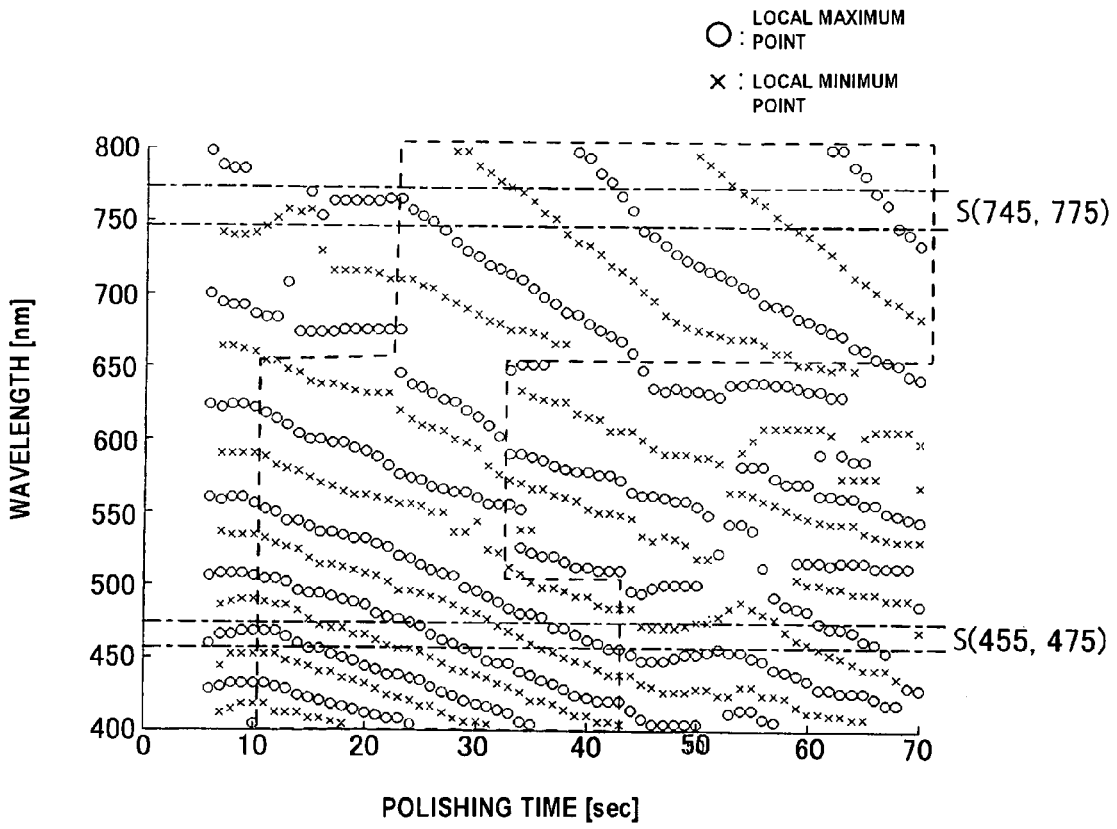
FIG. 31 is a distribution diagram of the local maximum points and the local minimum points produced based on spectral data obtained by polishing a substrate having interconnect patterns.

FIG. 31 is a distribution diagram of the local maximum points and the local minimum points produced based on spectral data obtained by polishing a substrate having interconnect patterns formed thereon. As shown in FIG. 31, the local maximum points and the local minimum points shift with the polishing time in a complicated manner when polishing the pattern substrate. However, even in this case, in a region surrounded by a dotted line shown in FIG. 31, the local maximum points and the local minimum points shift relatively regularly. In such a region, a characteristic value obtained is expected to have a good signal-to-noise ratio (i.e., describe a smooth sine wave with a large amplitude).

Figure 32:
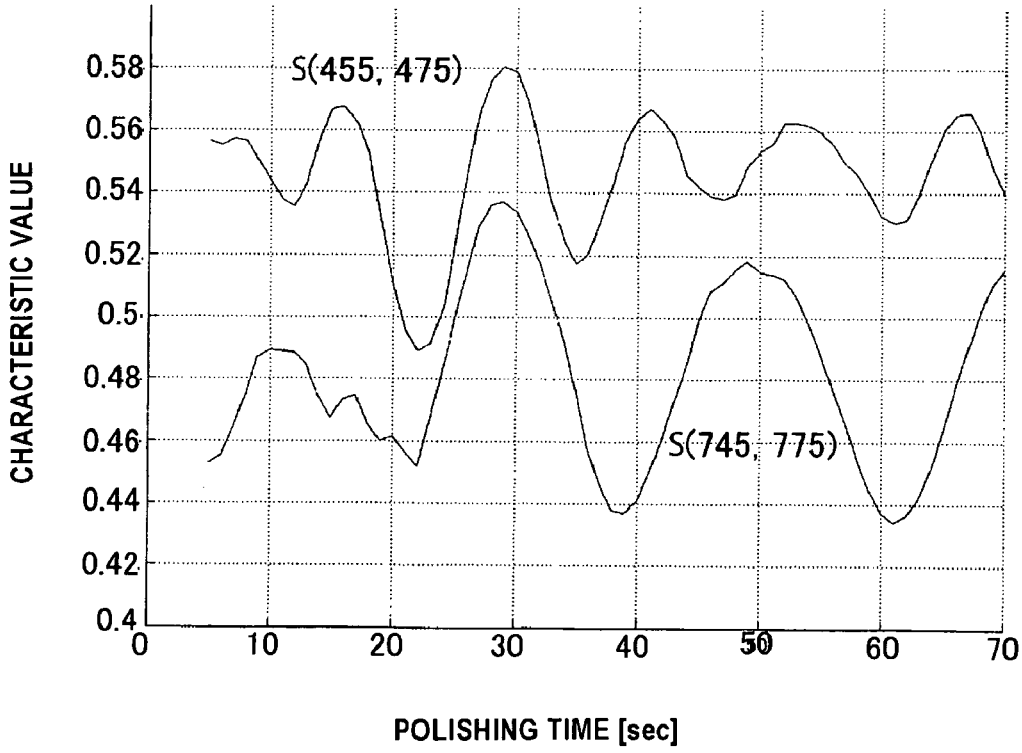
FIG. 32 is a diagram showing variations in characteristic values calculated using pairs of the wavelengths selected based on the distribution diagram shown in FIG. 31.

FIG. 32 is a graph showing change in characteristic values calculated using pairs of the wavelengths selected based on the distribution diagram shown in FIG. 31. In this example, a combination of two wavelengths [745 nm, 775 nm] and a combination of two wavelengths [455 nm, 475 nm] are selected, and two characteristic values calculated from these combinations are shown in FIG. 32. As shown in FIG. 31 and FIG. 32, the characteristic value corresponding to the region surrounded by the dotted line in FIG. 31 describes a smooth sine wave with a large amplitude. Therefore, optimum wavelengths for the target time of the polishing end point detection can be selected based on the distribution diagram shown in FIG. 31.

Figure 33:
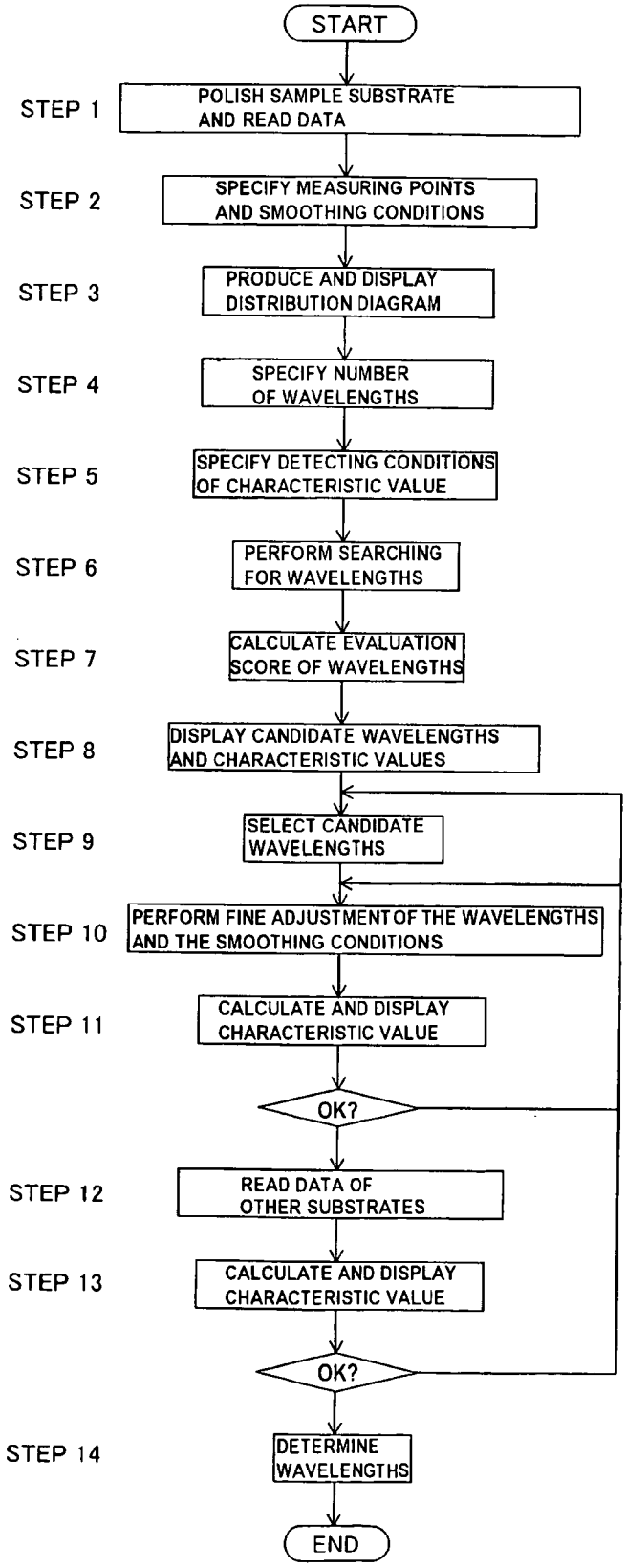
FIG. 33 is a flowchart showing an example of a method of selecting wavelengths of light as parameters of the characteristic value based on the distribution diagram of the local maximum points and the local minimum points with use of a software (computer program)

Next, an example of a method of selecting wavelengths of the light as a parameter of the characteristic value based on the above-described distribution diagram of the local maximum points and local minimum points, using a software (i.e., a computer program), will be described with reference to FIG. 33.

In step 1, a sample substrate having the same structure (identical interconnect patterns, identical films) as a substrate to be polished is polished, and the monitoring unit 15 reads spectral data measured during polishing of the sample substrate. Polishing of the sample substrate is performed under the same conditions (e.g., the same rotational speed of the polishing table 20, the same type of slurry) as those for the substrate as an object to be polished. It is preferable to polish the sample substrate until a polishing time thereof goes slightly over the target time of the polishing end point detection.

In step 2, the measuring points for monitoring the film thickness are specified. As shown in FIG. 21, measuring of the reflection intensities is performed at the plural measuring points each time the polishing table 20 makes one revolution. Thus, in this step, one or more measuring points are selected from the preset plural measuring points. For example, five measuring points in symmetrical arrangement with respect to the center of the sample substrate are designated. This designation of the measuring points is performed by inputting the number of measuring points into the monitoring unit 15 via a non-illustrate input device. The measuring unit 15 calculates an average of measurements at the designated measuring points. This average is an average of the reflection intensities (or the relative reflectances) which are obtained each time the polishing table 20 makes one revolution. Further, in this step 2, smoothing of average values as time-series data is performed using a moving average method. A term of the moving average (i.e., the number of time-series data to be averaged) is inputted into the monitoring unit 15 in advance, and the monitoring unit 15 calculates the average of the time-series data obtained during the specified time.

In step 3, the monitoring unit 15 creates the above-described distribution diagram of the local maximum points and the local minimum points using the spectral data obtained during polishing of the sample substrate. The relative reflectance at each wavelength that constitutes the spectral data is a relative reflectance averaged according to the smoothing conditions defined in step 2. The resultant distribution diagram is displayed on a display device of the monitoring unit 15 or other display device. If a desired distribution diagram cannot be obtained, the conditions in the step 2 (e.g., the number of measuring points or the term of the moving average) may be changed and then the step 2 may be conducted again.

In step 4, the number of wavelengths of the light to be used in the calculation of the characteristic value is specified. For example, when two wavelengths are to be selected for the calculation of the characteristic value, a number "2" is inputted into the monitoring unit 15. This number of wavelengths corresponds to K in the equation (5).

In step 5, conditions for detecting the local maximum point or local minimum point of the temporal variation in the characteristic value are specified. Specifically, a data region (i.e., time) that is not used in the wavelength selection is specified. This data region is not used in calculation of an evaluation score in step 7 which will be described later. This is because the characteristic value usually does not describe a smooth sine wave at an initial stage of the polishing process. Further, in this step 5, the above-described detection target time tI, detection-time lower limit tL, and detection-time upper limit tU (see FIG. 30), which define the permissible range of detecting the local maximum point or local minimum point of the characteristic value, are specified. The detection-time lower limit tL and the detection-time upper limit tU are also used in specifying the search range of the local maximum points and the local minimum points of the relative reflectances, as described above In step 6, the monitoring unit 15 performs searching for the wavelengths. In this step, the candidates of the wavelengths are searched based on the distribution diagram of the local maximum points and the local minimum points created in step 3, the detection target time tI, the detection-time lower limit tL, and the detection-time upper limit tU specified in step 5. Further, combinations of wavelengths (for example, combinations of two wavelengths, or combinations of three wavelengths) are generated in this step. Searching for the wavelengths and generating the combinations of the wavelengths are performed according to the procedures as discussed with reference to FIG. 30. There may be cases where the local maximum points and the local minimum points on the distribution diagram do not strictly correspond to the local maximum points and the local minimum points of the relative reflectances as viewed along the temporal axis. In view of such cases, wavelengths, which are near the wavelengths searched according to the procedures in FIG. 30, may be used in generating the combinations of the wavelengths. The monitoring unit 15 calculates a corresponding characteristic value from the combination of wavelengths based on the measuring points and the smoothing conditions specified in step 2, and judges whether or not the calculated characteristic value shows a local maximum point or local minimum point within the above-described permissible time range.

In step 7, evaluation scores are calculated with respect to the respective combinations of the selected wavelengths, based a wavelength-evaluation formula that is stored in advance in the monitoring unit 15. The evaluation score is an index for evaluating each combination of the selected wavelengths from the viewpoint of performing accurate detection of the polishing end point. The wavelength-evaluation formula includes several evaluation factors, such as a time difference between the target detection time and a time when the local maximum point or local minimum point of the characteristic value appears, amplitude of the characteristic value, stability of the amplitude of the characteristic value, stability of cycle of the characteristic value, and smoothness of a waveform described by the characteristic value. The higher the calculated evaluation score is, the more accurate the polishing end point detection is expected to be.

Specifically, the wavelength-evaluation formula is expressed by $$J = \Sigma wi \cdot Ji \tag{14}$$

$$= w1 \cdot J1 + w2 \cdot J2 + w3 \cdot J3 + w4 \cdot J4 + w5 \cdot J5$$

where:

w1 and J1 are a weighting factor and an evaluation score with respect to a time when the local maximum point or local minimum point of the characteristic value appears;

w2 and J2 are a weighting factor and an evaluation score with respect to amplitude of the characteristic value;

w3 and J3 are a weighting factor and an evaluation score with respect to stability of the amplitude of the characteristic value;

w4 and J4 are a weighting factor and an evaluation score with respect to stability of cycle of the characteristic value; and w5 and J5 are a weighting factor and an evaluation score with respect to smoothness of a waveform described by the characteristic value.

The above-described weighting factors w1, w2, w3, w4, and w5 are predetermined values. The evaluation scores J1, J2, J3, J4, and J5 are variables that vary depending on the characteristic value obtained. For example, where the local maximum point or local minimum point of the characteristic value appears at a time t, J1 is expressed as follows:

If $t \leqq tI$, $$J1=(t-tL)/(tI-tL) \tag{15}$$

If $t>tI$, $$J1=(tU-t)/(tU-tI) \tag{16}$$

Figure 34:
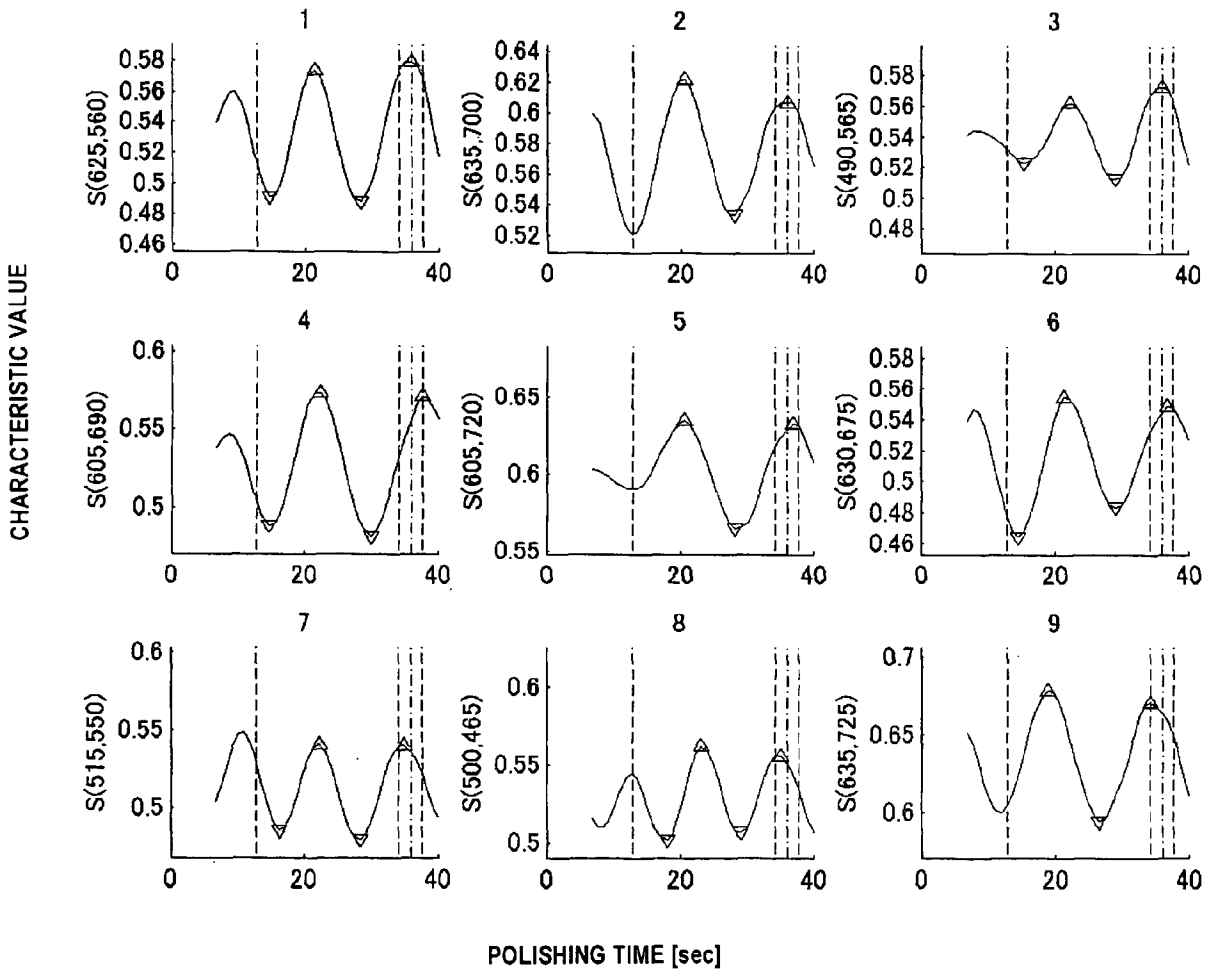
FIG. 34 is a diagram showing pairs of wavelengths and graphs described by the corresponding characteristic values displayed in order of increasing an evaluation score.

In step 8, the combination of wavelengths and graphs described by the corresponding characteristic values are displayed on the display device in order of increasing the calculated evaluation score. FIG. 34 is a diagram showing the combinations of wavelengths and the graphs described by the corresponding characteristic values displayed in order of increasing the evaluation score.

In step 9, an operating person designates as the candidate the combination of wavelengths that attains the highest evaluation score, with reference to the evaluation scores of the respective combinations of wavelengths displayed in step 8. If some problems arise in subsequent steps, another combination of wavelengths is designated as the candidate. In this case also, the next combination of wavelengths is designated basically according to the order of increasing the evaluation score.

The combination of wavelengths designated in step 9 can be determined to be the final combination of wavelengths to be selected. However, in order to perform more accurate detection of the polishing end point, it is preferable to make fine adjustment of the characteristic value and inspect repeatability of the characteristic value, as will be described below.

At step 10, conditions for the fine adjustment of the characteristic value are specified. The fine adjustment of the characteristic value is performed by slightly changing the wavelengths selected in step 9 and the smoothing conditions determined in step 2.

In step 11, the monitoring unit 15 calculates characteristic value based on the newly-obtained wavelengths and smoothing conditions resulting from the fine adjustment in step 10, and displays a temporal variation in the newly-obtained characteristic value. If a graph on the display shows a good result, the next step is performed. Otherwise, the procedure goes back to step 9 or step 10.

If spectral data on a substrate identical to the substrate to be polished are available in addition to those of the sample substrate, the monitoring unit 15 reads the data (step 12). Then, the monitoring unit 15 calculates the characteristic value using relative reflectances at the wavelengths obtained from the fine adjustment in step 10, and displays the graph of the characteristic value that varies with the polishing time (step 13). If the repeatability of the characteristic value is good, the wavelengths selected are determined to be the final wavelengths (step 14). If a good repeatability cannot be obtained, the procedure goes back to step 9 or step 10. The above-described processes to the step of the wavelength determination may be conducted by other computer using the spectral data obtained during polishing of the sample substrate, as well as the above-described procedures of creating the distribution diagram.

The polishing apparatus shown in FIG. 18 can be used in the present embodiment. Specifically, during polishing of the substrate W, the light-applying unit 11 applies the light to the substrate W, and the optical fiber 12 as the light-receiving unit receives the reflected light from the substrate W. During the application of the light, the hole 30 is filled with the water, whereby the space between the tip ends of the optical fibers 41 and 12 and the surface of the substrate W is filled with the water. The spectroscope 13 measures the intensity of the reflected light at each wavelength and produces the spectral data. The monitoring unit 15 calculates the characteristic value from relative reflectances (or reflection intensities) at the wavelengths that have been selected in advance according to the above-described method of selecting the wavelengths of the light. The monitoring unit 15 monitors the characteristic value that varies with the polishing time, and detects the polishing end point based on the local maximum point or local minimum point of the characteristic value. The polishing apparatus shown in FIG. 19 or FIG. 20 may be used in this embodiment.

Next, still another embodiment of the present invention will be described. In this embodiment also, the polishing monitoring apparatus shown in FIG. 8 and FIG. 21 is used. This polishing monitoring apparatus can also be used as a polishing end point detection apparatus. A substrate W as an object to be polished has a lower layer (e.g., a silicon layer or a SiN film) and a film (e.g., an insulating film, such as $SiO_2$, having a light-transmittable characteristic) formed on the underlying lower layer. The light-applying unit 11 and the light-receiving unit 12 are arranged so as to face a surface of the substrate W. During polishing of the substrate W, the polishing table 20 and the substrate W are rotated, as shown in FIG. 21, to provide relative movement between the polishing pad (not shown) on the polishing table 20 and the substrate W to thereby polish the surface of the substrate W.

The light-applying unit 11 applies the light in a direction substantially perpendicular to the surface of the substrate W, and the light-receiving unit 12 receives the reflected light from the substrate W. The light-applying unit 11 and the light-receiving unit 12 are moved across the substrate W each time the polishing table 20 makes one revolution. During the revolution, the light-applying unit 11 applies the light to plural measuring points including the center of the substrate W, and the light-receiving unit 12 receives the reflected light from the substrate W. The spectroscope 13 is coupled to the light-receiving unit 12. This spectroscope 13 measures intensity of the reflected light at each wavelength (i.e., measures reflection intensities at respective wavelengths). More specifically, the spectroscope 13 decomposes the reflected light according to the wavelength and measures the reflection intensity at each wavelength.

The monitoring unit 15 is coupled to the spectroscope 13. This monitoring unit 15 is configured to create a spectral profile (spectral waveform) from the reflection intensities measured by the spectroscope. The spectral profile is a profile indicating a relationship between the reflection intensity and the wavelength with respect to the film. In general, the reflection intensity, to be measured by the spectroscope 13, is affected not only by the film, but also by the underlying layer. Thus, in order to obtain the spectral profile depending only on the film, the monitoring unit 15 performs the following processes.

A reference spectral profile of a substrate with no film formed thereon (which will be hereinafter referred to as a reference substrate) is stored in the monitoring unit 15 in advance. A silicon wafer (bare wafer) is generally used as the reference substrate. The monitoring unit 15 divides the spectral profile of the substrate W (an object to be polished) by the reference spectral profile to determine relative reflectances. More specifically, the reflection intensity on the spectral profile of the substrate W is divided by the reflection intensity on the reference spectral profile, whereby the relative reflectances at respective wavelengths are obtained. The relative reflectance may be determined by subtracting the background intensity (which is a dark level obtained under conditions where no reflected light exists) from both the reflection intensity on the spectral profile of the substrate W and the reflection intensity on the reference spectral profile to determine an actual intensity and a reference intensity and then dividing the actual intensity by the reference intensity, as shown in the above-discussed equation (2).

By dividing the spectral profile by the reference spectral profile in this manner, an influence of individual differences between light sources or light-transmitting systems can be eliminated. Therefore, it can be said that the distribution of the relative reflectances according to the wavelength is a spectral profile which substantially depends on the film. The spectral profile created in this manner indicates the relationship between the reflection intensity and the wavelength with respect to the film.

Figure 35:
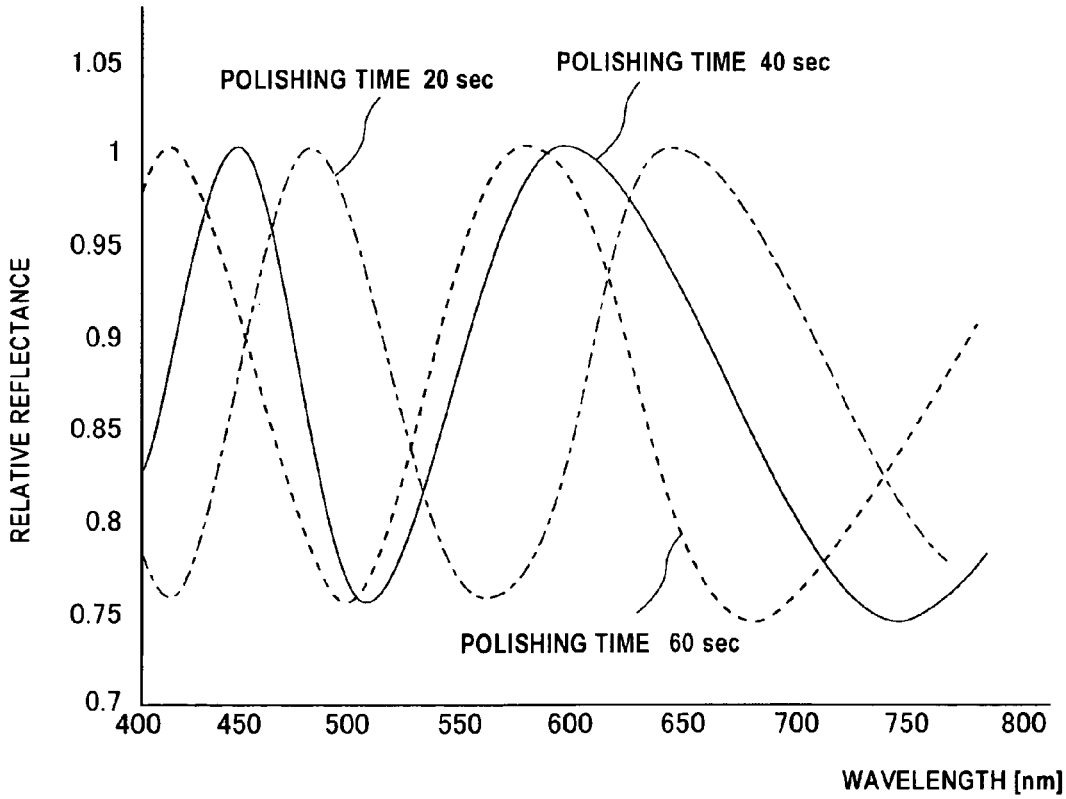
FIG. 35 is a diagram showing an example of a spectral profile when polishing an oxide film formed on a silicon wafer.

FIG. 35 is a diagram showing an example of a spectral profile when polishing an oxide film formed on a silicon wafer. In the graph shown in FIG. 35, a horizontal axis indicates wavelength of the light, and a vertical axis indicates relative reflectance. As shown in FIG. 35, the positions of the local maximum points and the local minimum points shift with the increase in the polishing time (i.e., the decrease in the film thickness).

The spectral profile is obtained each time the polishing table 20 makes one revolution. The monitoring unit 15 monitors the local maximum points and the local minimum points of the reflection intensities (relative reflectances) at the respective wavelengths obtained from the spectral profile, and detects the polishing end point based on a temporal variation in the local maximum points and/or the local minimum points as will be described later. A general-purpose computer or a dedicated computer can be used as the monitoring unit 15.

Figure 36:
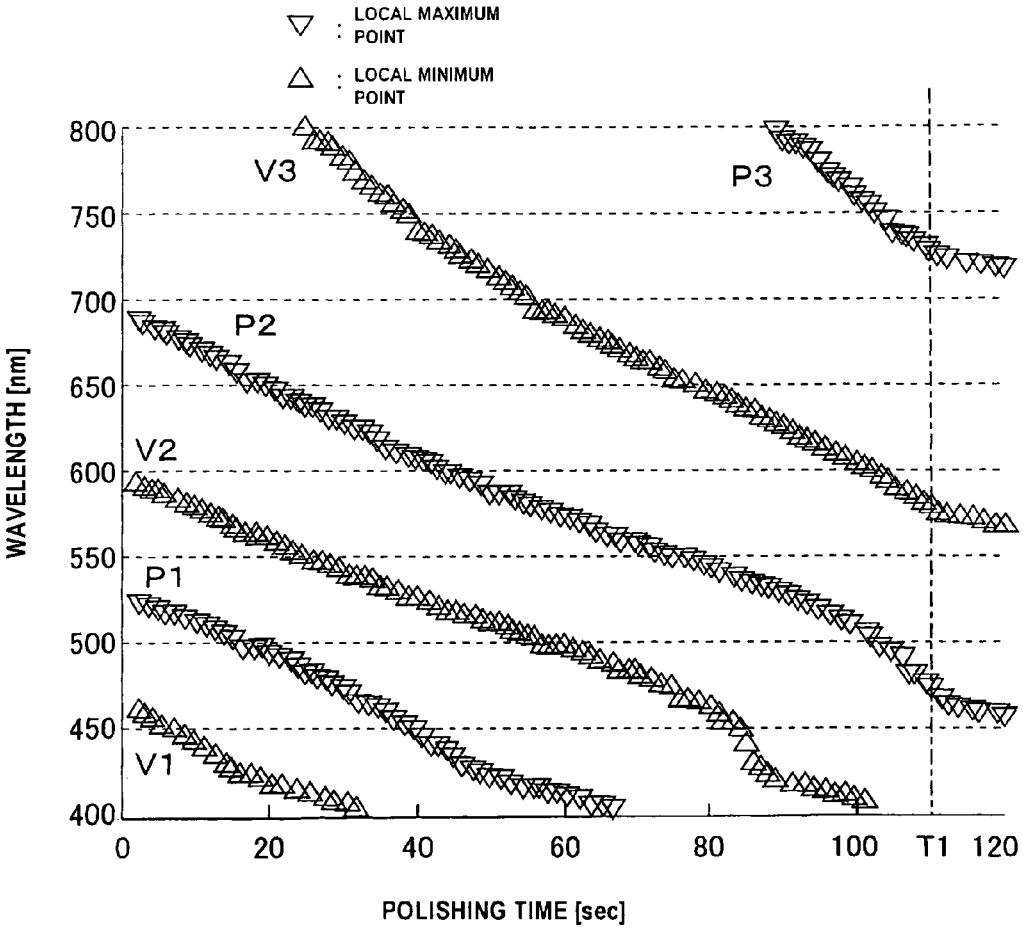
FIG. 36 is a distribution diagram of the local maximum points and the local minimum points.

As described above, the wavelengths indicating the local maximum points and the local minimum points of the reflection intensities (or the relative reflectances) vary according to the change in the film thickness (i.e., the polishing time). Thus, the monitoring unit 15 extracts the local maximum points and the local minimum points of the reflection intensities from the spectral profile during polishing of the substrate, and monitors the change in the local maximum points and the local minimum points. More specifically, the monitoring unit 15 determines the wavelengths of the light at which the local maximum points and the local minimum points of the reflection intensities appear, and identifies a polishing time when the reflection intensities of these extremal points are measured. The monitoring unit 15 stores the determined wavelengths and the corresponding polishing time in a storage device (not shown) incorporated in the monitoring unit 15. Further, the monitoring unit 15 plots coordinates, consisting of each wavelength stored and the corresponding polishing time, onto a coordinate system having a vertical axis indicating wavelength and a horizontal axis indicating polishing time, thereby creating a diagram as shown in FIG. 36. Hereinafter, this diagram will be referred to as a distribution diagram of the local maximum points and the local minimum points, or simply as a distribution diagram. The spectral data, obtained by the monitoring unit 15, may be transmitted to other computer, and creating of the distribution diagram may be performed by the computer. The spectral profile may contain components that do not change during polishing due to the influence of the underlying layer and components that shift toward shorter wavelengths from longer wavelengths with the progress of polishing (i.e., with the decrease in thickness of the film). In such a case, a normalized spectral profile may be created by dividing reflection intensity at each point of time during polishing by an average of the reflection intensities over the polishing process at each wavelength. The distribution diagram may be produced based on the normalized spectral profile. The distribution diagram shown in FIG. 36 is produced in this manner.

The spectral profile, obtained by the monitoring unit 15, may be transmitted to other computer, and creating of the distribution diagram may be performed by this computer. In this embodiment, the spectral profile is obtained each time the polishing table 20 makes one revolution. Therefore, plural spectral profiles are obtained at different times during polishing. The local maximum points and the local minimum points of the reflection intensities shown in these spectral profiles are plotted onto the coordinate system, whereby the distribution diagram as shown in FIG. 36 is obtained. The spectral profile may be obtained each time the polishing table 20 makes several revolutions. Since the polishing table 20 rotates at a constant speed during polishing, the spectral profiles are obtained at equal time intervals.

In the distribution diagram shown in FIG. 36, a symbol "∇" represents coordinates of a local maximum point, and a symbol "Δ" represents coordinates of a local minimum point. As can be seen from FIG. 36, the coordinates indicating the local maximum points and the local minimum points show a downward trend with the polishing time. Therefore, the distribution diagram in FIG. 36 shows a visually-perceptible downward trend of the film thickness. Replacing the film thickness x in the equations (6) and (7) with the polishing time, a straight line connecting the local maximum points and a straight line connecting the local minimum points shown in FIG. 36 can be expressed by the equations (6) and (7), respectively.

In the distribution diagram shown in FIG. 36, a polishing time T1 indicates a time when an upper film is removed and an underlying lower layer is exposed, i.e., a time when a polishing rate is lowered. When the polishing rate is lowered, the film thickness does not change greatly. As a result, the downward trend of the local maximum points and the local minimum points becomes gentle. The monitoring unit 15 monitors the local maximum points and/or the local minimum points during polishing, and determines a polishing end point by detecting a time when the downward trend of the local maximum points and/or the local minimum points becomes gentle.

As shown in FIG. 36, the local maximum points and the local minimum points form plural clusters. A cluster in this specification means an aggregate or a group of continuous extremal points. In FIG. 36, symbols P1, P2, . . . , Pi represent clusters each composed of continuous local maximum points, and symbols V1, V2, . . . , Vi represent clusters each composed of continuous local minimum points. The monitoring unit 15 monitors the local maximum points and/or the local minimum points that belong to at least one predetermined cluster.

The change in the downward trend is monitored as follows. The monitoring unit 15 calculates a slope of a straight line connecting latest two extremal points belonging to a predetermined cluster each time the extremal point is plotted on the coordinate system. This slope indicates an amount of relative change in the extremal point between two spectral profiles obtained at different times. As can be seen from FIG. 36, this amount of relative change is an amount of decrease in the wavelength indicating the extremal point. In this embodiment, since a new extremal point is added to the cluster each time the polishing table 20 makes one revolution, the monitoring unit 15 determines a slope of a straight line connecting the latest two of the extremal points each time the polishing table 20 makes one revolution. The extremal points may be plotted on the coordinate system each time the polishing table 20 makes a predetermined number of revolutions (e.g., two or three revolutions).

The clusters P1, P2, . . . , Pi, each composed of local maximum points, are groups of local maximum points specified by the parameter m (natural number) in the above-described equation (6). Similarly, the clusters V1, V2, . . . Vi, each composed of local minimum points, are groups of local minimum points specified by the parameter m in the above-described equation (7). The monitoring unit 15 calculates a difference in the wavelength between the extremal points belonging to the cluster specified by the parameter m and detects the polishing end point based on a change in the difference.

When the polishing rate is lowered as a result of removal of the upper film, the slope of the straight line becomes small. Therefore, the polishing end point can be detected by monitoring the slope of the straight line. Thus, the monitoring unit 15 judges that the polishing rate is lowered, i.e., the polishing end point is reached, when the slope of the straight line reaches a predetermined threshold.

Figure 37:
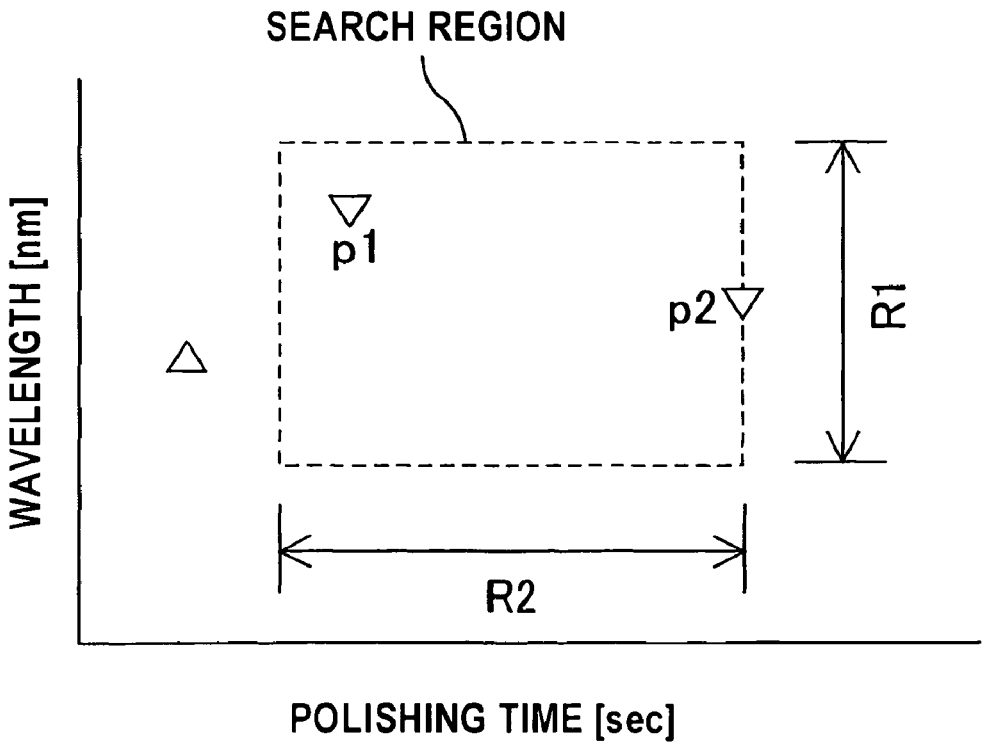
FIG. 37 is a diagram showing plural extremal points plotted on a coordinate system.

As can be seen from FIG. 36, multiple clusters exist on the coordinate system having axes indicating the wavelength and the polishing time. A single extremal point (a local maximum point or a local minimum point) plotted on the coordinate system belongs to any one of these clusters. Here, a method of determining which cluster the extremal point belongs to will be described with reference to FIG. 37. FIG. 37 is a diagram showing plural extremal points plotted on the coordinate system. As shown in FIG. 37, when a new local maximum point p2 is plotted, the monitoring unit 15 searches for other local maximum point within a predetermined search region on the coordinate system. This search region is defined by a predetermined wavelength range R1 with its center on a wavelength of the local maximum point p2 and a predetermined time range R2. For example, the wavelength of the local maximum point p2 plus 20 nm may be an upper limit of the wavelength range R1, and the wavelength of the local maximum point p2 minus 20 nm may be a lower limit of the wavelength range R1. The time range R2 starts from the polishing time of the local maximum point p2 back to a predetermined past time.

In the example shown in FIG. 37, other local maximum point p1 exists in the search region. In this case, the monitoring unit 15 judges that the local maximum point p2 belongs to the cluster of the local maximum point p1, and the monitoring unit 15 associates the local maximum point p2 with the existing cluster to which the local maximum point p1 belongs. On the other hand, when no other local maximum point exists in the search region, the monitoring unit 15 judges that the local maximum point p2 belongs to a new cluster. The monitoring unit 15 identifies the local maximum points and the local minimum points as different categories, and sorts the local maximum points and the local minimum points separately.

Figure 38:
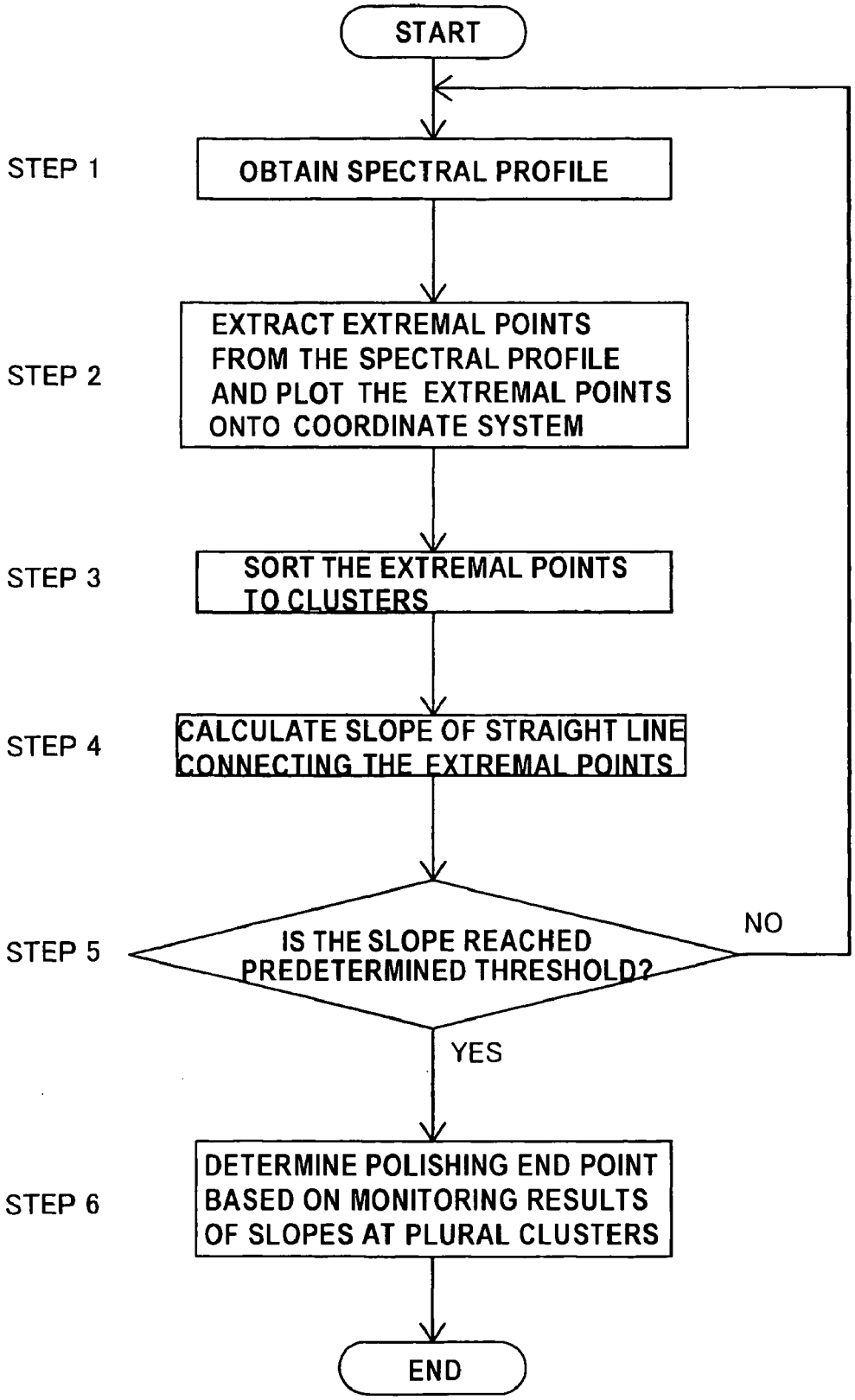
FIG. 38 is a flowchart illustrating an example of a method of detecting a polishing end point using plural clusters.

The cluster to be monitored for the polishing end point detection is selected prior to polishing. A single cluster or plural clusters may be selected. When plural clusters are selected, the polishing end point is detected based on the change in the downward trend of the extremal points belonging to at least one of the plural clusters. FIG. 38 is a flowchart illustrating an example of a method of detecting the polishing end point using plural clusters. In step 1, the spectral profile is obtained from the reflected light from the substrate during polishing, as described above. In step 2, the extremal points are extracted from the spectral profile and plotted onto the coordinate system.

In step 3, each of the plotted extremal points is sorted into one of the clusters or a new cluster. In step 4, the slopes, each indicating the downward trend of the extremal points (i.e., the amount of relative change in the extremal point), are calculated from the extremal points in preselected plural clusters. Each slope is a slope of a straight line connecting the latest two extremal points, as described above. In step 5, the monitoring unit 15 judges whether or not the slopes have reached at least one predetermined threshold. The at least one threshold may be a single threshold, or may be plural thresholds established for the respective clusters. In step 6, the polishing end point is determined based on monitoring results of the slopes at the plural clusters. For example, when the slopes at three out of five clusters have reached the at least one threshold, the monitoring unit 15 judges that the polishing end point is reached. Alternatively, the monitoring unit 15 may judge that the polishing end point is reached when the slopes in all of the clusters have reached the at least one threshold.

Figure 39:
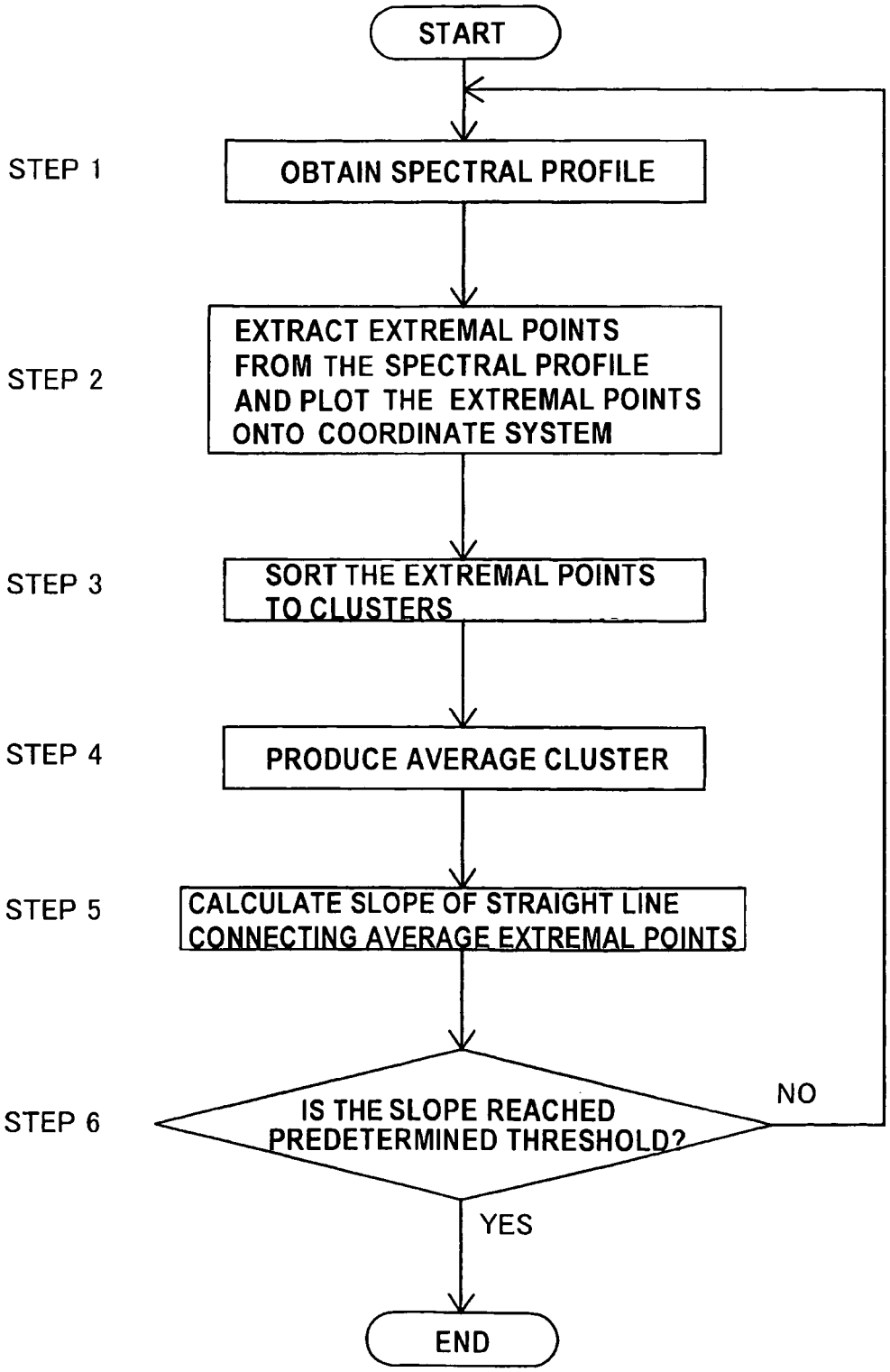
FIG. 39 is a flowchart illustrating an example of a method of detecting a polishing end point using an average cluster.

An average cluster may be produced from the plural clusters, and a downward trend of extremal points in the average cluster may be monitored. FIG. 39 is a flowchart illustrating an example of a method of detecting a polishing end point using the average cluster. In step 1, the spectral profile is obtained from the reflected light from the substrate during polishing, as described above. In step 2, the extremal points are extracted from the spectral profile and plotted onto the coordinate system. In step 3, each of the plotted extremal points is classified into one of the clusters or a new cluster.

Figure 40:
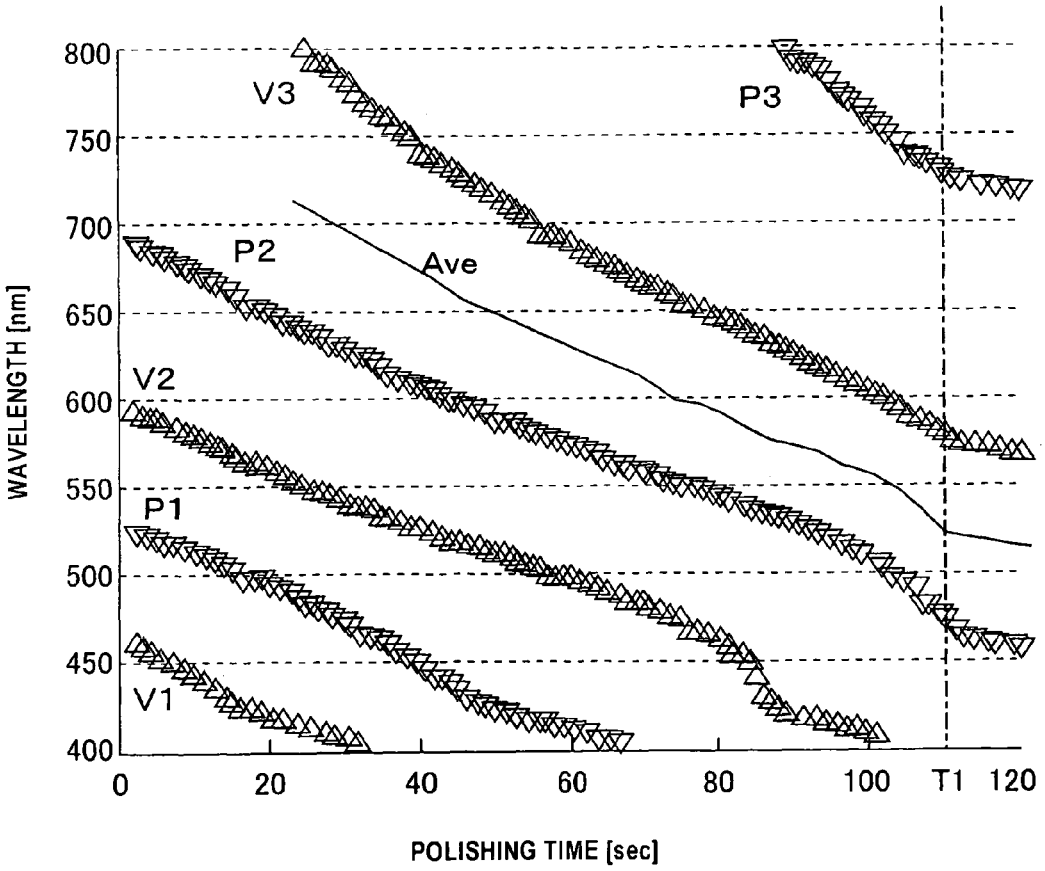
FIG. 40 is a distribution diagram showing the average cluster.

In step 4, the average cluster is created from the extremal points in preselected plural clusters. Specifically, the average cluster is created by producing an average extremal point as an average of the wavelengths of the local maximum points and the local minimum points extracted from the same spectral profile. A symbol "Ave" shown in FIG. 40 represents an average cluster constituted by average extremal points calculated from the local maximum points and the local minimum points belonging to the cluster P2 and the cluster V3. In step 5, a slope, indicating the downward trend of the average extremal points (i.e., the amount of relative change in the extremal points), is calculated. In step 6, the monitoring unit 15 judges whether or not the slope has reached a predetermined threshold. In this example, a time when the slope has reached the predetermined threshold is determined to be the polishing end point.

In the method described in FIG. 38 and FIG. 39, there may be cases where no extremal point exists for calculating the slope of the straight line connecting the latest extremal points. In such cases, interpolation may be used to interpolate an appropriate extremal point. Examples of the interpolation include linear interpolation and spline interpolation. Some extremal points may show an upward trend due to the influence of the underlying layer or noise. In such cases, it is preferable to ignore such extremal points showing the upward trend. In the method shown in FIG. 39, it is possible to obtain an average extremal point of plural extremal points including those extremal points showing the upward trend.

The cluster to be monitored during polishing is selected based on a polishing result of a dummy substrate having the same structure (i.e., the same films and the same multilayer structure) as a substrate to be polished. During polishing of the dummy substrate, a spectral profile is obtained from reflected light from the dummy substrate during polishing, as described above. Local maximum points and local minimum points are extracted from the spectral profile and plotted onto the coordinate system having the vertical axis indicating wavelength and the horizontal axis indicating polishing time. The local maximum points and the local minimum points, plotted on the coordinate system, form plural clusters. At least one cluster suitable for use in the polishing end point detection is selected among these clusters. The cluster to be selected is such that the downward trend of the extremal points changes clearly at the polishing end point. It is preferable to polish several substrates, which are the object to be polished, and check repeatability of the appearance of the clusters.

The threshold (slope) for use in the polishing end point detection is also selected based on the polishing result of the dummy substrate. During polishing of the dummy substrate, a polishing rate is kept substantially constant. A reference polishing rate (reference slope) is determined from a polishing rate at an initial stage of polishing of the dummy substrate or an average polishing rate. The reference polishing rate is multiplied by 1/n and the resulting value is set to the threshold. It is preferable that the value n be two or more.

In this embodiment, the local maximum points and the local minimum points are extracted from the reflection intensities (relative reflectances). Alternatively, a spectral profile, which is composed of characteristic value (spectral index), may be newly created based on the relative reflectances in the same manner as the equation (3), and local maximum points and local minimum points may be extracted from the newly-created spectral profile. For example, the characteristic value $S(\lambda)$ can be calculated by using $$S(\lambda)=R(\lambda)/(R(\lambda)+R(\lambda+\Delta\lambda)) \quad (17)$$

where $\Delta\lambda$ is 50 nm.

In this case also, when the polishing rate is lowered, the downward trend of the extremal points becomes gentle. Therefore, removal of the upper film (i.e., the polishing end point) can be detected based on a time when a slope indicating the change in the extremal points reaches a predetermined threshold.

Figure 41:
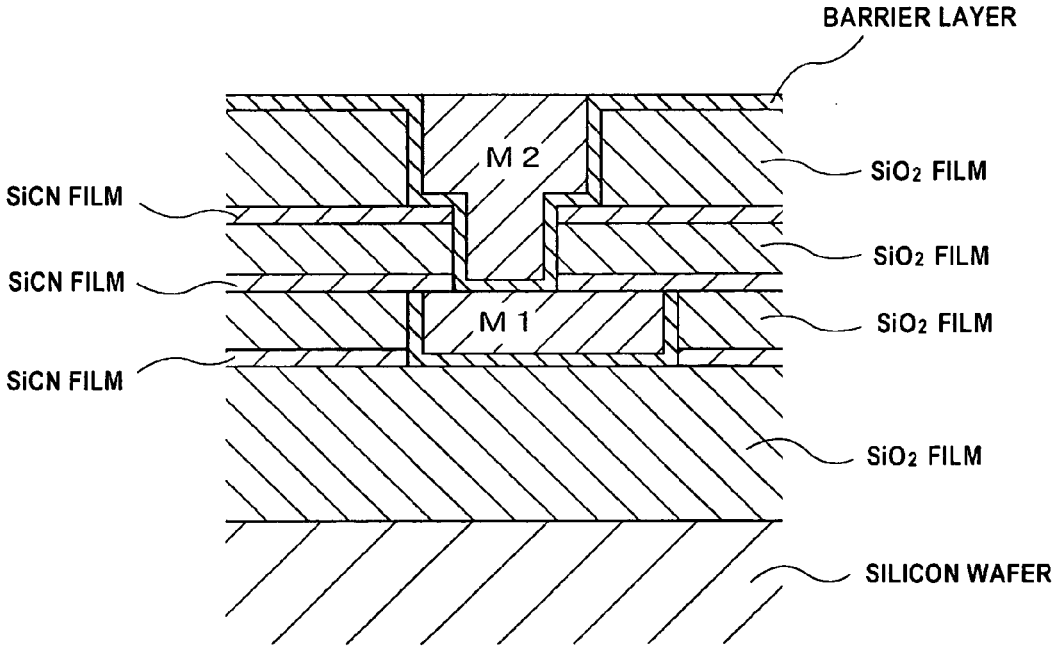
FIG. 41 shows an example of a structure of a substrate in Cu interconnect forming process.

The above-described method detects the point of decrease in the polishing rate based on the change in the wavelength of the extremal point on the spectral profile. It is also possible to determine an amount of film that has been removed based on the change in the wavelength of the extremal point in the same manner. FIG. 41 shows an example of a structure of a substrate in Cu interconnect forming process. Multiple oxide films ($SiO_2$ films) are formed on a silicon wafer. Two-level copper interconnects, i.e., an upper-level copper interconnects M2 and a lower-level copper interconnects M1 which are in electrical communication with each other via via-holes, are formed. SiCN layers are formed between the respective oxide films, and a barrier layer (e.g., TaN or Ta) is formed on the uppermost oxide film. Each of the upper three oxide films has a thickness ranging from 100 nm to 200 nm, and each of the SiCN layers has a thickness of about 30 nm. The lowermost oxide film has a thickness of about 1000 nm. The polishing process is performed for the purpose of adjusting a height of the upper-level copper interconnects M2.

Figure 42:
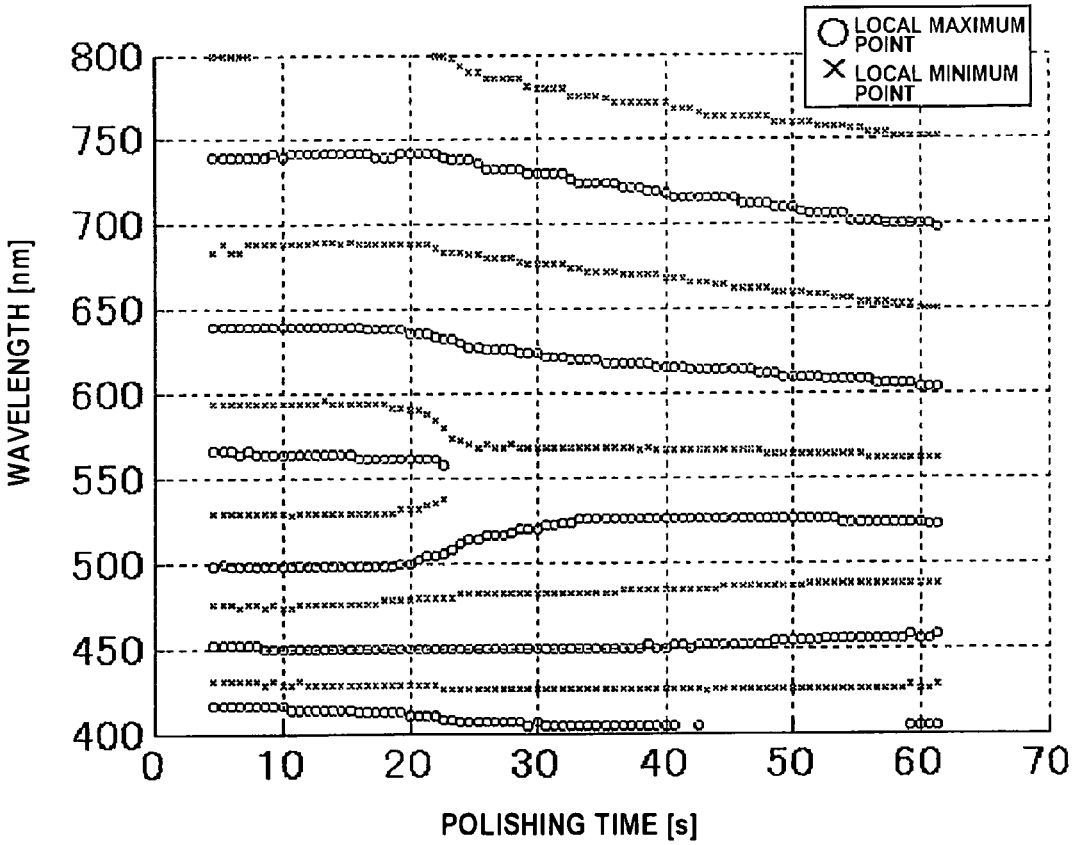
FIG. 42 is a distribution diagram created by plotting local maximum points and local minimum points on the spectral profile when polishing the substrate shown in FIG. 41.
Figure 43:
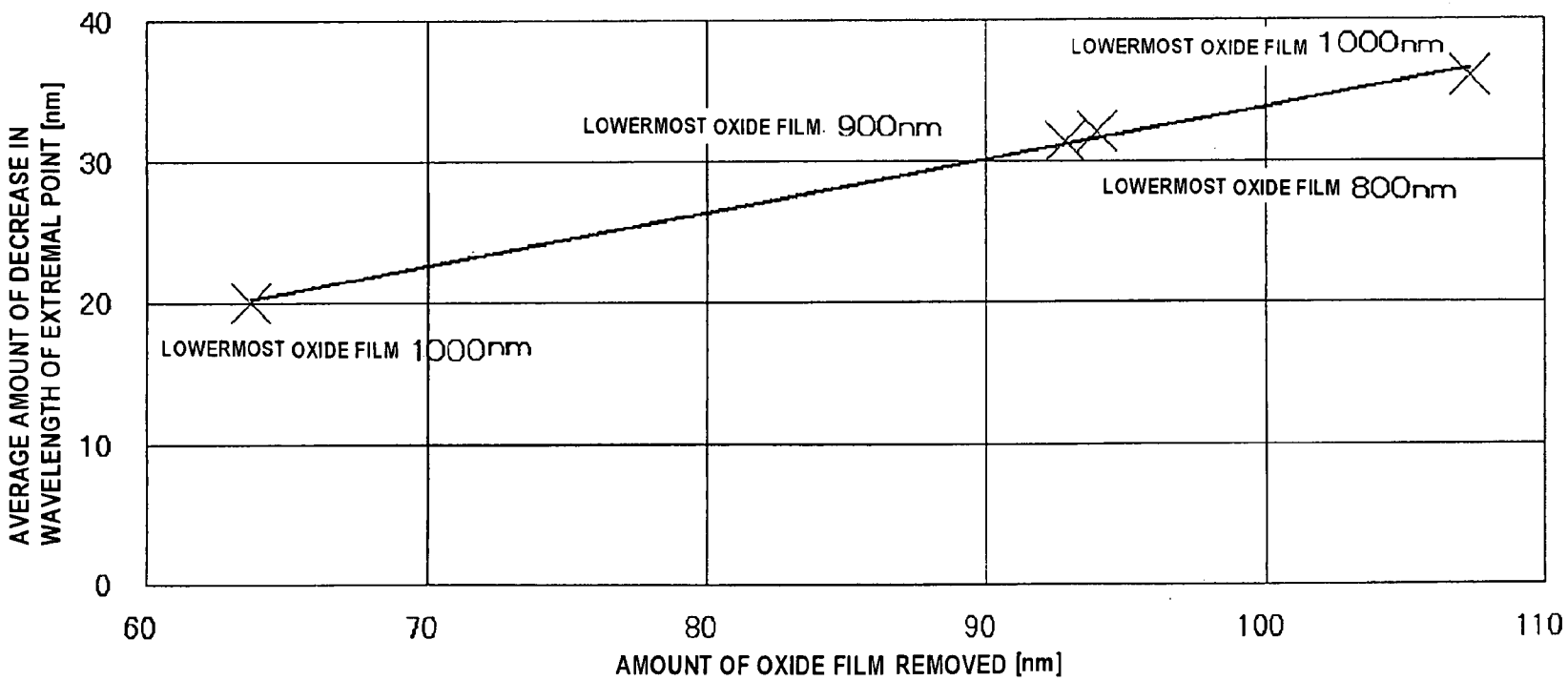
FIG. 43 is a graph obtained by polishing four substrates having respective lowermost oxide films with different thicknesses shown in FIG. 41.

FIG. 42 is a distribution diagram created by plotting local maximum points and local minimum points on the spectral profile when polishing the substrate shown in FIG. 41. In this example, the normalization of the spectral profile using the average over the polishing time is not performed. In the example shown in FIG. 42, the barrier layer is removed when about 25 seconds have elapsed. Further, as can be seen from the graph shown in FIG. 42, after elapse of about 25 seconds, the distribution of the extremal points in a region where the wavelength is not less than 600 nm describes substantially downward straight lines. FIG. 43 is a graph obtained by polishing four substrates having respective lowermost oxide films with different thicknesses shown in FIG. 41. In the graph of FIG. 43, a horizontal axis indicates amount of the removed oxide film obtained from thicknesses thereof measured before and after polishing of the substrate, and a vertical axis indicates amount of decrease in the wavelength of the extremal point in the region where the wavelength is not less than 600 nm after the barrier layer is removed. This amount of decrease in the wavelength is an averaged value. A time when the barrier layer is removed can be determined from a change in output value of an eddy current sensor.

As shown in FIG. 43, the amount of the oxide film removed is proportional to the amount of change in the wavelength. Therefore, the amount of the oxide film removed can be monitored accurately by measuring the amount of change in the wavelength of the extremal point in the region where the wavelength is not less than 600 nm after the barrier layer is removed. Accordingly, the film thickness can be calculated from a difference between an initial thickness of the oxide film, that has been obtained prior to polishing, and the amount of the oxide film that has been removed. Further, it is possible to determine a time when a target film thickness is reached. The initial thickness of the oxide film is, for example, a thickness of an insulating film after interconnect-trenches are formed by dry etching or the like in the Cu interconnect forming process. While the extremal points are determined from the spectral profile composed of the relative reflectances in this example, it is also possible to use the spectral profile composed of the characteristic value expressed by the equation (17), as with the previously-described example.

Figure 44:
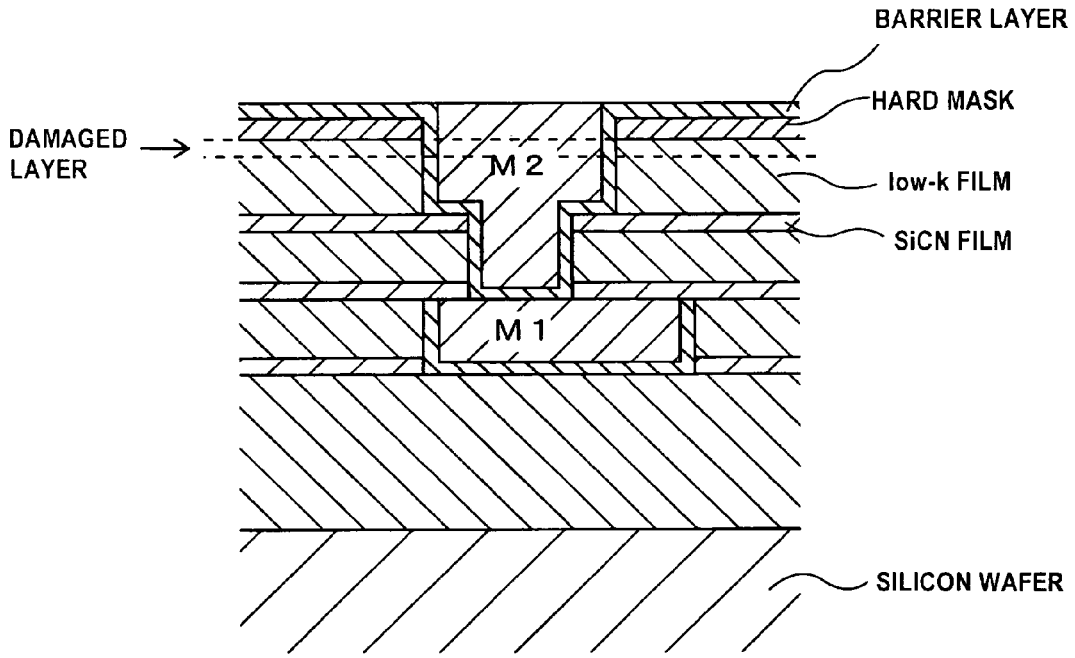
FIG. 44 is a cross-sectional view showing a damaged layer existing in a Cu interconnect structure having a low-k material as an insulating film.
Figure 45:
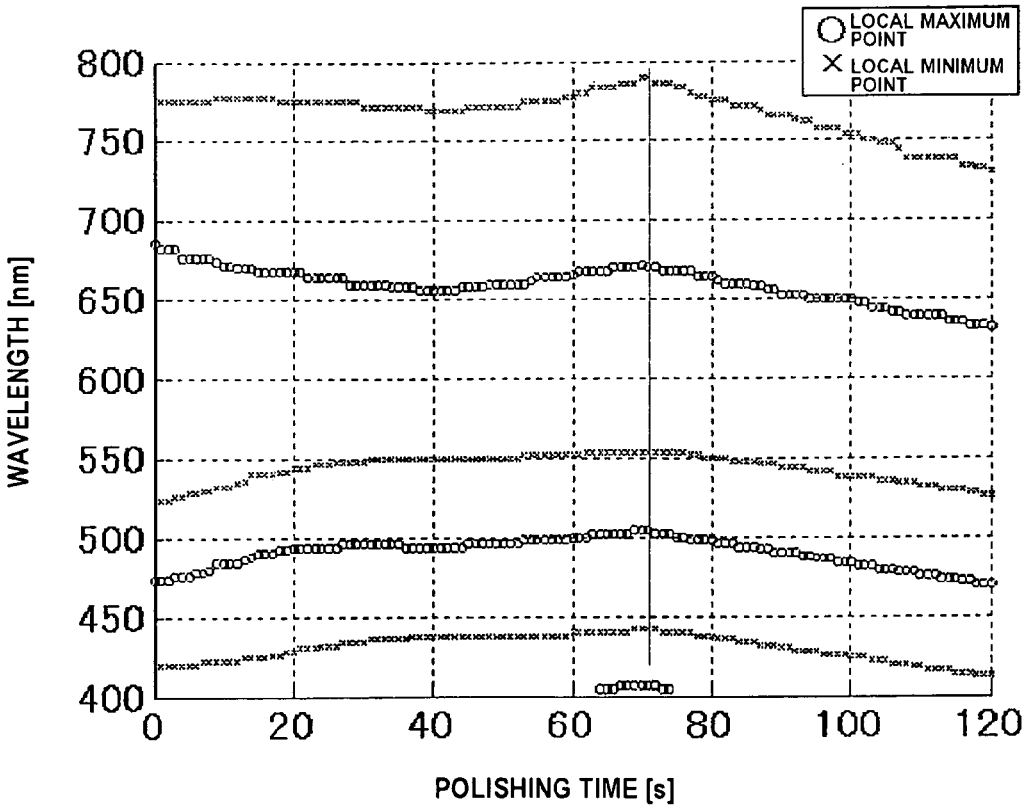
FIG. 45 is a graph showing an example of distribution of the extremal points on the spectral profile when polishing the Cu interconnect structure having the damaged layer.

As shown in FIG. 44, in a Cu interconnect structure having an insulating film of a low-k material, a damaged layer may exist as a result of the etching process or other process. With the development of LSI toward higher density and higher integration, it has been a recent trend to use a low-k material, i.e., a low-dielectric-constant material, as a material of the insulating film in the copper-interconnect forming process. In recent years, the dielectric constant of the low-k material becomes lower and lower. For example, a low-k material made of porous material has a dielectric constant of less than 2.5. However, since the porous material has holes therein, it has a low density, compared with conventional insulating materials. Therefore, during fabrication processes, such as a hole-forming process, an etching process, and an ashing process, particles of plasma and a cleaning agent are likely to spread through a low-k film, thus damaging the low-k film. Such damages include formation of a layer of a deteriorated low-k material between a hardmask and the low-k film. The deteriorated low-k material exists as a damaged layer between the hardmask film and the low-k film. FIG. 45 shows an example of distribution of the extremal points on the spectral profile when polishing the Cu interconnect structure having such a damaged layer. The spectral profile in this example is not subjected to the above-described normalization. The damaged layer may have a refractive index that is lower than that of the low-k film with no damage. In this case, during polishing of the damaged layer, the wavelength stays constant or shows an upward trend. Therefore, it is possible to detect the damaged layer based on the amount of relative change in the extremal point. For example, a start point of a decrease in the wavelength of the extremal point can be determined to be a removal point of the damaged layer.

The polishing apparatus shown in FIG. 18 can be used in the present embodiment. Specifically, during polishing of the substrate W, the light-applying unit 11 applies the light to the substrate W, and the optical fiber 12 as the light-receiving unit receives the reflected light from the substrate W. During the application of the light, the hole 30 is filled with the water, whereby the space between the tip ends of the optical fibers 41 and 12 and the surface of the substrate W is filled with the water. The spectroscope 13 measures the intensity of the reflected light at each wavelength and the monitoring unit 15 produces the spectral data from the reflection intensities measured. The monitoring unit 15 extracts the local maximum points and the local minimum points from the spectral profile, and plots the local maximum points and the local minimum points onto the coordinate system having the vertical axis indicating wavelength and the horizontal axis indicating polishing time. Further, the monitoring unit 15 detects the polishing end point based on the change in the downward trend of the local maximum points and/or the local minimum points on the coordinate system. The polishing apparatus shown in FIG. 19 or FIG. 20 may be used in this embodiment.

Figure 46:
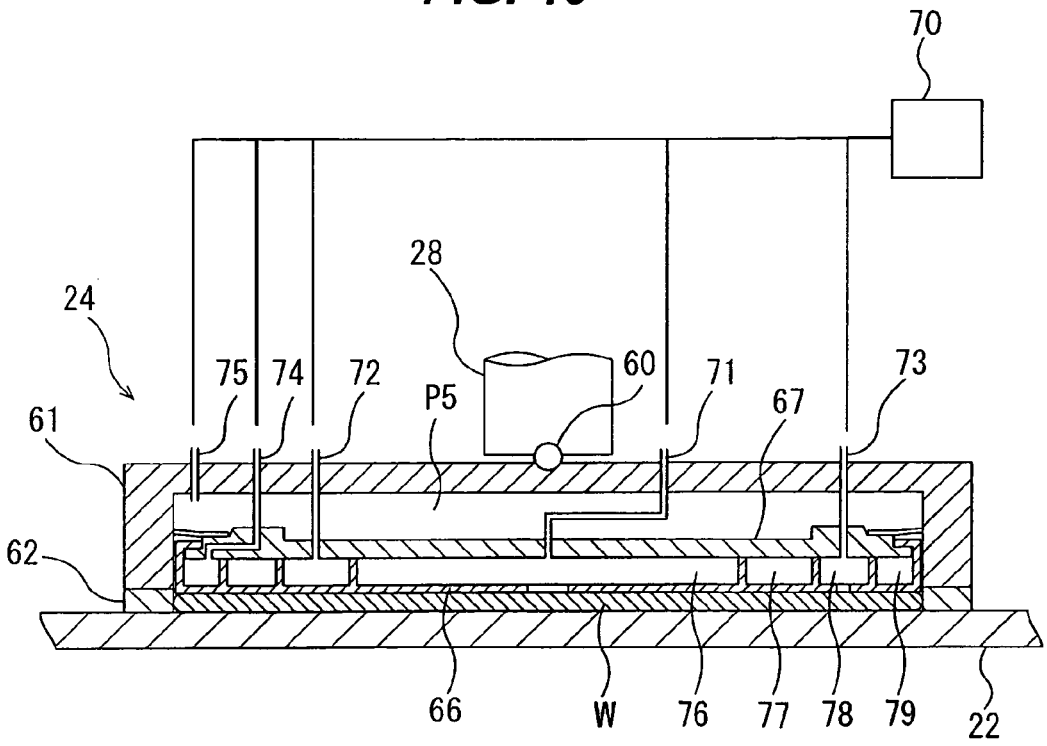
FIG. 46 is a cross-sectional view showing an example of a top ring having a pressing mechanism capable of pressing multiple zones of the substrate independently.

FIG. 46 is a cross-sectional view showing an example of a top ring having a pressing mechanism capable of pressing multiple zones of the substrate independently. The top ring 24 includes a top ring body 61 coupled to a top ring shaft 28 via a universal joint 60, and a retainer ring 62 provided on a lower portion of the top ring body 61. A circular flexible pad (membrane) 66, which is arranged to contact the substrate W, and a chucking plate 67 holding the flexible pad 66 are provided below the top ring body 61. Four pressure chambers (air bags) 76, 77, 78, and 79 are provided between the flexible pad 66 and the chucking plate 67. These pressure chambers 76, 77, 78, and 79 are formed by the flexible pad 66 and the chucking plate 67. The central pressure chamber 76 has a circular shape, and the other pressure chambers 77, 78, and 79 have an annular shape. These pressure chambers 76, 77, 78, and 79 are in a concentric arrangement.

A pressurized fluid (e.g., a pressurized air) is supplied into the pressure chambers 76, 77, 78, and 79 or vacuum is developed in the pressure chambers 76, 77, 78, and 79 by a pressure adjuster 70 via fluid passages 71, 72, 73, and 74, respectively. Internal pressures of the pressure chambers 76, 77, 78, and 79 can be changed independently by the pressure adjuster 70 to thereby independently adjust pressing forces applied to four zones of the substrate W: a central zone, an inner middle zone, an outer middle zone, and a peripheral zone. Further, by lowering the top ring 24 in its entirety, the retainer ring 62 can press the polishing pad 10 at a predetermined force. The retainer ring 62 is shaped so as to surround the substrate W.

A pressure chamber P5 is formed between the chucking plate 67 and the top ring body 61. A pressurized fluid is supplied into the pressure chamber P5 or a vacuum is developed in the pressure chamber P5 by the pressure adjuster 70 via a fluid passage 75. With this configuration, the chucking plate 67 and the flexible pad 66 in their entireties can be moved vertically. The retainer ring 62 is arranged around the periphery of the substrate W so as to prevent the substrate W from coming off the top ring 24 during polishing of the substrate W. The flexible pad 66 has an opening at a position corresponding to the pressure chamber 78. When a vacuum is developed in the pressure chamber 78, the substrate W is held by the top ring 24 via vacuum suction. On the other hand, when a nitrogen gas or clean air is supplied into the pressure chamber 78, the substrate W is released from the top ring 24.

Figure 47:
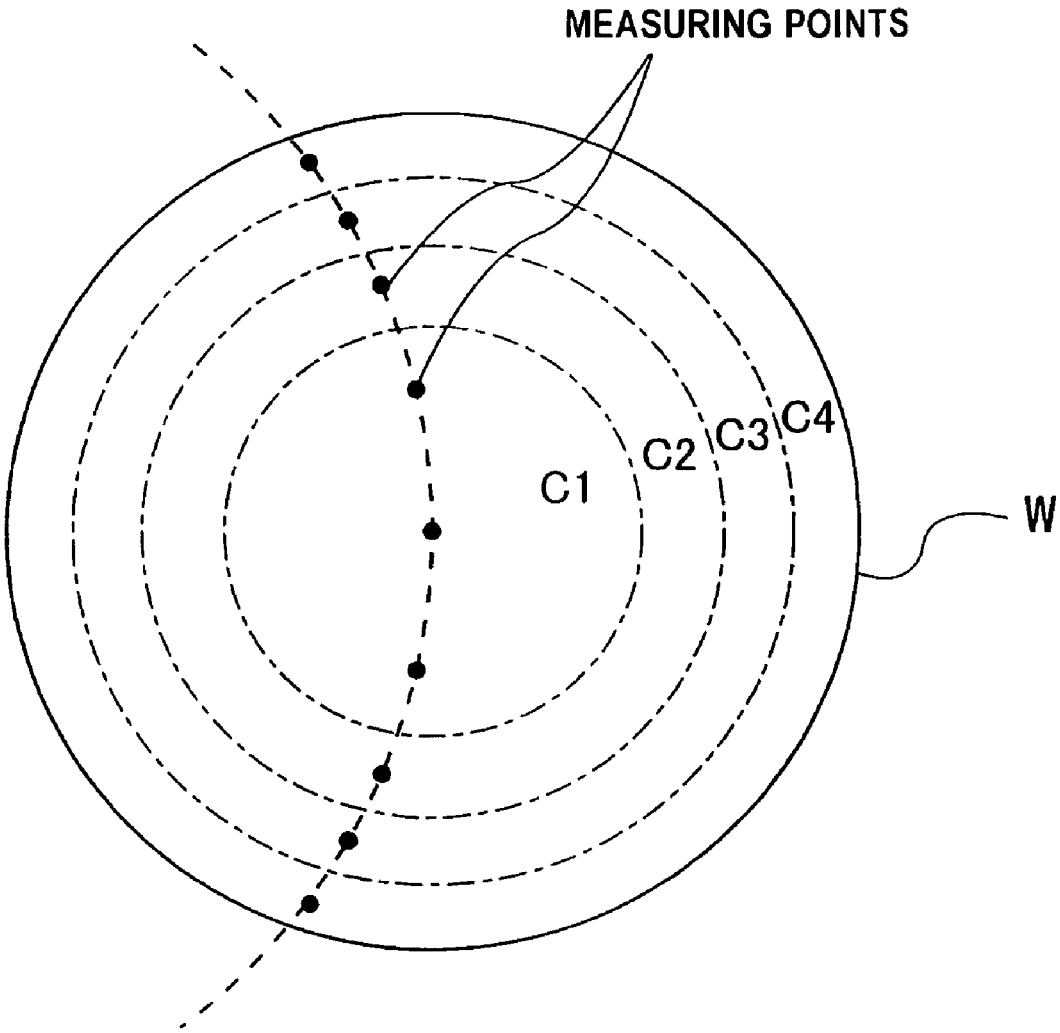
FIG. 47 is a plan view showing the multiple zones of the substrate corresponding to multiple pressure chambers of the top ring.

The monitoring unit 15 monitors the amount of the relative change in the extremal point of the reflection intensities according to the above-described method. FIG. 47 is a plan view showing the multiple zones of the substrate corresponding to the multiple pressure chambers of the top ring. As shown in FIG. 47, the plural measuring points to be monitored are assigned to multiple zones C1, C2, C3, and C4 of the substrate W which correspond to the pressure chambers 76, 77, 78, and 79 of the top ring 24. Specifically, each of the zones C1, C2, C3, and C4 of the substrate W has at least one measuring point. When several measuring points are assigned to one zone of the substrate W, one of the measuring points is selected as a representative measuring point. For example, in the zone C1, a measuring point located at a center of the substrate is selected. Alternatively, an average of measurements at the multiple measuring points in a single zone may be used.

The extremal points at the respective measuring points vary according to the polishing time, as shown in FIG. 36. The monitoring unit 15 controls the pressures in the pressure chambers 76, 77, 78, and 79 independently during polishing, based on the extremal points obtained in the respective zones C1, C2, C3, and C4 of the substrate W. With this operation, the film thicknesses at the zones C1, C2, C3, and C4 can be controlled independently, and a polishing profile of the film can be controlled. Thresholds are set respectively for the zones C1, C2, C3, and C4 of the substrate W corresponding to the pressure chambers 76, 77, 78, and 79. These thresholds may be the same or different for the zones C1, C2, C3, and C4 of the substrate W. The monitoring unit 15 monitors the change in the downward trend of the extremal points (i.e., the amount of the relative change in the extremal point) at each of the zones of the substrate W during polishing of the substrate W according to the above-described method. Further, the monitoring unit 15 determines polishing end points at the respective zones of the substrate W by detecting that the amounts of the relative change in the extremal point reach the respective thresholds.

There may be cases where the polishing end point is detected in one or more zones, but the polishing end point is still not detected in other zone. In such cases, the monitoring unit 15 controls the pressure adjuster 70 so as to reduce the pressure in the pressure chamber corresponding to the zone where the polishing end point has been detected to thereby stop the progress of polishing, and increase the pressure in the pressure chamber corresponding to the zone where the polishing end point is not detected to thereby accelerate the progress of polishing. When the polishing end points are reached in all zones, polishing of the substrate W is terminated. According to this polishing method, a desired polishing profile can be realized.

Next, still another embodiment of the present invention will be described. In this embodiment also, the polishing monitoring apparatus shown in FIG. 8 and FIG. 21 is used as a polishing end point detection apparatus. A substrate W as an object to be polished has a lower layer (e.g., a silicon layer or a SiN film) and a film (e.g., an insulating film, such as $SiO_2$, having a light-transmittable characteristic) formed on the underlying lower layer. The light-applying unit 11 and the light-receiving unit 12 are arranged so as to face a surface of the substrate W. During polishing of the substrate W, the polishing table 20 and the substrate W are rotated, as shown in FIG. 21, to provide relative movement between the polishing pad (not shown) on the polishing table 20 and the substrate W to thereby polish the surface of the substrate W.

The light-applying unit 11 applies the light in a direction substantially perpendicular to the surface of the substrate W, and the light-receiving unit 12 receives the reflected light from the substrate W. The light-applying unit 11 and the light-receiving unit 12 are moved across the substrate W each time the polishing table 20 makes one revolution. During the revolution, the light-applying unit 11 applies the light to plural measuring points including the center of the substrate W, and the light-receiving unit 12 receives the reflected light from the substrate W. The spectroscope 13 is coupled to the light-receiving unit 12. This spectroscope 13 measures intensity of the reflected light at each wavelength (i.e., measures reflection intensities at respective wavelengths). More specifically, the spectroscope 13 decomposes the reflected light according to the wavelength and creates a spectral waveform (spectral profile) indicating the reflection intensities at respective wavelengths over a predetermined wavelength range. The monitoring unit 15 is coupled to the spectroscope 13 and monitors the spectral waveform.

The spectral waveform is obtained each time the polishing table 20 makes one revolution. Typically, the polishing table 20 rotates at a constant speed during polishing of the substrate W. Therefore, spectral waveforms are obtained at equal time intervals which are established by a rotational speed of the polishing table 20. The spectral waveform may be obtained each time the polishing table 20 makes a predetermined number of revolutions (e.g., two or three revolutions).

Figure 48:
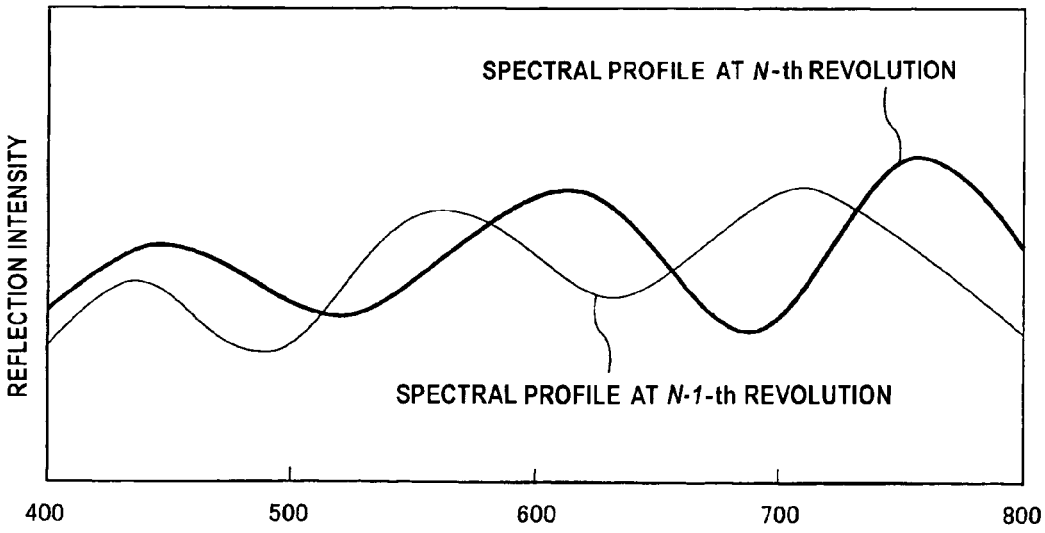
FIG. 48 is a graph showing a spectral waveform obtained when the polishing table is making N−1-th revolution and a spectral waveform obtained when the polishing table is making N-th revolution.

FIG. 48 is a graph showing a spectral waveform obtained when the polishing table is making N−1-th revolution and a spectral waveform obtained when the polishing table is making N-th revolution. In the graph shown in FIG. 48, a vertical axis indicates wavelength and a horizontal axis indicates reflection intensity. As can be seen from FIG. 48, the spectral waveform is a distribution of the reflection intensities according to the wavelength of the reflected light. During polishing of the substrate, the spectral waveform varies according to a decrease in thickness of the film. As shown in FIG. 48, the spectral waveform obtained when the polishing table 20 is making N−1-th revolution differs in its entirety from the spectral waveform obtained when the polishing table 20 is making N-th revolution. This indicates a fact that the reflection intensity varies depending on the film thickness.

Each time the reflection intensities are measured by the spectroscope 13, the monitoring unit 15 calculates a characteristic value (i.e., a spectral index) from the reflection intensity at one or more predetermined wavelengths using the above-described equation (1). The characteristic value may be calculated from relative reflectance using the above equations (2) and (3). The monitoring unit 15 counts the number of distinctive points (i.e., local maximum points or local minimum points) of a variation in the characteristic value, and determines a polishing end point based on a time when the number of distinctive points reaches a predetermined value.

Figure 49:
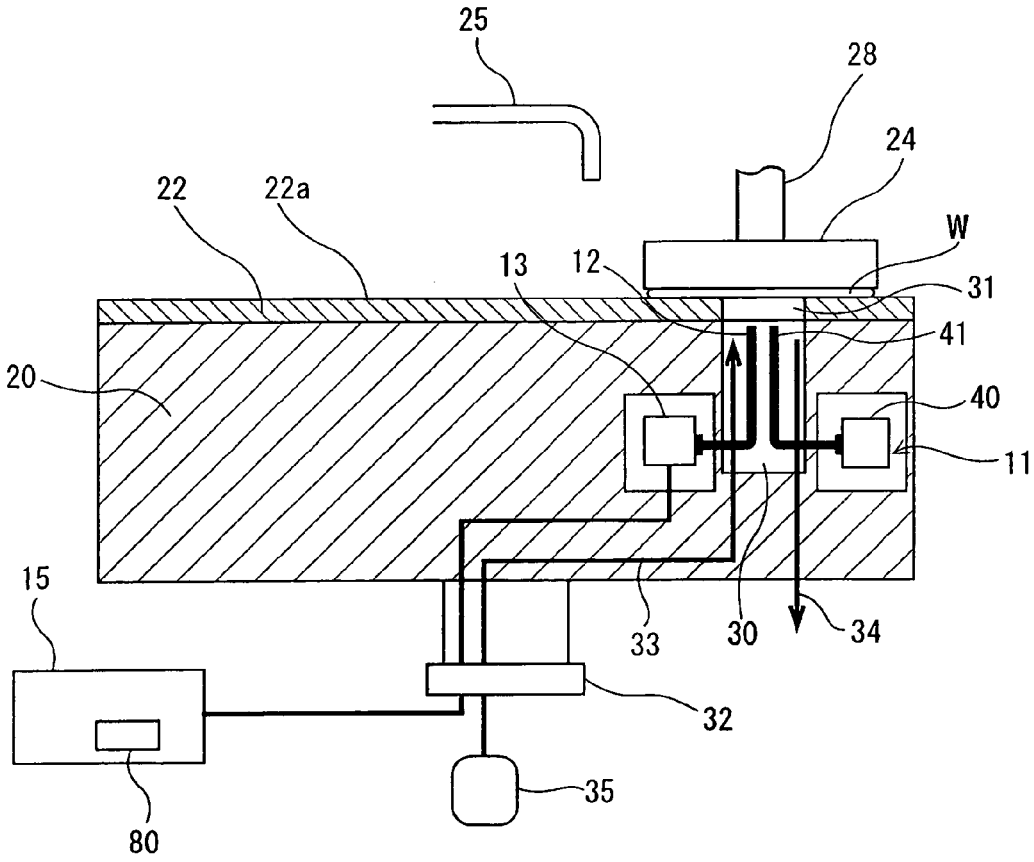
FIG. 49 is a cross-sectional view schematically showing a polishing apparatus incorporating a polishing end point detection unit.

FIG. 49 is a cross-sectional view schematically showing the polishing apparatus incorporating a polishing end point detection unit. The polishing apparatus according to the present embodiment has the same structures as those of the polishing apparatus shown in FIG. 18, and such structures will not be described repetitively. The polishing apparatus has the polishing end point detection unit for detecting the polishing end point according to the above-described method. The polishing end point detection unit includes the light-applying unit 11 configured to apply light to the surface of the substrate W, the optical fiber 12 as the light-receiving unit configured to receive the reflected light from the substrate W, the spectroscope 13 configured to decompose the reflected light according to the wavelength and measures the reflection intensity at each wavelength over the predetermined wavelength range, and the monitoring unit 15 configured to calculate the characteristic value (see the above-described equation (1)) using the reflection intensity obtained by the spectroscope 13 and monitor the progress of polishing of the substrate W based on the characteristic value. The monitoring unit 15 may calculate the characteristic value from the relative reflectance, as described above.

During polishing of the substrate W, the light-applying unit 11 applies the light to the substrate W, and the optical fiber 12 as the light-receiving unit receives the reflected light from the substrate W. During the application of the light, the hole 30 is filled with the water, whereby the space between the tip ends of the optical fibers 41 and 12 and the surface of the substrate W is filled with the water. The spectroscope 13 measures the intensity of the reflected light at each wavelength, and the monitoring unit 15 detects the polishing end point based on the characteristic value, as described above. Instead of the characteristic value, the intensity itself of the reflected light at a predetermined wavelength may be monitored. In this case also, the intensity of the reflected light varies periodically with the polishing time like the graph shown in FIG. 1. Therefore, the polishing end point can be detected from a variation in the intensity of the reflected light.

The monitoring unit 15 includes a storage device 80 therein configured to store an irradiation time of the light on the substrate, intensities of the light on the substrate, and wavelengths of the light. The intensities of the light on the substrate can be obtained by measuring intensities of the reflected light from the substrate using the spectroscope 13. Specifically, the intensities of the reflected light obtained by the spectroscope 13 at respective wavelengths are stored in the storage device 80. The range of the wavelengths of the light to be stored in the storage device 80 is determined by the monitoring ability of the monitoring unit 15. For example, when the monitoring unit 15 has the ability to monitor the wavelengths ranging from 400 to 800 nm, the intensities of the light measured in this wavelength range are stored in association with the corresponding wavelengths.

Photocorrosion may possibly be related not only to the intensity of the light, but also to the wavelength of the light. Further, not only visible ray but also ultraviolet ray and/or infrared ray can affect the photocorrosion. From such viewpoints, the spectroscope 13 is configured to measure the intensities of the light as energy over the wide wavelength range covering visible ray, ultraviolet ray, and infrared ray. By measuring and storing the intensities of the light over the wide wavelength range, a relationship between the photocorrosion and the wavelength can be inspected.

It is not possible to judge the occurrence of the photocorrosion during polishing of the substrate. The occurrence of the photocorrosion remains unknown until an operation test is conducted after final fabrication process to check whether or not a device as a product functions properly. The storage device 80 stores polishing conditions, including the irradiation time of the light, the intensities of the light, and the wavelengths of the light, which are associated with date and time when an individual substrate is polished. This makes it possible to identify the polishing conditions, including the irradiation time of the light, the intensities of the light, and the wavelengths of the light, that have been stored in association with date and time when a certain substrate was polished, if the test results show the occurrence of the photocorrosion in the substrate.

In the present embodiment, the polishing conditions, including the irradiation time of the light, the intensities of the light, and the wavelengths of the light, that are associated with a polished substrate can be used in finding out the cause of the photocorrosion. Moreover, once the cause of the photocorrosion is identified, it is possible to prevent the photocorrosion by avoiding the polishing conditions that can lead to the identified cause of the photocorrosion.

In order to prevent the photocorrosion, it is preferable that the monitoring unit 15 multiply the intensity of the reflected light at a predetermined wavelength by the irradiation time to determine an amount of accumulated irradiation and generate an alarm when the amount of accumulated irradiation reaches a predetermined threshold. Alternatively, when the above-described light irradiation time reaches a predetermined threshold, the monitoring unit 15 may generate an alarm.

The polishing conditions to be stored in the storage device 80 are factors that can be the cause of the photocorrosion. The possible causes of the photocorrosion may further include a type and a concentration of slurry to be used as the polishing liquid, a temperature of a substrate, and an ambient light. Therefore, it is preferable that the storage device 80 be configured to store a type and a concentration of slurry, a temperature of a substrate, and information on an ambient light in a polishing chamber (e.g., irradiation time, intensity, wavelength), in addition to the above-described irradiation time of the light, the intensities of the light, and the wavelengths of the light. A temperature of the substrate can be determined by indirectly measuring a temperature of the polishing surface using a temperature sensor, such as a thermograph. It is also possible to determine the temperature of the substrate by indirectly measuring a temperature of the water discharged through the liquid discharge passage 34.

The intensity of the ambient light in the polishing chamber can be measured by the spectroscope 13 through the light-receiving unit 12 when the light-receiving unit 12 is not facing the substrate. In this case, an amount of accumulated irradiation of the ambient light may be calculated by multiplying the intensity of the ambient light at a predetermined wavelength by the irradiation time. Further, the amount of accumulated irradiation of the ambient light may be added to the above-described amount of the accumulated irradiation of the light from the light source 40, and the monitoring unit 15 may generate an alarm when the resultant amount of irradiation reaches a predetermined threshold.

Figure 50:
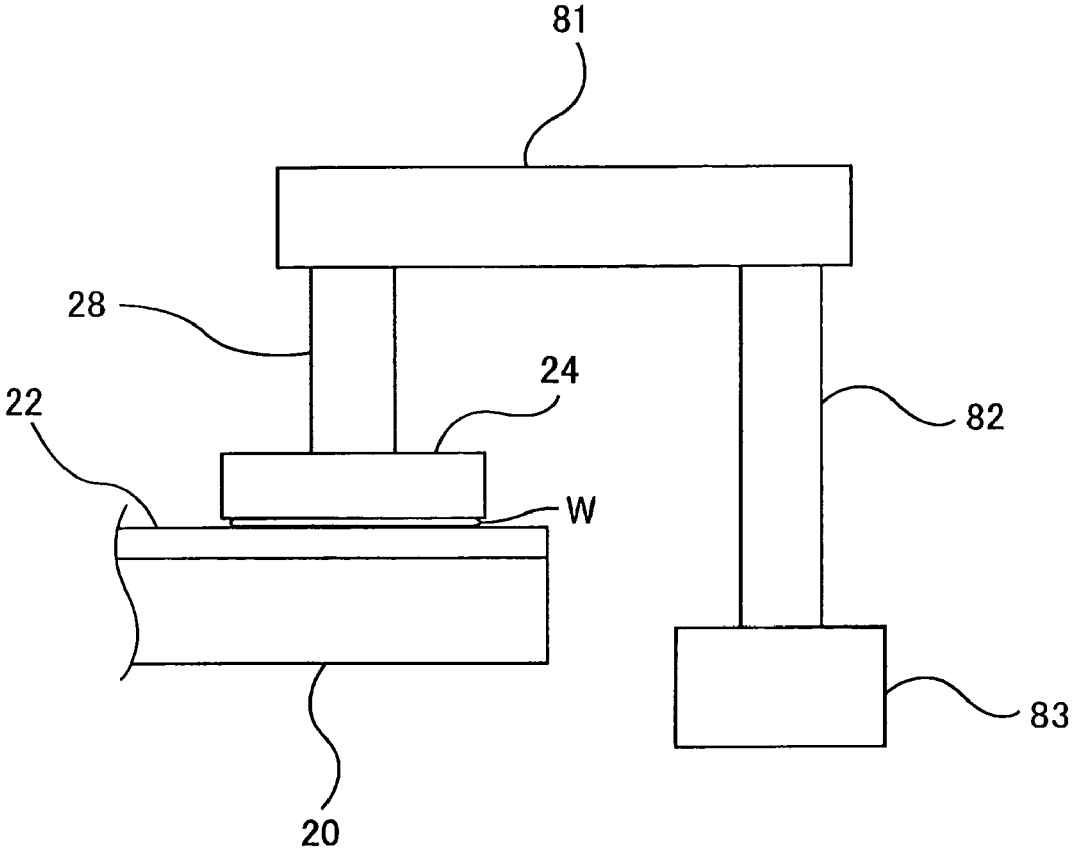
FIG. 50 is a side view showing a swinging mechanism for swinging a top ring.

As shown in FIG. 21, the light from the light source 40 is applied to the center of the substrate W each time the polishing table 20 makes one revolution. Therefore, the center of the substrate W is a portion where the photocorrosion is most likely to occur. Thus, in order to avoid excess application of the light to the center of the substrate W, it is preferable to swing the top ring 24 during polishing of the substrate W. FIG. 50 is a side view showing a swinging mechanism for swinging the top ring 24. As shown in FIG. 50, the swinging mechanism includes a pivot arm 81 coupled to the top ring shaft 28, a pivot shaft 82 supporting the pivot arm 81, and a drive mechanism configured to rotate the pivot shaft 82 about its own axis through a predetermined angle. The top ring shaft 28 is coupled to one end of the pivot arm 81, and the pivot shaft 82 is coupled to the other end of the pivot arm 81. The drive mechanism 83 includes, for example, a motor and reduction gears. When the drive mechanism 83 is set in motion, the pivot arm 81 pivots to thereby swing the top ring 24. While the swinging direction of the top ring 24 is not limited particularly, it is preferable to swing the top ring 24 in a radial direction of the polishing table 20.

Instead of the swinging motion of the top ring 24 or in addition to the swinging motion of the top ring 24, the light may be applied to the center of the substrate each time the polishing table 20 makes several numbers of revolutions. Further, the light source 40 may comprise two light sources which are a halogen lamp emitting stationary light and a xenon flash lamp emitting pulse light, and the halogen lamp and the xenon flash lamp may be used selectively.

Generally, the photocorrosion occurs in a surface of a metal film. Therefore, even if the photocorrosion occurs during polishing, the corroded part is removed by the sliding contact with the polishing pad. Thus, it is preferable to detect a predetermined preliminary polishing end point which is set slightly before the actual polishing end point, stop the application of the light from the light source 40 to the substrate when the preliminary polishing end point is detected, and stop polishing of the substrate when a predetermined time has elapsed from the preliminary polishing end point. In the graph shown in FIG. 1, the preliminary polishing end point is set to a time slightly before the actual polishing end point. In this manner, the photocorroded part can be removed by over-polishing the substrate without applying the light to the substrate.

Figure 51:
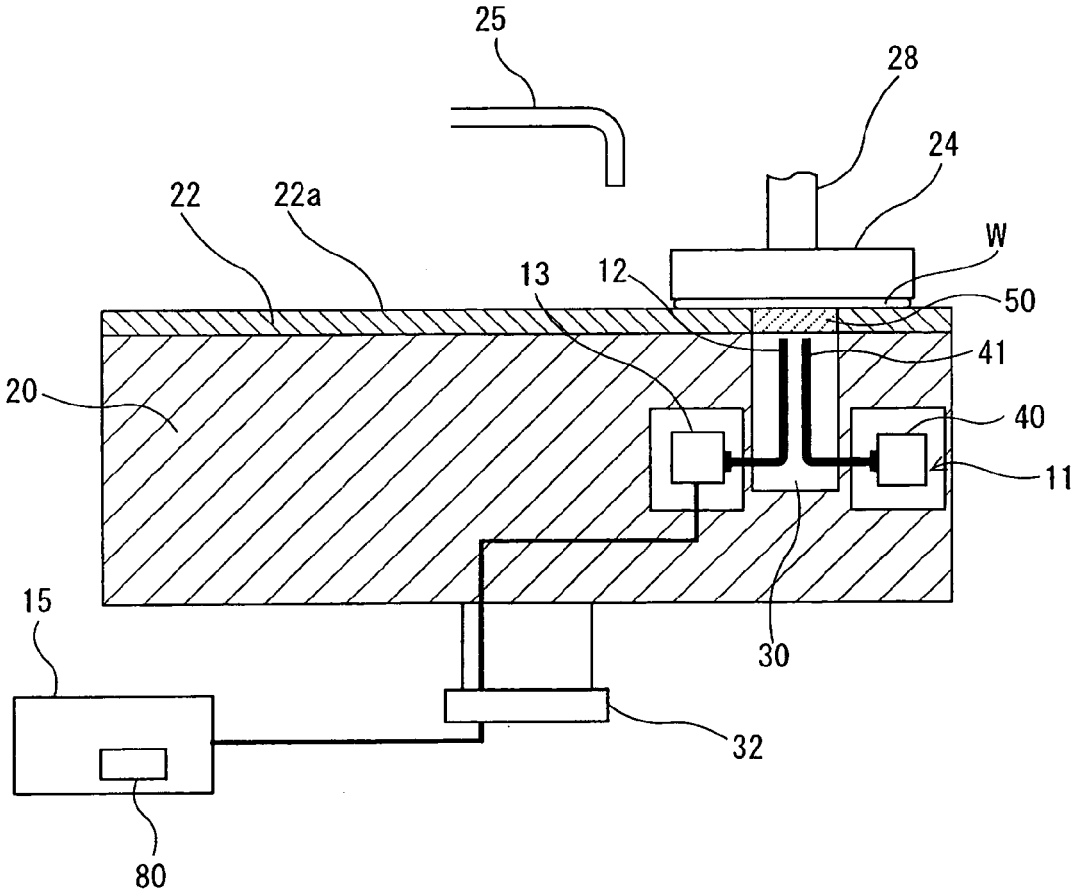
FIG. 51 is a cross-sectional view showing another modified example of the polishing apparatus shown in FIG. 49.

FIG. 51 is a cross-sectional view showing another modified example of the polishing apparatus shown in FIG. 49. In the example shown in FIG. 51, the liquid supply passage, the liquid discharge passage, and the liquid supply source are not provided. Instead of these configurations, a transparent window 50 is provided in the polishing pad 22. The optical fiber 41 of the light-applying unit 11 applies the light through the transparent window 50 to the surface of the substrate W on the polishing pad 22, and the optical fiber 12 as the light-receiving unit receives the reflected light from the substrate W through the transparent window 50. Other structures are identical to those of the polishing apparatus shown in FIG. 49.

Next, still another embodiment of the present invention will be described. In this embodiment also, the polishing monitoring apparatus shown in FIG. 8 and FIG. 21 is used. A substrate W as an object to be polished has a lower layer (e.g., a silicon layer or metal interconnects) and a film (e.g., an insulating film, such as $SiO_2$, having a light-transmittable characteristic) formed on the underlying lower layer. The light-applying unit 11 and the light-receiving unit 12 are arranged so as to face a surface of the substrate W. During polishing of the substrate W, the polishing table 20 and the substrate W are rotated, as shown in FIG. 21, to provide relative movement between the polishing pad (not shown) on the polishing table 20 and the substrate W to thereby polish the surface of the substrate W.

The light-applying unit 11 applies the light in a direction substantially perpendicular to the surface of the substrate W, and the light-receiving unit 12 receives the reflected light from the substrate W. The light-applying unit 11 and the light-receiving unit 12 are moved across the substrate W each time the polishing table 20 makes one revolution. During the revolution, the light-applying unit 11 applies the light to plural measuring points including the center of the substrate W, and the light-receiving unit 12 receives the reflected light from the substrate W. The spectroscope 13 is coupled to the light-receiving unit 12. This spectroscope 13 measures intensity of the reflected light at each wavelength (i.e., measures reflection intensities at respective wavelengths). More specifically, the spectroscope 13 decomposes the reflected light according to the wavelength and measures the reflection intensity at each wavelength.

The monitoring unit 15 is coupled to the spectroscope 13. This monitoring unit 15 is configured to normalize the reflection intensity measured by the spectroscope to generate relative reflectance. This relative reflectance can be calculated using the above-described equation (2). A reference spectral waveform, which indicates distribution of reference intensities according to wavelength of the light, is stored in the monitoring unit 15. The monitoring unit 15 divides the intensity of the reflected light at each wavelength by the corresponding reference intensity to create the relative reflectance at each wavelength, and generates a spectral waveform (spectral profile) which indicates a relationship between the relative reflectance and the wavelength of the light. This spectral waveform shows a distribution of relative reflectances according to the wavelength.

The spectral waveform is created based on the intensity of the reflected light. Therefore, the spectral waveform varies according to the decrease in thickness of the film. The spectroscope 13 measures the reflection intensities each time the polishing table 20 makes one revolution, and the monitoring unit 15 produces the spectral waveform from the reflection intensities measured by the spectroscope 13. Further, the monitoring unit 15 monitors the progress of the polishing (i.e., the decrease in the film thickness) based on the spectral waveform. A general-purpose computer or a dedicated computer can be used as the monitoring unit 15.

Figure 7:
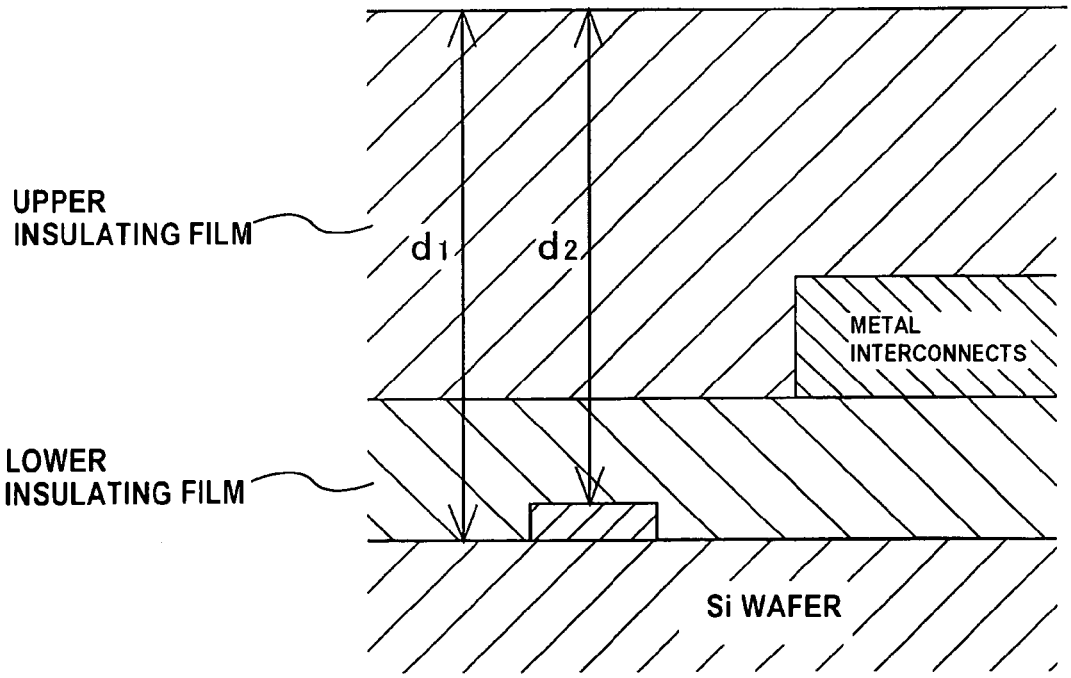
FIG. 7 is a cross-sectional view showing an example of a multilayer structure.

As described above, the monitoring unit 15 monitors the progress of the polishing based on the spectral waveform that varies depending on the thickness of the film. However, an actual substrate to be polished has a complicated multilayer structure. For example, as shown in FIG. 7, a light-transmittable insulating film may exist underneath an uppermost insulating film that is an object to be polished. In such a structure, the light from the light-applying unit 11 travels not only through the upper insulating film, but also through the underlying lower insulating film. As a result, the spectral waveform reflects the thickness of both the upper insulating film and the lower insulating film. In this case, if the thickness of the lower insulating film varies from region to region of the substrate or from substrate to substrate, the accuracy of the polishing end point detection is lowered. Thus, in this embodiment, a numerical filter is used to reduce the influence caused by the variations in thickness of the lower film. The details of the numerical filter used in the embodiment of the present invention will be described below.

Figure 52:
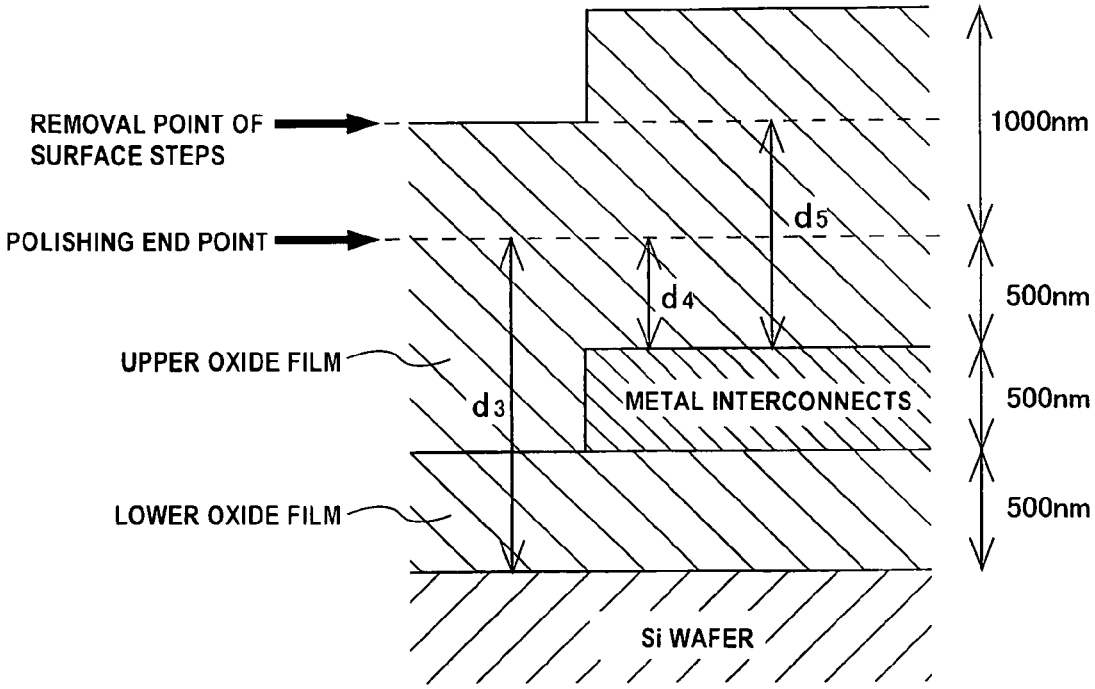
FIG. 52 is a schematic view showing part of a cross section of a substrate having a multilayer structure.

FIG. 52 is a schematic view showing part of a cross section of a substrate having a multilayer structure. This substrate W has a silicon wafer, a lower oxide film (an $SiO_2$ film in this example) formed on the silicon wafer, metal interconnects (e.g., interconnects of aluminum or copper) formed on the lower oxide film, and an upper oxide film (an $SiO_2$ film in this example) formed so as to cover the lower oxide film and the metal interconnects. The lower oxide film has a thickness of 500 nm, the metal interconnects have a thickness of 500 nm, and the upper oxide film has a thickness of 1500 nm. Due to the metal interconnects, steps are formed on a surface of the upper oxide film. The height of the surface steps is approximately equal to the thickness of the metal interconnects, which is about 500 nm.

In this example, the polishing end point is set to 1000 nm which is an amount to be removed. This target amount is set to be large enough to remove the surface steps to planarize the surface of the film. This polishing end point is determined from a thickness of the upper oxide film on the metal interconnects. Both the upper oxide film and the lower oxide film are inter-level dielectric composed of an insulating material. Hereinafter, the upper oxide film and the lower oxide film may be collectively referred to as an insulating part.

Figure 53:
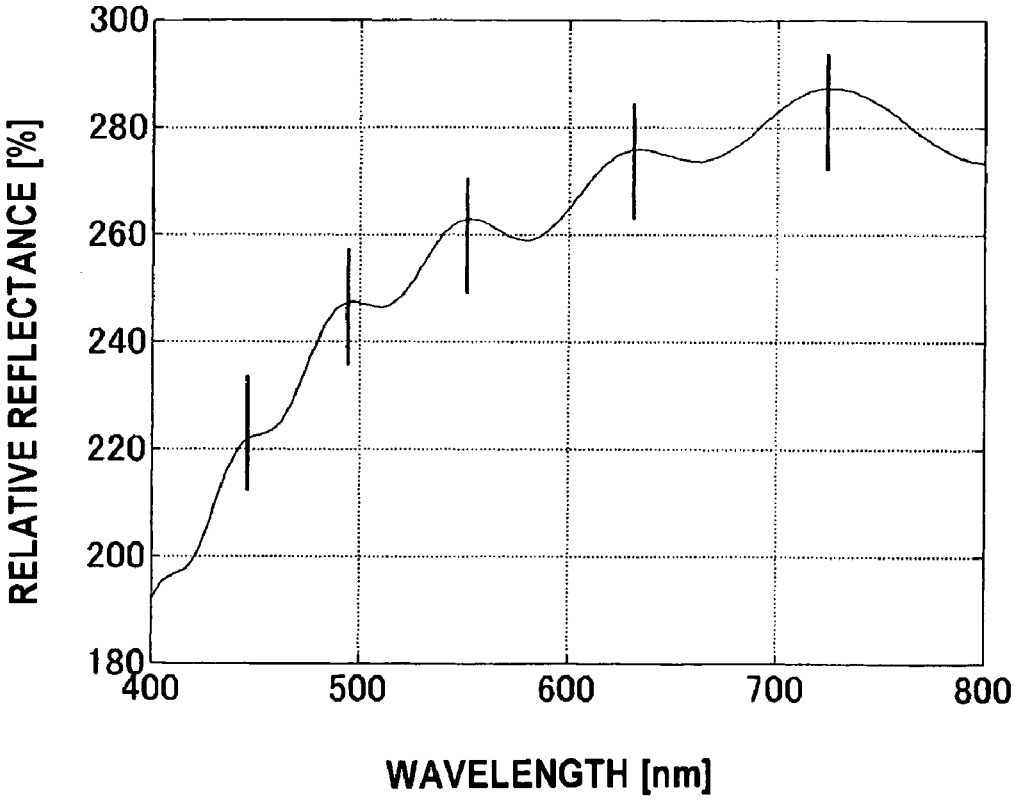
FIG. 53 is a graph showing a spectral waveform obtained at a polishing end point.

FIG. 53 is a graph showing a spectral waveform obtained at the polishing end point. Pure water is used as a medium contacting the substrate. In FIG. 53, a vertical axis indicates relative reflectance [%], and a horizontal axis indicates wavelength of the reflected light [nm]. As shown in FIG. 53, the relative reflectance increases and decreases repeatedly along the horizontal axis (i.e., the wavelength axis). In other words, as can be seen in a shorter-wavelength region, a slope of the spectral waveform increases and decreases repeatedly along the wavelength axis, while the relative reflectance itself shows a monotonous increase (or monotonous decrease) with respect to the wavelength. This is because the number of light waves existing on an optical path in the insulating part varies depending on the wavelength and therefore the manner of interference of the light changes according to the wavelength. As can be seen in FIG. 53, an interval between local maximum points of the relative reflectances increases as the wavelength increases. Hereinafter, such a fluctuating component that appears on the spectral waveform will be referred to as an optical interference component or simply as an interference component. In addition, in this specification, the interval between local maximum points of the relative reflectances will be referred to as an extremum interval.

In the spectral waveform shown in FIG. 53, two interference components coexist. One is an interference component formed as fluctuations that are composed of repetitive increase and decrease about five times as can be seen visibly from FIG. 53. The other is an interference component having longer extrema intervals, although it cannot be seen visually in FIG. 53. This interference component having longer extrema intervals is caused by the interference of the light in a region where the metal interconnects are formed. More specifically, the interference component having longer extrema intervals is caused by optical interference between reflected light from the upper surface (a surface to be polished) of the upper oxide film and reflected light from upper surfaces of the metal interconnects. On the other hand, the interference component having shorter extrema intervals is caused by the interference of the light in a region where the metal interconnects are not formed. More specifically, the interference component having shorter extrema intervals is caused by optical interference between reflected light from the upper surface of the upper oxide film and reflected light from the upper surface of the Si wafer.

Figure 54:
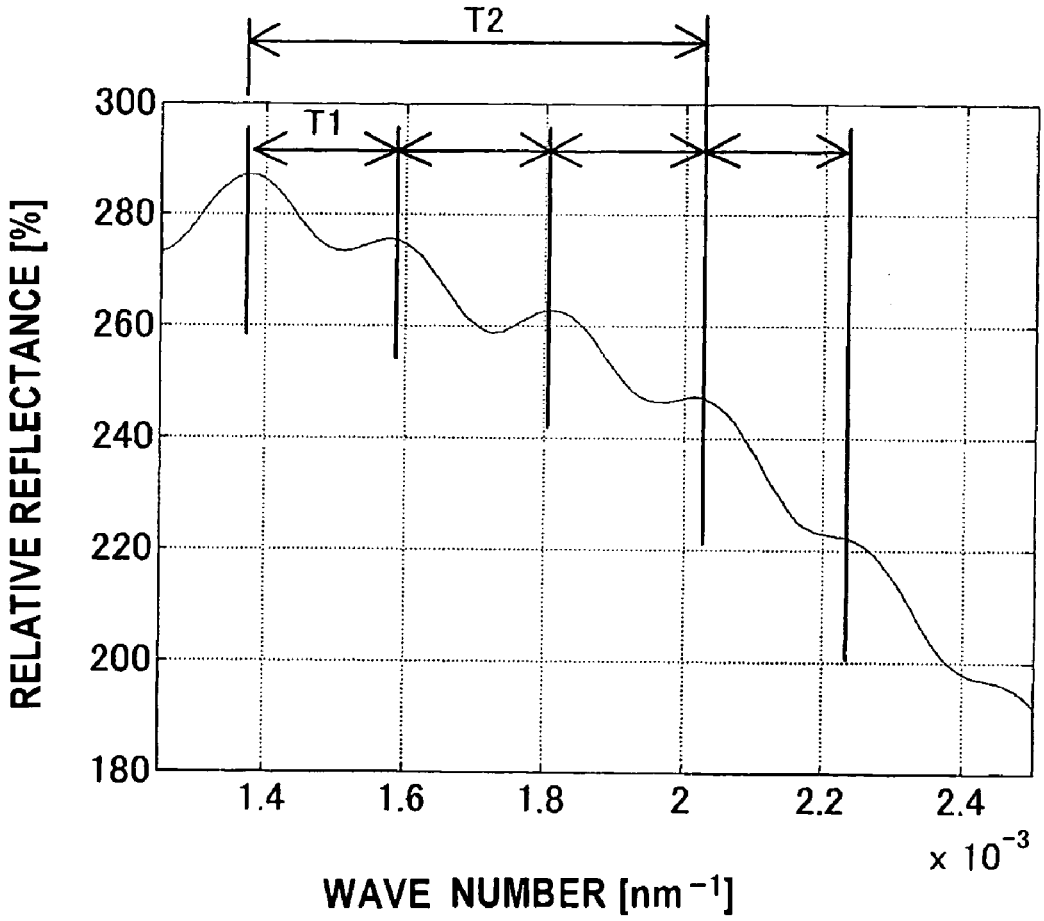
FIG. 54 is a graph showing a spectral waveform obtained by converting wavelength along a horizontal axis in FIG. 53 into wave number.

FIG. 54 is a graph showing a spectral waveform obtained by converting wavelength on the horizontal axis in FIG. 53 into wave number [$nm^{-1}$]. The wave number is the number of light waves per unit length and expressed as an inverse number of the wavelength. Unlike FIG. 53, the interference components on the spectral waveform shown in FIG. 54 fluctuate periodically. Specifically, a cycle T1 of a shorter-cycle interference component that appears along a wave-number axis is substantially constant. This cycle T1 is expressed approximately by $\frac{1}{2}nd_3$, where n is a refractive index of the oxide film, and $d_3$ is a thickness of the oxide film in a region where the metal interconnects are not formed. On the other hand, although not visibly shown in FIG. 53, a longer-cycle interference component has a cycle T2 which is expressed approximately by $\frac{1}{2}nd_4$, where $d_4$ is a thickness of the oxide film formed on the metal interconnects, and $d_4<d_3$ (see FIG. 52).

As described above, since the substrate shown in FIG. 52 has the insulating part whose thickness varies from region to region, interference components having different cycles appear on the spectral waveform. Generally, the substrate has a complicated multilayer structure, and a light-transmittable film may be formed underneath a film to be polished. If the thickness of the underlying film varies from region to region in the substrate or varies from substrate to substrate, the length of the optical path in the substrate also varies from region to region or from substrate to substrate. As a result, even if the uppermost film, to be polished, has a uniform thickness, the spectral waveform obtained can vary from region to region in the substrate or vary from substrate to substrate. To monitor the progress of polishing of the substrate, it is necessary to eliminate such an influence of the variation in thickness of the underlying film and extract only the thickness of the uppermost film. In view of this respect, the present invention applies the numerical filter to the spectral waveform to eliminate the influence of the variation in thickness of the underlying film. Specifically, the numerical filter permits passage of only interference components generated in a thickness region ranging from the surface, to be polished, to a predetermined depth. In this embodiment, the numerical filter thus designed is used to reduce unwanted interference components.

The numerical filter is a digital filter, and is a low-pass filter. Specifically, the numerical filter removes interference components, having cycles corresponding to thickness of not less than a predetermined threshold, from the spectral waveform and allows interference components, having cycles corresponding to thickness of less than the predetermined threshold, to pass therethrough. This filtering process using the numeral filter is performed as a post-process of the spectral waveform.

The numeral filter removes from the spectral waveform the interference components of the light generated in the region where the thickness of the insulating part is not less than the predetermined threshold. More specifically, the numerical filter allows passage of interference components having cycles that are not less than a cycle (not more than a frequency) corresponding to a predetermined thickness, and reduce interference components having cycles that are less than the cycle (more than the frequency) corresponding to the predetermined thickness. The relationship between the thickness d of the insulating part and the cycle T of the interference component is determined uniquely by the expression $T=\frac{1}{2}nd$. This expression indicates a fact that the thickness and the cycle are in inverse proportion to each other.

As shown in FIG. 54, conversion from the wavelength axis into the wave-number axis makes the cycles ($=\frac{1}{2}nd$) of the interference components constant along the horizontal axis of the graph of the spectral waveform. As a result of the conversion, the thickness and the cycle of the insulating part correspond to each other in one-to-one relationship. Therefore, the interference components to be cut off can be specified by the thickness of the insulating part, and it becomes easy to design the numerical filter having intended response characteristics. In a case where the thickness to be monitored (see $d_4$ in FIG. 52) differs greatly from the thickness to be cut off (see $d_3$ in FIG. 52), the wavelength may not be converted into the wave number. In such a case, an appropriate numerical filter (a low pass filter) is applied to the spectral waveform along the horizontal axis which is the wavelength axis.

Figure 55:
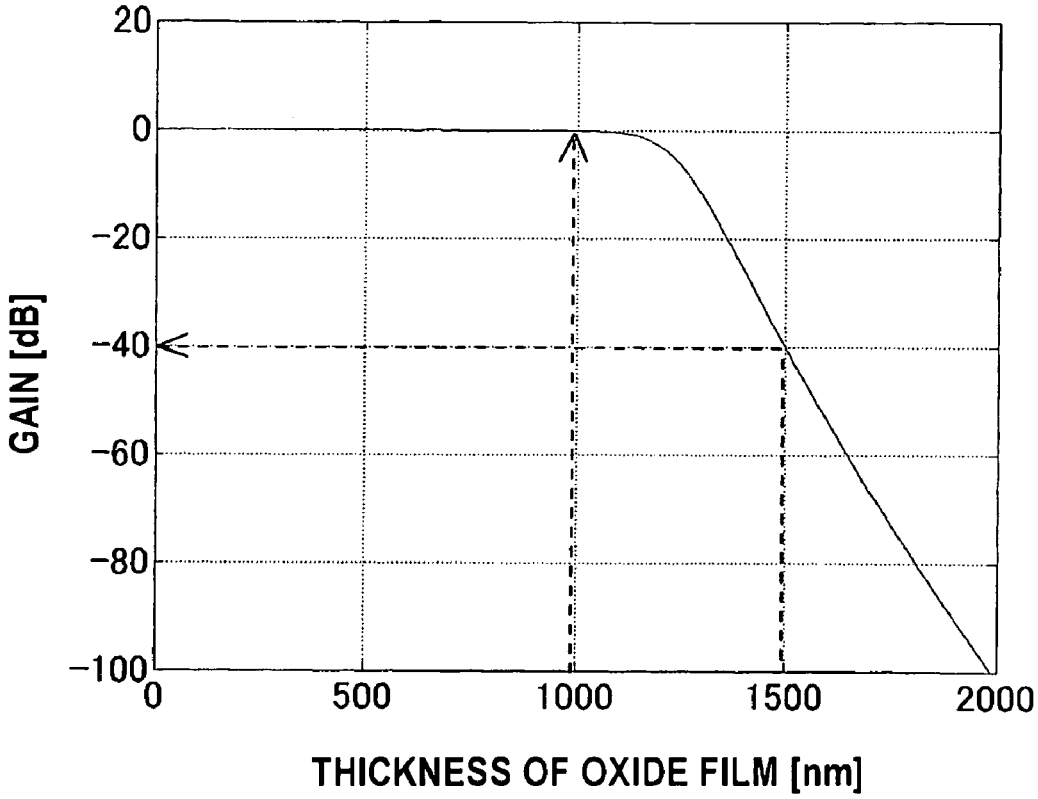
FIG. 55 is a graph showing frequency response characteristics of a numerical filter.

FIG. 55 is a graph showing frequency response characteristics of the numerical filter. In the graph in FIG. 55, a vertical axis indicates gain [dB], and a horizontal axis indicates thickness (depth) from a surface of the insulating part. This horizontal axis indicates the thickness (depth) of the insulating part converted from the cycle T of the interference component, under the assumption that the cycle T of the interference component is $\frac{1}{2}nd$, where n is the refractive index of the insulating part and d is the thickness of the insulating part. The insulating part may comprise plural light-transmittable films with different refractive indices. In such cases, an insulating-part equivalent thickness may be calculated as long as the optical characteristics (e.g., refractive index and attenuation coefficient) of the films do not differ greatly. The insulating-part equivalent thickness is obtained by converting the respective thicknesses of the plural light-transmittable films into insulating-part equivalent thicknesses based on the refractive indices and then calculating the sum of the resultant thicknesses. Specifically, the insulating-part equivalent thickness can be obtained by the following expression:

The insulating-part equivalent thickness=Σ(a thickness of a light-transmittable film×a refractive index of the light-transmittable film/a refractive index of a reference insulating film)

In this example, in order to sufficiently cut off, at the polishing end point, the interference components generated in regions where the metal interconnects are not formed, a gain corresponding to 1500 nm (see $d_3$ in FIG. 52) in thickness of the insulating part is set to not more than −40 dB (an amplitude ratio is not more than 1%). On the other hand, in order to allow, at a removal point of the surface steps, the passage of interference components generated in regions where the insulating part is formed on the metal interconnects, a gain corresponding to 1000 nm (see $d_5$ in FIG. 52) in thickness of the insulating part is set to not less than −0.0873 dB (an amplitude ratio is not less than 99%). Therefore, at the polishing end point, the interference components due to the reflected light from the upper surfaces of the metal interconnects pass through the numerical filter, and on the other hand the interference components due to the reflected light from reflecting surfaces (e.g., the upper surface of the Si wafer) located below the upper surfaces of the metal interconnects are removed from the spectral waveform by the numerical filter.

In this manner, application of the numerical filter to the spectral waveform can remove the interference components due to the reflected light from a second reflecting surface (e.g., the upper surface of the Si wafer) located below a first reflecting surface in the insulating part (e.g., the upper surfaces of the metal interconnects). The first reflecting surface is a reflecting surface lying in the insulating part and located at the highest position basically, i.e., located closest to the surface to be polished. If metal interconnects, belonging to a level underlying the uppermost metal interconnects, have upper surface areas larger than those of the uppermost metal interconnects, the upper surfaces of the metal interconnects belonging to the underlying level may be the first reflecting surface.

A commercially-available interactive numerical analysis software MATLAB can be used for designing the numerical filter. In this embodiment, this software is used to design a twelfth-order Butterworth filter having gains, one of which is half of −40 dB representing the above-described gain in the cut-off band and the other is half of −0.0873 dB representing the above-described gain in the pass band. This numerical filter is used as a zero-phase filter. Specifically, the numerical filter is applied to the spectral waveform from forward and then from backward with respect to the wave-number axis shown in FIG. 54. By applying the numerical filter in this manner, phase shifts due to filtering can be cancelled, and damping characteristics with twice the preset gains can be obtained.

Figure 56:
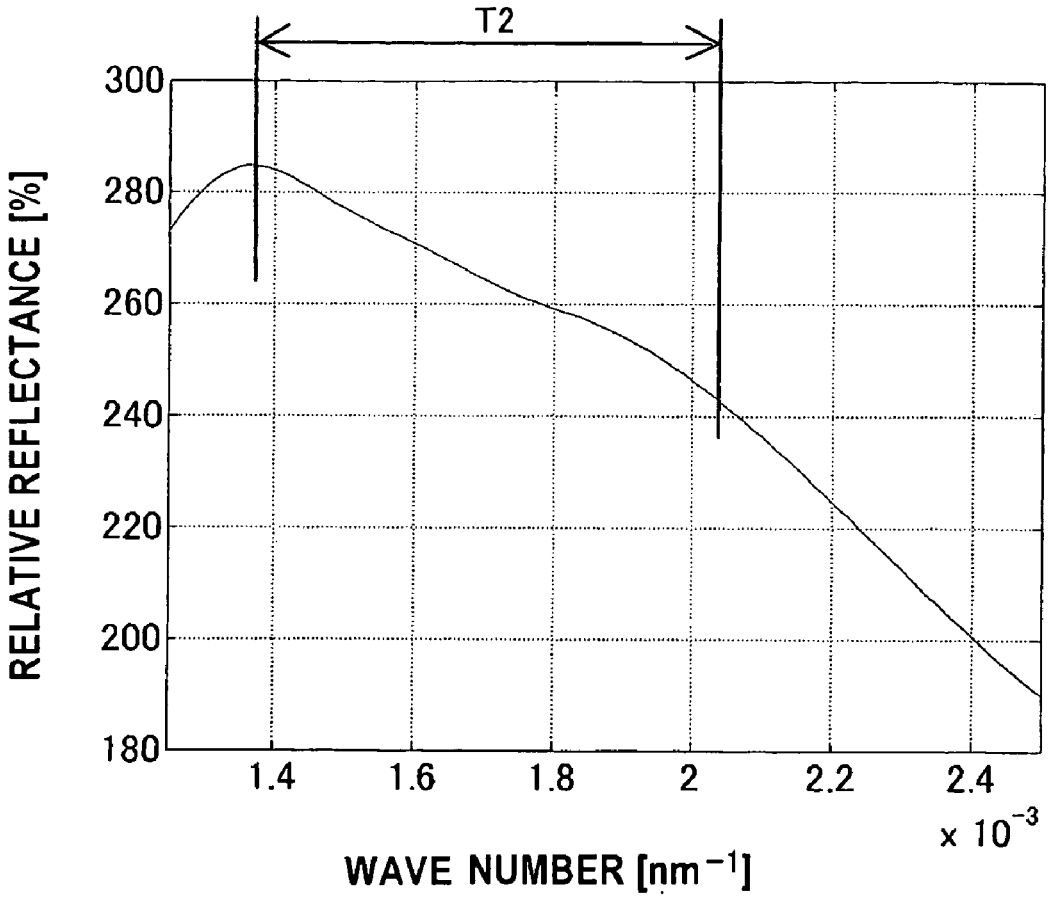
FIG. 56 is a graph showing a spectral waveform obtained by applying the numerical filter having the characteristics shown in FIG. 55 to the spectral waveform shown in FIG. 54.
Figure 57:
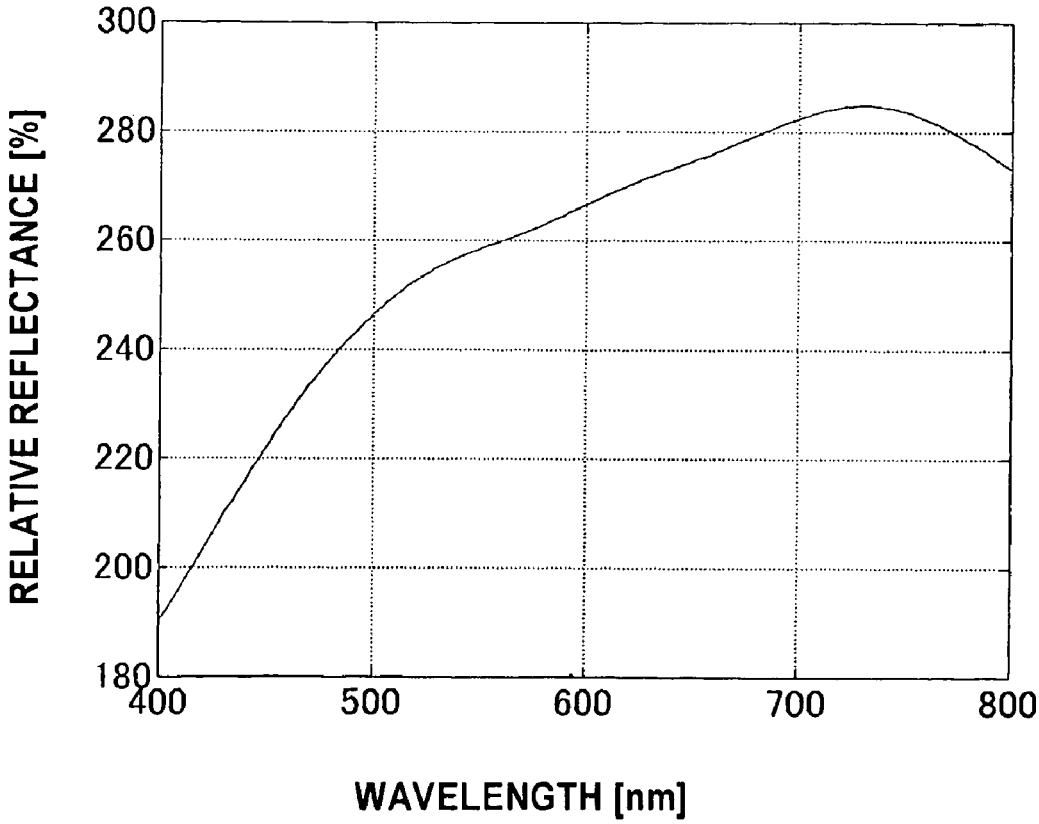
FIG. 57 is a graph obtained by converting wave number along a horizontal axis in FIG. 56 into wavelength.

FIG. 56 is a graph showing a spectral waveform obtained by applying the numerical filter having the characteristics shown in FIG. 55 to the spectral waveform shown in FIG. 54. As can be seen from FIG. 56, the interference component having a short cycle T1 is removed, and only the interference component having a long cycle T2 appears on the spectral waveform. FIG. 57 is a graph obtained by converting the wave numbers on the horizontal axis in FIG. 56 into the wavelengths.

Figure 58:
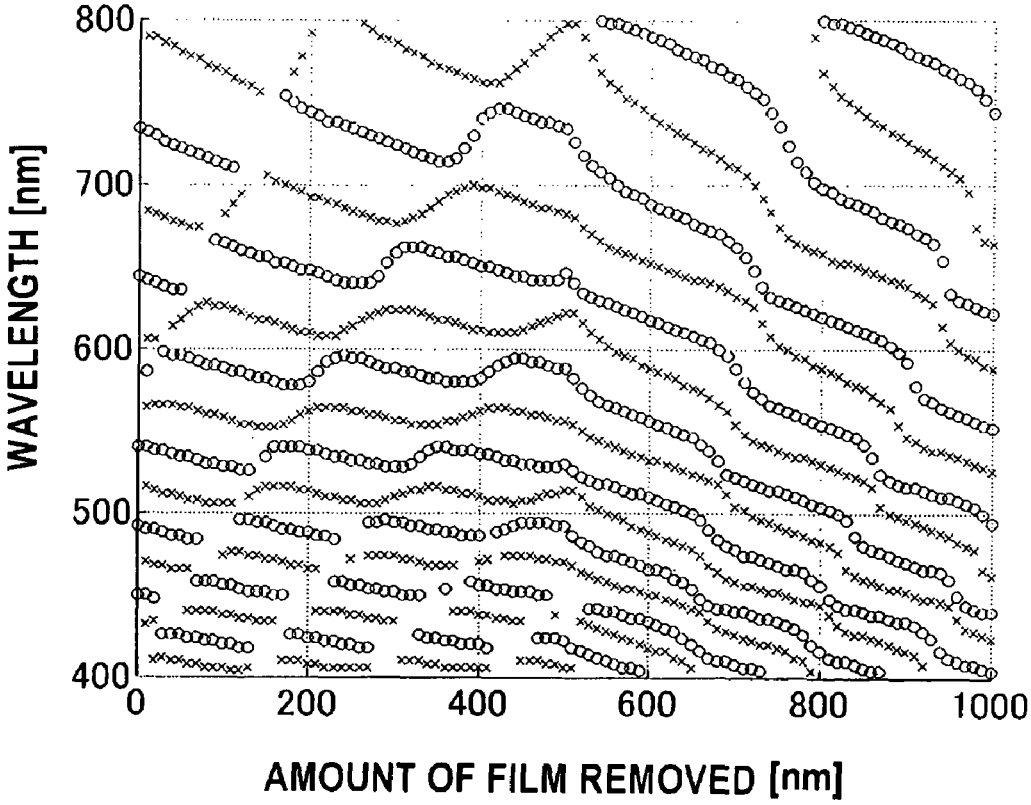
FIG. 58 is a graph obtained by plotting local maximum points and local minimum points, appearing on the spectral waveform before filtering, onto a coordinate system.
Figure 59:
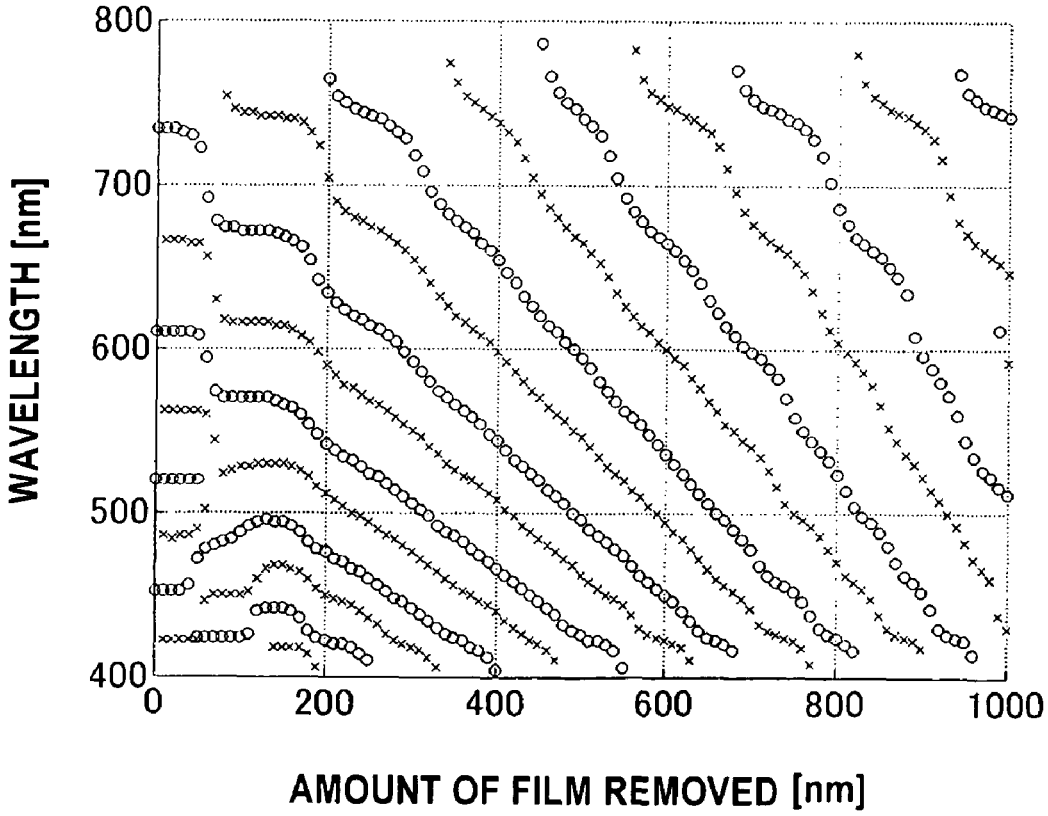
FIG. 59 is a graph obtained by plotting local maximum points and local minimum points, appearing on the spectral waveform after filtering, onto a coordinate system.

FIG. 58 is a graph obtained by plotting local maximum points and local minimum points, appearing on the spectral waveform before filtering, onto a coordinate system. FIG. 59 is a graph obtained by plotting local maximum points and local minimum points, appearing on the spectral waveform after filtering, onto a coordinate system. The coordinate system shown in FIG. 58 and FIG. 59 has a vertical axis indicating wavelength and a horizontal axis indicating amount of the film removed. In FIG. 58 and FIG. 59, a symbol "○" represents coordinates of a local maximum point, and a symbol "X" represents coordinates of a local minimum point. The coordinates of the local maximum point consist of a wavelength determining a location of the local maximum point and an amount of removed film at a point of time when the local maximum point appears. Similarly, the coordinates of the local minimum point consist of a wavelength and an amount of the film removed. The amount of the removed film is an amount of the oxide film that has been removed in the region where the oxide film lies on the metal interconnects. The spectral waveform used for obtaining the distribution diagrams of the local maximum points and the local minimum points (which will be referred to collectively as extremal points) as shown in FIG. 58 and FIG. 59 is a spectral waveform which has been normalized in order to eliminate the influence of the underlying layer, such as the metal interconnects. This normalized spectral waveform is obtained by dividing the relative reflectance at each wavelength by an average of relative reflectances at the corresponding wavelength obtained over the polishing process.

The monitoring unit 15 obtains the spectral waveform each time the polishing table 20 makes one revolution. The local maximum points and the local minimum points of the relative reflectances, appearing on the spectral waveform, are plotted onto the coordinate system, whereby the distribution diagram as shown in FIG. 58 and FIG. 59 can be obtained. The spectral data, obtained by the monitoring unit 15, may be transmitted to other computer, and creating of the distribution diagram may be performed by this computer. As shown in FIG. 21, plural spectral waveforms are obtained at the respective measuring points each time the polishing table 20 makes one revolution. In creating of the distribution diagram, the spectral waveforms obtained at one or more measuring points (e.g., the center of the substrate W) may be used, or average spectral waveforms, each of which is an average of spectral waveforms obtained at the neighboring measuring points, may be used. The monitoring unit 15 may obtain the spectral waveform each time the polishing table 20 makes several revolutions. Further, the spectral waveforms, obtained while the polishing table 20 makes a predetermined number of revolutions, may be averaged (e.g., by means of moving average).

In the distribution diagram of the local maximum points and the local minimum points shown in FIG. 58, an interval between the local maximum point and the local minimum point in a wavelength-axis direction is small due to the influence of the large-thickness portion of the insulating part (see $d_3$ in FIG. 52), and the local maximum points and the local minimum points in their entirety show a gentle downward trend. In addition, due to the influence of a small-thickness portion of the insulating part (see $d_4$ and $d_5$ in FIG. 52), steps appear on loci of the local maximum points and the local minimum points, and the local maximum points and the local minimum points do not show a monotonous decrease. In contrast, in the distribution diagram shown in FIG. 59, an interval between the local maximum point and the local minimum point in a wavelength-axis direction is large, and the local maximum points and the local minimum points show a linear downward trend, except at the polishing initial stage. Therefore, the progress of the removal of the film can be monitored accurately based on the changes in the local maximum points and the local minimum points.

Figure 60:
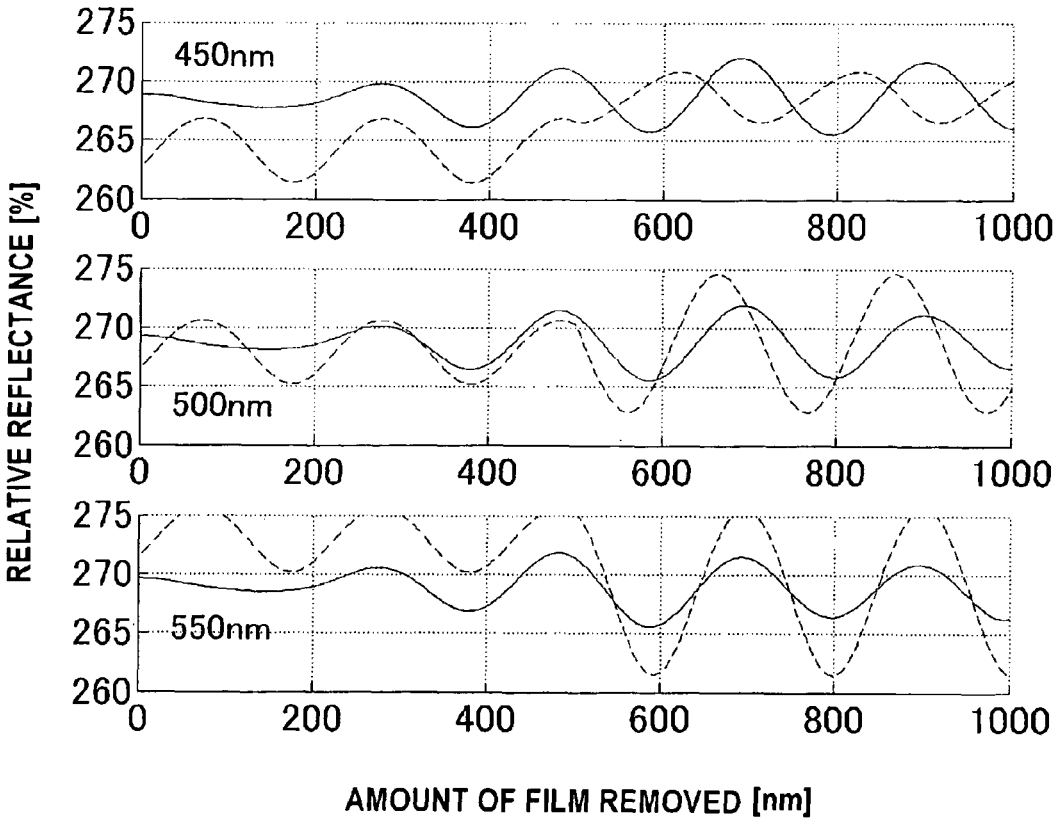
FIG. 60 are graphs each showing a change in the relative reflectance at a wavelength of 600 nm during polishing.

FIG. 60 are graphs each showing a change in the relative reflectance at a wavelength of 600 nm during polishing. In FIG. 60, a vertical axis indicates relative reflectance, and a horizontal axis indicates amount of the film that has been removed (i.e., the polishing time). FIG. 60 shows three graphs. An upper graph shows relative reflectance in a case where the lower oxide film, underlying the metal interconnects, has a thickness of 450 nm, a center graph shows relative reflectance in a case where the lower oxide film has a thickness of 500 nm, and a lower graph shows relative reflectance in a case where the lower oxide film has a thickness of 550 nm. Each solid line represents the change in the relative reflectance after filtering and each dotted line represents the change in the relative reflectance before filtering.

As can be seen from FIG. 60, the relative reflectance before filtering fluctuates with different amplitudes and different phases that depend on the thickness of the lower oxide film formed beneath the metal interconnects. On the other hand, in the three graphs, the relative reflectance after filtering fluctuates with similar amplitudes and similar phases regardless of the thickness of the lower oxide film, and the local maximum points and the local minimum points of the relative reflectance appear at approximately the same times. This means that the relative reflectance after filtering varies depending only on the oxide film on the metal interconnects. Therefore, the monitoring unit 15 can accurately monitor the progress of polishing based on the thickness of the oxide film on the metal interconnects. Further, the monitoring unit 15 can determine the polishing end point by detecting the local maximum point or the local minimum point of the relative reflectance. For example, the monitoring unit 15 can terminate the polishing process when a predetermined time has elapsed from a time when a predetermined extremal point is detected.

The metal interconnects are constituted by metal, such as aluminum or copper. The metal interconnects having a thickness of 500 nm do not permit the light to pass therethrough at all. Therefore, even if the metal interconnects have various heights, the same results can be obtained after the surface steps are removed from the film. Specifically, the variation in the metal interconnects is detected as the variation in the thickness of the insulating part located under the upper surfaces of the metal interconnects. Thus, in this case also, by applying the numerical filter to the spectral waveform, the influence of the variation in the metal interconnects can be removed or reduced. Further, since the increase in the film thickness is synonymous with the increase in the refractive index from the viewpoint of the length of the optical path (nd), it is possible to remove not only the variation in the thickness of the lower oxide film but also the variation in the refractive index, using the same procedures.

The monitoring unit 15 calculates the characteristic value using the relative reflectances obtained from the spectral waveform shown in FIG. 57. Specifically, the monitoring unit 15 calculates the characteristic value S from the relative reflectances at plural wavelengths $\lambda k(k=1, \ldots K)$ using the above-described equations (4) and (5). It should be noted that the characteristic value to be used is not limited to this example and the characteristic value may be calculated using the equation (3).

Figure 61:
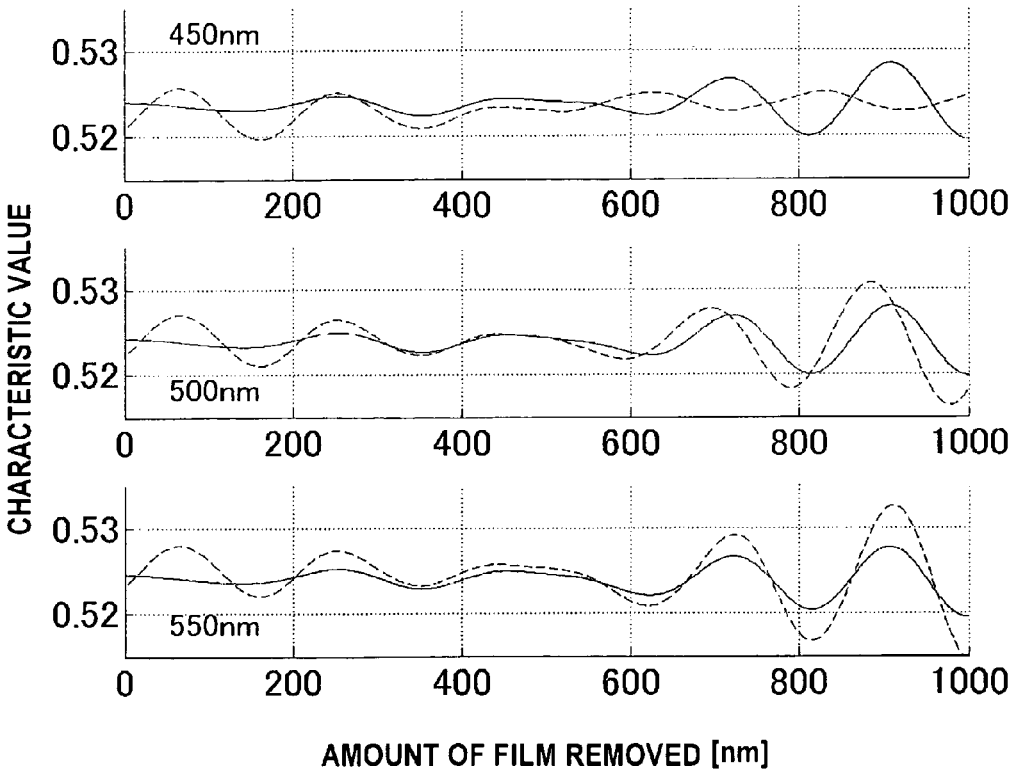
FIG. 61 are graphs each showing a change in the characteristic value.

FIG. 61 is a graph showing a change in the characteristic value S ($\lambda 1$=600 nm, $\lambda 2$=500 nm) obtained from the above-described equation (5). In FIG. 61, a vertical axis indicates characteristic value, and a horizontal axis indicates amount of the film that has been removed (i.e., the polishing time). FIG. 61 shows three graphs. An upper graph shows characteristic value in a case where the lower oxide film, underlying the metal interconnects, has a thickness of 450 nm, a center graph shows characteristic value in a case where the lower oxide film has a thickness of 500 nm, and a lower graph shows characteristic value in a case where the lower oxide film has a thickness of 550 nm. Each solid line represents the change in the characteristic value after filtering and each dotted line represents the characteristic value before filtering.

As can be seen from FIG. 61, the characteristic value fluctuates with similar amplitudes and similar phases with the passage of the polishing time, without being affected by the thickness of the lower oxide film formed underneath the metal interconnects. In other words, it can be seen from FIG. 61 that the characteristic value based on the thickness of the oxide film on the metal interconnects is obtained. Therefore, the monitoring unit 15 can accurately monitor the progress of polishing based on the thickness of the oxide film on the metal interconnects, and can thus realize an accurate polishing end point detection. In this case also, the monitoring unit 15 can terminate the polishing process when a predetermined time has elapsed from a time when a predetermined extremal point of the characteristic value is detected.

Figure 62:
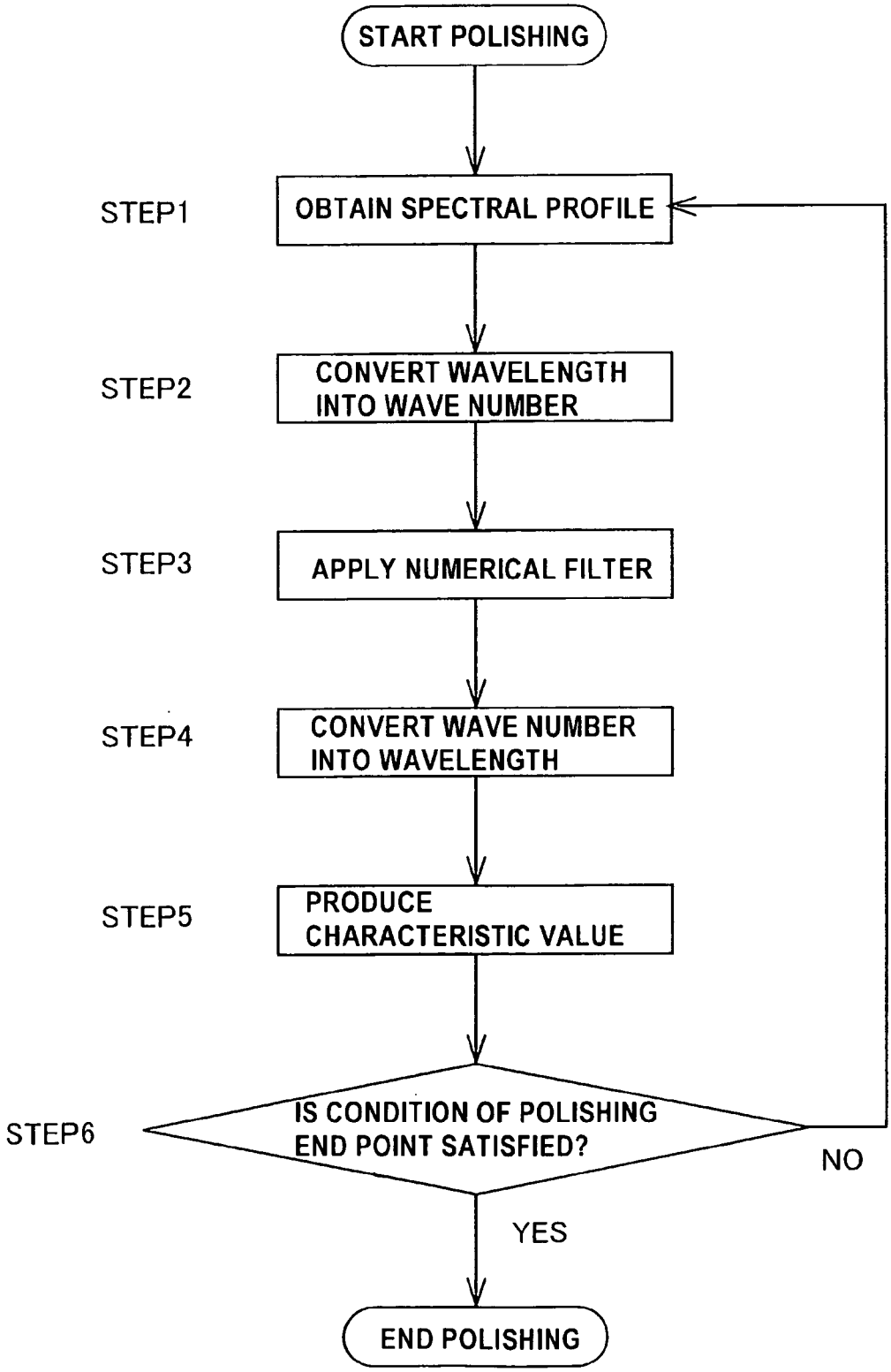
FIG. 62 is a flowchart illustrating a sequence of processing by a monitoring apparatus during polishing.

Next, the processing flow of the monitoring unit 15 during polishing will be described with reference to FIG. 62.

In step 1, the monitoring unit 15 receives measurements of the reflection intensities obtained during polishing from the spectroscope 13, calculates the relative reflectances from the equation (2), and creates a spectral waveform indicating the distribution of the relative reflectances according to the wavelength. In step 2, the monitoring unit 15 converts the wavelength into the wave number to create a spectral waveform indicating the relationship between the wave number and the relative reflectance. Specifically, data along the wavelength axis are converted into data along the wave-number axis, and then spline interpolation is performed, whereby the spectral waveform having appropriate wave-number intervals is obtained.

In step 3, the monitoring unit 15 applies the numerical filter to the converted spectral waveform from forward along the wave-number axis and then applies the numerical filter to the converted spectral waveform from backward. In step 4, the monitoring unit 15 converts the wave number into the wavelength to create a monitoring-purpose spectral waveform from the filtered spectral waveform. In this case also, data along the wave-number axis are converted into data along the wavelength axis, and then spline interpolation is performed, whereby the spectral waveform having appropriate wavelength intervals (e.g., intervals equal to those of the original spectral waveform) is obtained.

In step 5, the monitoring unit 15 calculates the characteristic value as an index for monitoring the polishing process from the monitoring-purpose spectral waveform according to the above-described method. In step 6, the monitoring unit 15 judges whether or not the characteristic value satisfies a predetermined condition of the polishing end point. The condition of the polishing end point is, for example, a point of time when the characteristic value shows a predetermined local maximum point or local minimum point. If the characteristic value satisfies the condition of the polishing end point, the monitoring unit 15 terminates the polishing process. Before terminating the polishing process, the substrate may be over-polished for a predetermined period of time. On the other hand, if the characteristic value does not satisfy the condition of the polishing end point, the procedure goes back to the step 1, and the monitoring unit 15 obtains a subsequent spectral waveform.

Instead of the characteristic value, an estimated film thickness may be used as an index for monitoring the polishing process. This estimated film thickness is determined from a shape of the spectral waveform. The monitoring unit 15 obtains the estimated film thickness as follows. First, prior to polishing a product substrate which is a workpiece to be polished, a sample substrate is prepared and an initial thickness of the sample substrate is measured by a film-thickness measuring device. The sample substrate is of the same type as the product substrate. An optical film-thickness measuring device is used as the film-thickness measuring device. This film-thickness measuring device may be of stand-alone type or may be of in-line type incorporated in the polishing apparatus. Next, the sample substrate is polished under the same polishing conditions as those for the product substrate. During polishing of the sample substrate, plural spectral waveforms are produced at predetermined time intervals according to the above-discussed method. These spectral waveforms are spectral waveforms at the respective polishing times.

After the polishing of the sample substrate, a film thickness of the sample substrate is measured by the above-mentioned film-thickness measuring device. A polishing rate is calculated from the film thickness before polishing, the film thickness after polishing, and a total polishing time. Film thicknesses at the above-mentioned respective polishing times when the spectral waveforms were obtained can be calculated from the film thickness before polishing, the polishing rate, and the corresponding polishing times. Therefore, the spectral waveforms can be regarded as indicating the film thicknesses at the respective polishing times. The spectral waveforms are stored in the monitoring unit 15, with each spectral waveform being associated with the corresponding film thickness. Since the polishing rate during polishing of the sample substrate may not be constant, the film thicknesses thus calculated are relative film thicknesses using the sample substrate as a reference.

During polishing of the product substrate, the spectral waveforms are created by the monitoring unit 15 in the same procedures. The monitoring unit 15 compares each of the created spectral waveforms with the stored spectral waveform of the sample substrate, and estimates a film thickness (relative film thickness) of the product substrate from the closest spectral waveform of the sample substrate.

Figure 63:
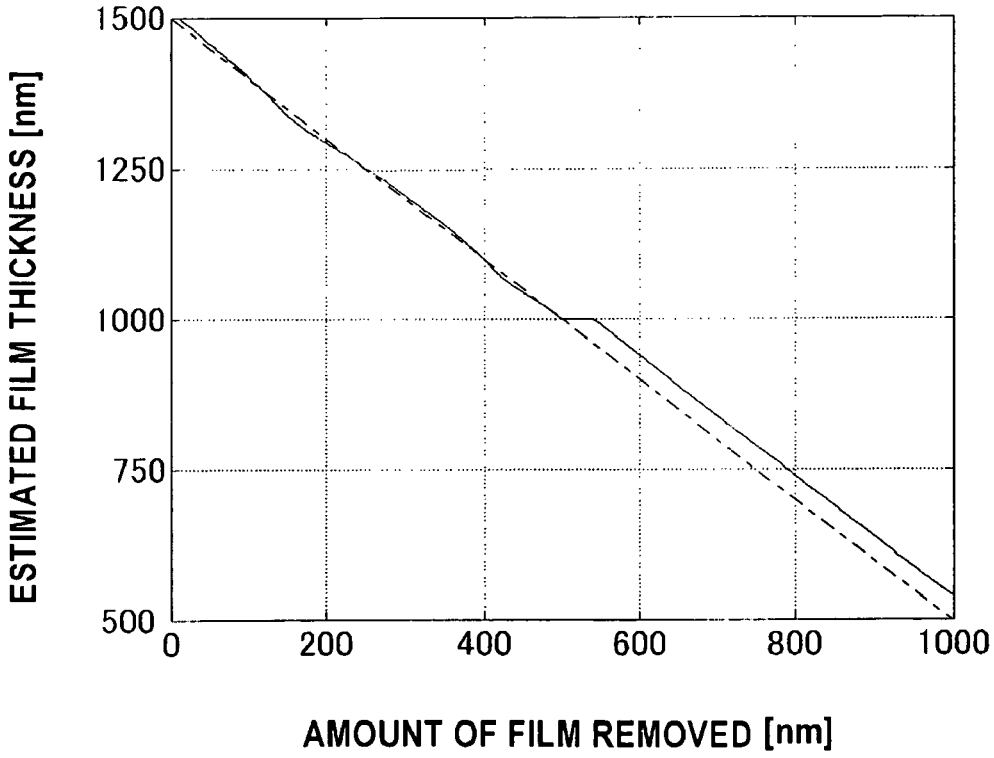
FIG. 63 is a graph showing a change in film thickness estimated from the spectral waveform before filtering.
Figure 64:
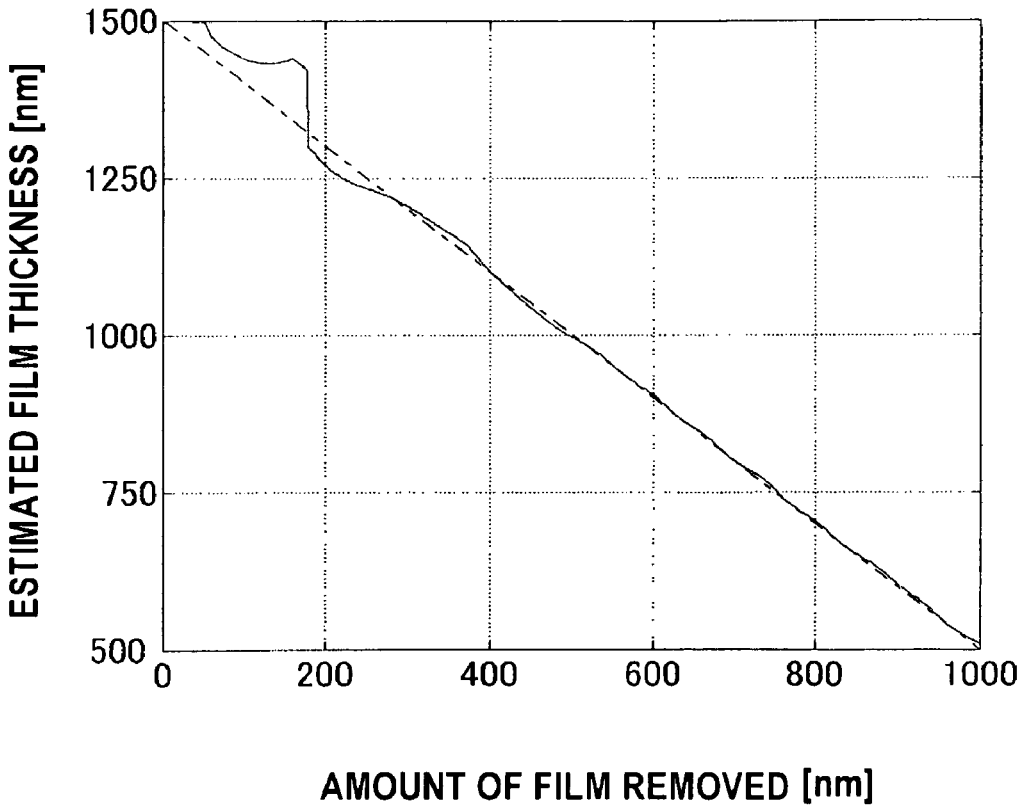
FIG. 64 is a graph showing a change in film thickness estimated from the spectral waveform after filtering.

FIG. 63 is a graph showing a change in the film thickness estimated from the spectral waveform before filtering, and FIG. 64 is a graph showing a change in the film thickness estimated from the spectral waveform after filtering. In FIG. 63 and FIG. 64, a vertical axis indicates estimated thickness of the oxide film on the metal interconnects, and a horizontal axis indicates amount of removed oxide film on the metal interconnects. A dotted line in each graph indicates a reference film thickness obtained from a sample substrate having structures in which an oxide film having a thickness of 500 nm is formed under metal interconnects, and a solid line in each graph indicates an estimated film thickness obtained from a product substrate having structures in which an oxide film having a thickness of 450 nm is formed under the metal interconnects.

As shown in FIG. 63, the estimated film thickness obtained from the spectral waveform before filtering substantially agrees with the reference film thickness until surface steps are removed, i.e., until the amount of the film removed reaches 500 nm. However, after the surface steps are removed, the film thickness is overestimated due to the influence of the underlying oxide film. In contrast, the estimated film thickness obtained from the spectral waveform after filtering does not agree with the reference film thickness at the polishing initial stage. This is because the film thickness is large at the polishing initial stage and the interference components generated in the oxide film on the metal interconnects are reduced to a certain degree by the numerical filter. However, after the surface steps are removed, the estimated film thickness substantially agrees with the reference film thickness. Therefore, by filtering the spectral waveform with the numerical filter, the progress of polishing can be accurately monitored based on the thickness of the oxide film on the metal interconnects. Further, the polishing end point can be detected accurately.

As described above, even when the thickness of the lower film, which lies under the film to be polished, varies from region to region, the progress of polishing can be accurately monitored without being affected by such variation in thickness of the lower film. The polishing monitoring method according to the present embodiment is suitable for use in polishing inter-level dielectric and fabricating shallow trench isolation (STI). For example, this polishing monitoring method can be applied to a process of forming an insulating film on trenches as in STI, with the insulating film in the trenches being regarded as the lower film, irrespective of fabrication processes.

Figure 65:
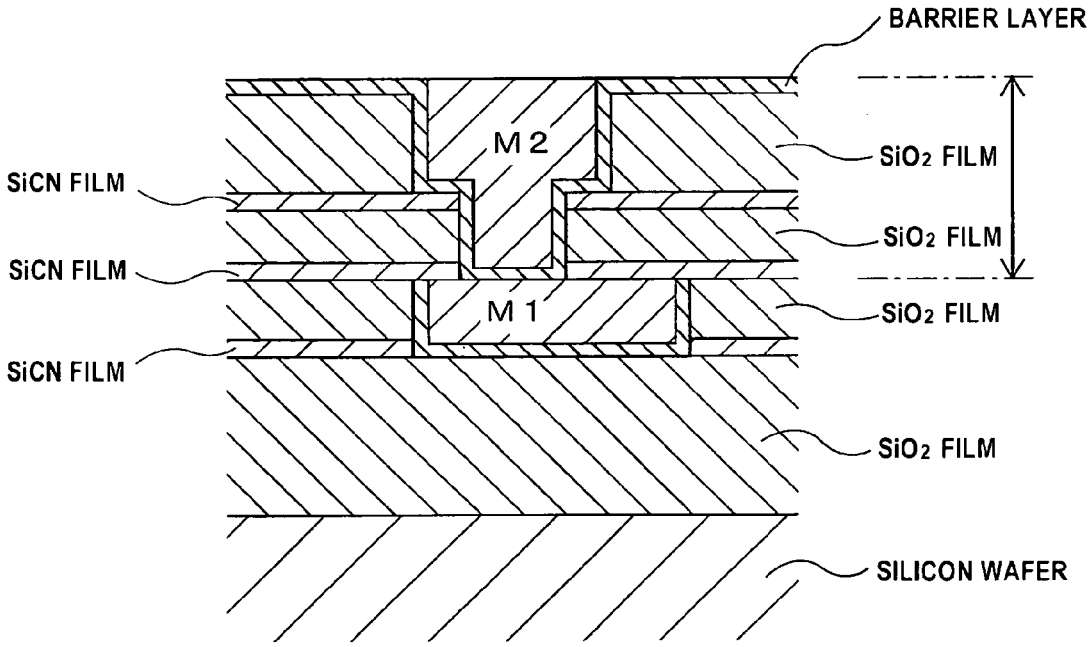
FIG. 65 is a schematic view showing a cross section of a substrate.

Next, an example in which the polishing monitoring method according to the present embodiment is applied to more complicated structures will be described. FIG. 65 is a schematic view showing a cross section of a substrate to be polished. Multiple oxide films ($SiO_2$ films) are formed on a silicon wafer. Two-level copper interconnects, i.e., an upper-level copper interconnects M2 and a lower-level copper interconnects M1 which are in electrical communication with each other via via-holes, are formed. SiCN layers are formed between the respective oxide films, and a barrier layer (e.g., TaN or Ta) is formed on the uppermost oxide film. Each of the upper three oxide films has a thickness ranging from 100 nm to 200 nm, and each of the SiCN layers has a thickness of about 30 nm. The lowermost oxide film has a thickness of about 1000 nm. As previously described, the thickness of the lowermost oxide film may vary relatively greatly from region to region or from substrate to substrate. The following descriptions show results of polishing processes in which a substrate having the lowermost oxide film with a thickness of about 1000 nm (hereinafter, this substrate will be referred to as a substrate I) and a substrate having the lowermost oxide film with a thickness of about 900 nm (hereinafter, this substrate will be referred to as a substrate II) were polished. These polishing processes are for the purpose of adjusting a height of the upper-level copper interconnects M2. For monitoring the height of the upper-level copper interconnects M2 during polishing, a signal corresponding to a thickness from upper surfaces of the lower-level copper interconnects M1 to a surface to be polished (see arrow in FIG. 65) may be detected and monitored. However, an area ratio of the upper surfaces of the lower-level copper interconnects M1 to the surface of the substrate is small in this example, and it is therefore difficult to extract the corresponding signal from the reflected light. Most part of the surface of the substrate is constituted by the insulating layers (the $SiO_2$ film and the SiCN film), and most part of the incident light travels through the insulating layers and is reflected off the upper surface of the silicon wafer.

Figure 66A:
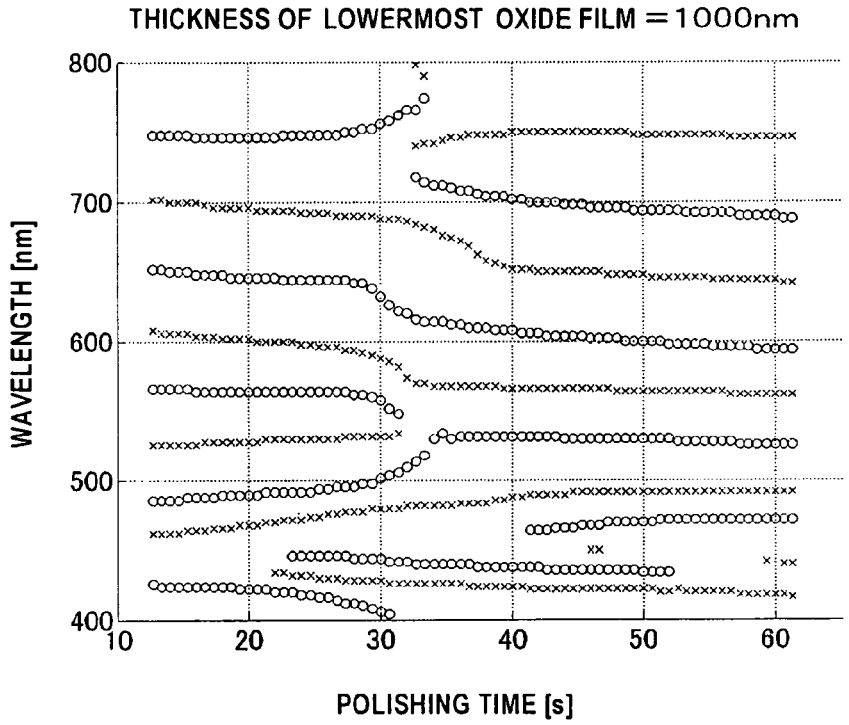
FIG. 66A and FIG. 66B are graphs obtained by plotting local maximum points and local minimum points, appearing on the normalized spectral waveform before filtering, onto the coordinate system.
Figure 66B:
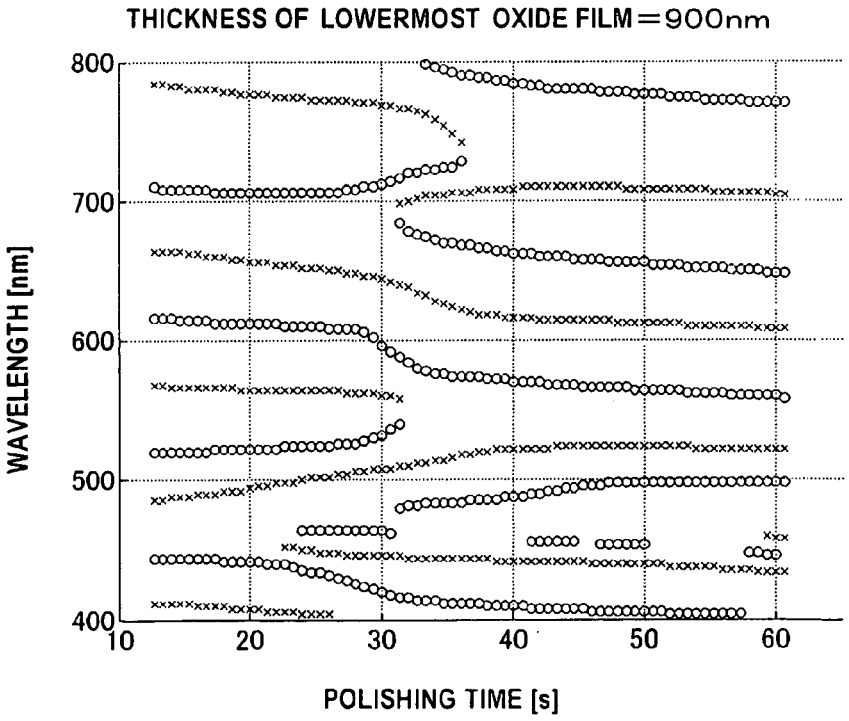

FIG. 66A and FIG. 66B are graphs each showing a distribution of local maximum points and local minimum points appearing on the spectral waveform obtained when polishing the barrier layer (Ta/TaN) and the uppermost oxide film by about 100 nm. In FIG. 66A and FIG. 66B, a horizontal axis indicates polishing time. These graphs are produced by plotting the local maximum points (indicated by ○) and the local minimum points (indicated by X), appearing on the normalized spectral waveform before filtering, onto the coordinate system in the same manner as in FIG. 58. More specifically, FIG. 66A shows a distribution diagram of the extremal points when polishing the substrate I (i.e., the thickness of the lowermost oxide film is about 1000 nm), and FIG. 66B shows a distribution diagram of the extremal points when polishing the substrate II (i.e., the thickness of the lowermost oxide film is about 900 nm). As a result of the influence of optical interference due to the lowermost oxide film, four or five local maximum points appear on the spectral waveform at each time throughout the polishing process. In each graph, wavelengths of the local maximum points and the local minimum points do not vary greatly, regardless of the progress of polishing. However, due to the difference in thickness of the lowermost oxide film, wavelengths of the local maximum points and the local minimum points differ between FIG. 66A and FIG. 66B.

Figure 67:
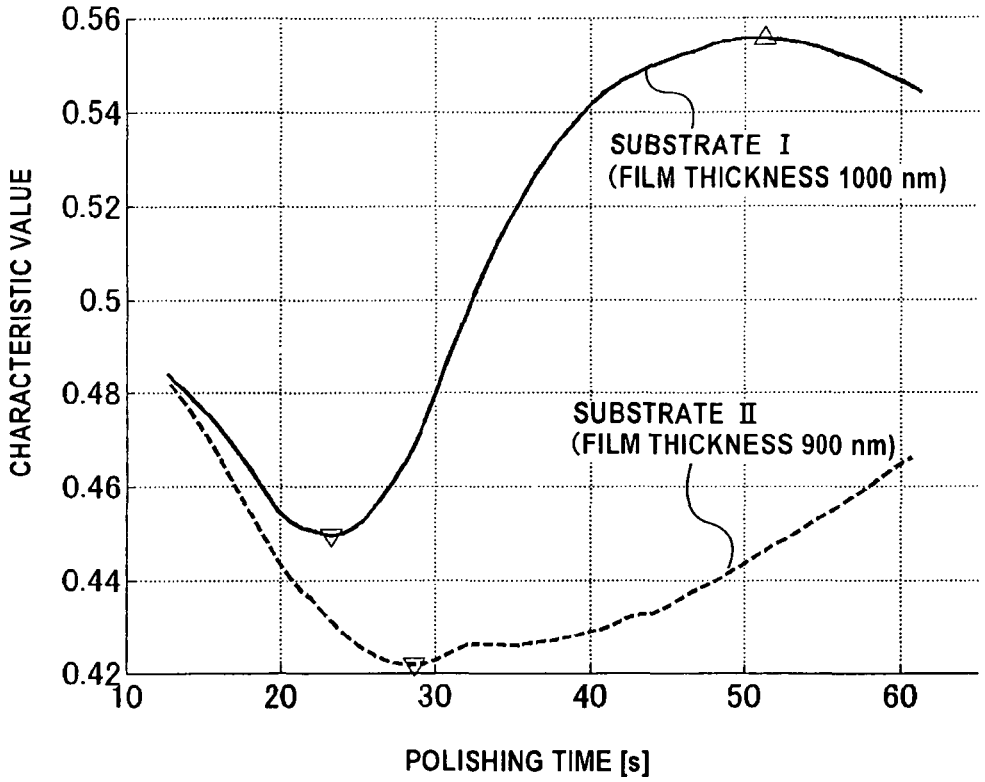
FIG. 67 is a graph showing a temporal variation in the characteristic value calculated based on the spectral waveform before filtering.

FIG. 67 is a graph showing a temporal variation in the characteristic value calculated based on the spectral waveform before filtering. The characteristic value was calculated using the above-described equation (5), and wavelengths were selected such that a local maximum point appears at a polishing time of about 50 seconds when polishing the substrate I having the lowermost oxide film with a thickness of 1000 nm ($\lambda 1$=535 nm, $\lambda 2$=465 nm). A solid line in FIG. 67 indicates the characteristic value when polishing the substrate I, and a dotted line indicates the characteristic value when polishing the substrate II. As can be seen from FIG. 67, a locus of the characteristic value when polishing the substrate II (with the film thickness of 900 nm) differs greatly from a locus of the characteristic value when polishing the substrate I (with the film thickness of 1000 nm). Therefore, use of the characteristic value calculated based on the wavelengths as parameters that are common between the substrate I and the substrate II does not make it possible to monitor the progress of polishing of the substrate II having the lowermost oxide film whose thickness differs from that of the substrate I.

Figure 68A:
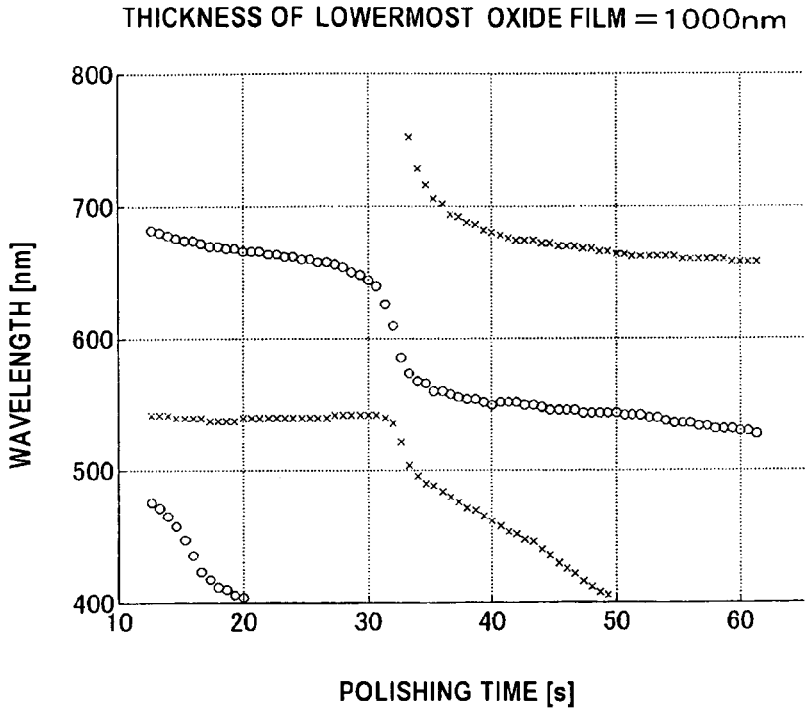
FIG. 68A and FIG. 68B are graphs obtained by plotting local maximum points and local minimum points, appearing on the normalized spectral waveform after filtering, onto the coordinate system.
Figure 68B:
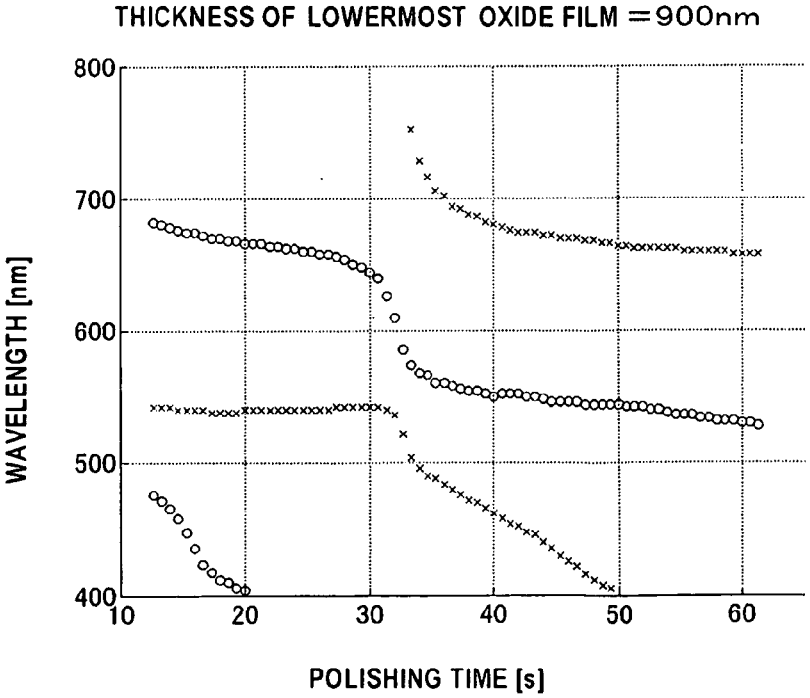

In contrast, FIG. 68A and FIG. 68B are graphs obtained by plotting local maximum points and local minimum points, appearing on the normalized spectral waveform after filtering, onto the coordinate system in the same manner as in FIG. 59. In this example, the numerical filter was designed to have response characteristics in which a gain corresponding to a film thickness of 1000 nm is not more than −40 dB and a gain corresponding to a film thickness of 300 nm is not less than −0.0873 dB. These film thicknesses 1000 nm and 300 nm represent the film thicknesses converted into those of the oxide film. FIG. 68A shows a distribution diagram of local maximum points and local minimum points when polishing the substrate I, and FIG. 68B shows a distribution diagram of local maximum points and local minimum points when polishing the substrate II. It can be seen from these distribution diagrams that application of the numerical filter results in a sparse distribution of the extremal points. Further, it can be seen that the local maximum points and the local minimum points appear at approximately the same wavelengths in FIG. 68A and FIG. 68B and that the influence of the thickness of the lowermost oxide film is reduced.

Figure 69:
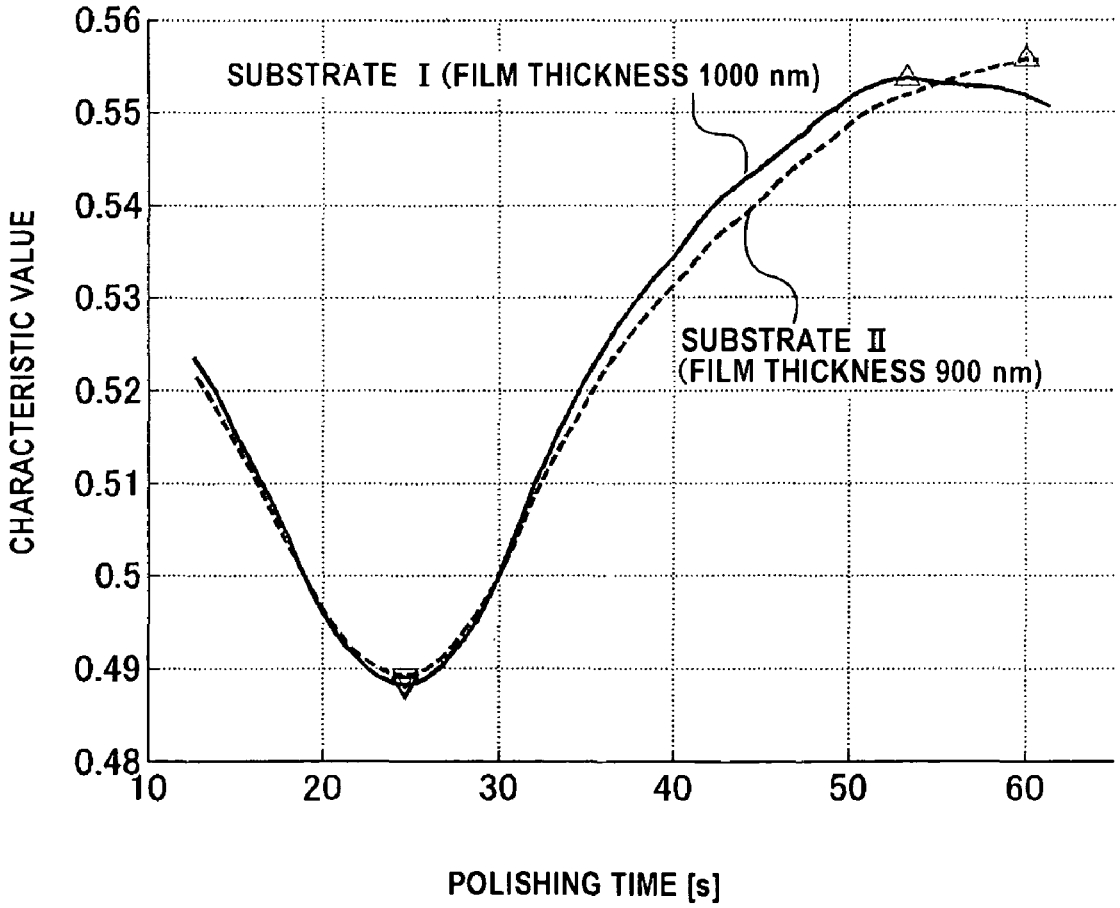
FIG. 69 is a graph showing a temporal variation in the characteristic value calculated based on the spectral waveform after filtering.

FIG. 69 is a graph showing a temporal variation in the characteristic value calculated based on the spectral waveform after filtering. In this example also, the characteristic value was calculated using the above-described equation (5), and wavelengths were selected such that a local maximum point appears at a polishing time of about 50 seconds when polishing the substrate I having the lowermost oxide film with a thickness of 1000 nm ($\lambda 1$=560 nm, $\lambda 2$=460 nm). As can be seen from FIG. 69, the characteristic value of the substrate I (indicated by a solid line) and the characteristic value of the substrate II (indicated by a dotted line) vary so as to describe similar loci with the polishing time. In these two cases, the thicknesses of the uppermost oxide films measured after polishing were 77 nm and 90 nm, respectively. These measurement results agree with the loci of the two characteristic values indicating the fact that polishing of the substrate I precedes polishing of the substrate II. In this manner, filtering of the spectral waveform can reduce the influence of the variation in thickness of the lower insulating film. As a result, even if the thickness of the lower insulating film is unknown, the progress of polishing can be monitored based on the temporal variation in the characteristic value calculated with use of the common wavelengths as the parameters. Further, the polishing end point can be determined by detecting the local maximum point or the local minimum point of the characteristic value.

The wavelengths, selected so as to cause the local maximum point of the characteristic value to appear at about 50 seconds, may not agree with the wavelengths of the extremal points on the normalized spectral waveform that appear at about 50 seconds in the distribution diagrams shown in FIGS. 66A and 66B. If the film thickness is relatively large and the distribution of the extremal points of the spectral waveform shows several downward lines (which are substantially straight lines), searching for wavelengths near the wavelength of the extremal point in the distribution diagram is beneficial for determining wavelengths which are such that a temporal waveform of the characteristic value (i.e., a waveform indicating the temporal variation in the characteristic value) has a local maximum point or local minimum point appearing at a desired time. On the other hand, for some reason, such as a low polishing rate or an influence of the underlying film, the variation in the extremal point of the spectral waveform may be small during polishing and the distribution diagram may not show downward straight lines. Further, there may be cases where the extremal points are sparsely distributed and three or less extremal points appear at each polishing time, for the reason that a film to be polished is thin or the numerical filter is applied. In such cases, the wavelengths that cause the local maximum point or local minimum point of the characteristic value to appear at a certain point of time do not agree with the wavelengths of the extremal points at the same point of time in the distribution diagram. However, even in such cases, wavelengths can be determined such that the temporal waveform of the characteristic value has a local maximum point or local minimum point at a desired time by extracting possible combinations of wavelengths successively from the whole wavelength range (from 400 nm to 800 nm in this example) at certain intervals, calculating the characteristic value, and checking the temporal waveform of the characteristic value. In this case, it is possible to use the steps shown in FIG. 33 as well, except for the step 6 which employs different way of searching for the wavelengths.

In both substrates in FIG. 69, only one local minimum point and only one local maximum point appear on the temporal waveform of the characteristic value, because the amount of the film that has been polished is small. In these cases, it is difficult to grasp the progress of polishing. Thus, it is preferable to select plural combinations of wavelengths such that local maximum points or local minimum points appear at several points of time and monitor temporal waveforms of plural characteristic values. By detecting the local maximum points and/or the local minimum points of the temporal waveforms of the respective characteristic values, the progress of polishing can be grasped in more detail.

The polishing apparatus shown in FIG. 18 can be used in the present embodiment. Specifically, during polishing of the substrate W, the light-applying unit 11 applies the light to the substrate W, and the optical fiber 12 as the light-receiving unit receives the reflected light from the substrate W. During the application of the light, the hole 30 is filled with the water, whereby the space between the tip ends of the optical fibers 41 and 12 and the surface of the substrate W is filled with the water. The spectroscope 13 measures the intensity of the reflected light at each wavelength and the monitoring unit 15 produces the spectral waveform from the reflection intensities measured. The monitoring unit 15 monitors the progress of polishing of the substrate W based on the spectral waveform and determines the polishing end point based on the above-described characteristic value or estimated film thickness. The polishing apparatus shown in FIG. 19 or FIG. 20 may be used in this embodiment.

According to the present embodiment, use of the numerical filter can remove or reduce the optical interference components due to the reflected light that has passed through the lower film underlying the target film to be polished. Therefore, the influence of the variation in thickness of the lower film can be eliminated, and the progress of polishing can be monitored accurately based on the thickness of the uppermost film.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A method of producing a diagram for use in selecting wavelengths of light in optical polishing end point detection, said method comprising:

polishing a surface of a substrate having a film by a polishing pad;

applying light to the surface of the substrate and receiving reflected light from the substrate during said polishing of the substrate;

calculating relative reflectances of the reflected light at respective wavelengths;

determining wavelengths of the reflected light which indicate a local maximum point and a local minimum point of the relative reflectances which vary with a polishing time;

identifying a point of time when said wavelengths, indicating the local maximum point and the local minimum point, are determined; and plotting coordinates, specified by said wavelengths and said point of time corresponding to said wavelengths, onto a coordinate system having coordinate axes indicating wavelength of the light and polishing time.

2. The method of producing the diagram according to claim 1, wherein said determining wavelengths of the reflected light which indicate the local maximum point and the local minimum point comprises:

calculating an average of relative reflectances at each wavelength;

dividing each relative reflectance at each point of time by the average to provide modified relative reflectances for the respective wavelengths; and determining wavelengths of the reflected light which indicate a local maximum point and a local minimum point of the modified relative reflectances.

3. The method of producing the diagram according to claim 1, wherein said determining wavelengths of the reflected light which indicate the local maximum point and the local minimum point comprises:

calculating an average of relative reflectances at each wavelength;

subtracting the average from each relative reflectance at each point of time to provide modified relative reflectances for the respective wavelengths; and determining wavelengths of the reflected light which indicate a local maximum point and a local minimum point of the modified relative reflectances.

4. A method of selecting wavelengths of light for use in optical polishing end point detection, said method comprising:

polishing a surface of a substrate having a film by a polishing pad;

applying light to the surface of the substrate and receiving reflected light from the substrate during said polishing of the substrate;

calculating relative reflectances of the reflected light at respective wavelengths;

determining wavelengths of the reflected light which indicate a local maximum point and a local minimum point of the relative reflectances which vary with a polishing time;

identifying a point of time when said wavelengths, indicating the local maximum point and the local minimum point, are determined;

plotting coordinates, specified by said wavelengths and said point of time corresponding to said wavelengths, onto a coordinate system having coordinate axes indicating wavelength of the light and polishing time to produce a diagram;

searching for coordinates existing in a predetermined time range on the diagram; and selecting plural wavelengths from wavelengths constituting the coordinates obtained by said searching.

5. The method of selecting the wavelengths according to claim 4, wherein said selecting plural wavelengths from wavelengths constituting the coordinates obtained by said searching comprises:

with use of the wavelengths constituting the coordinates obtained by said searching, generating plural combinations each comprising plural wavelengths;

calculating a characteristic value, which varies periodically with a change in thickness of the film, from relative reflectances at the plural wavelengths of each combination;

calculating evaluation scores for the plural combinations using a wavelength-evaluation formula; and selecting plural wavelengths constituting a combination with a highest evaluation score.

6. The method of selecting the wavelengths according to claim 5, wherein said wavelength-evaluation formula includes, as evaluation factors, a point of time when a local maximum point or a local minimum point of the characteristic value appears and an amplitude of a graph described by the characteristic value with the polishing time.

7. The method of selecting the wavelengths according to claim 4, further comprising:

performing fine adjustment of the selected plural wavelengths.

8. The method of selecting the wavelengths according to claim 4, wherein said determining wavelengths of the reflected light which indicate the local maximum point and the local minimum point comprises:

calculating an average of relative reflectances at each wavelength;

dividing each relative reflectance at each point of time by the average to provide modified relative reflectances for the respective wavelengths; and determining wavelengths of the reflected light which indicate a local maximum point and a local minimum point of the modified relative reflectances.

9. The method of selecting the wavelengths according to claim 4, wherein said determining wavelengths of the reflected light which indicate the local maximum point and the local minimum point comprises:

calculating an average of relative reflectances at each wavelength;

subtracting the average from each relative reflectance at each point of time to provide modified relative reflectances for the respective wavelengths; and determining wavelengths of the reflected light which indicate a local maximum point and a local minimum point of the modified relative reflectances.

10. A method of detecting a polishing end point, comprising:

polishing a surface of a substrate having a film by a polishing pad;

applying light to the surface of the substrate and receiving reflected light from the substrate during said polishing of the substrate;

calculating relative reflectances of the reflected light at plural wavelengths selected according to a method as recited in claim 4;

from the calculated relative reflectances, calculating a characteristic value which varies periodically with a change in thickness of the film; and detecting the polishing end point of the substrate by detecting a local maximum point or a local minimum point of the characteristic value that appears during said polishing of the substrate.

* * * * *